US008226076B2

(12) United States Patent
Shirakuma et al.

(10) Patent No.: US 8,226,076 B2
(45) Date of Patent: Jul. 24, 2012

(54) POST-PROCESSING APPARATUS, CONTROL METHOD THEREOF AND IMAGE FORMING SYSTEM

(75) Inventors: Takumi Shirakuma, Tokyo (JP); Takeshi Tamada, Toyohashi (JP); Eiji Sugimoto, Hino (JP); Teruhiko Toyoizumi, Tachikawa (JP); Hideo Yamane, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 113 days.

(21) Appl. No.: 12/898,447

(22) Filed: Oct. 5, 2010

(65) Prior Publication Data

US 2011/0084436 A1 Apr. 14, 2011

(30) Foreign Application Priority Data

Oct. 8, 2009 (JP) ..... 2009-234562
Nov. 25, 2009 (JP) ..... 2009-267512
Dec. 8, 2009 (JP) ..... 2009-278518

(51) Int. Cl.
*B65H 37/04* (2006.01)

(52) U.S. Cl. ..... 270/32; 270/37; 270/45; 493/444; 493/445

(58) Field of Classification Search ..... 270/58.12, 270/58.16, 58.17, 32, 37, 45; 493/444, 445
See application file for complete search history.

(56) References Cited

U.S. PATENT DOCUMENTS

| | | | | |
|---|---|---|---|---|
| 5,382,011 | A * | 1/1995 | Tani | 270/37 |
| 6,644,654 | B1 * | 11/2003 | Mao | 271/220 |
| 6,997,451 | B2 * | 2/2006 | Yoshimura et al. | 270/58.12 |
| 7,883,086 | B2 * | 2/2011 | Kamiya | 271/220 |
| 7,946,569 | B2 * | 5/2011 | Suzuki et al. | 270/58.12 |
| 7,975,999 | B2 * | 7/2011 | Fukasawa et al. | 270/37 |
| 2008/0067730 | A1 * | 3/2008 | Suzuki et al. | 270/37 |
| 2008/0265484 | A1 * | 10/2008 | Fukasawa et al. | 270/58.12 |

FOREIGN PATENT DOCUMENTS

| | | | |
|---|---|---|---|
| JP | 2002-87679 | | 3/2002 |
| JP | 2004-10198 | | 1/2004 |
| JP | 2006347656 | A * | 12/2006 |
| JP | 2006347657 | A * | 12/2006 |

* cited by examiner

*Primary Examiner* — Patrick Mackey
(74) *Attorney, Agent, or Firm* — Finnegan, Henderson, Farabow, Garrett & Dunner, L.L.P.

(57) ABSTRACT

When a sheet is loaded to the sheet tray, the position of a trailing edge regulating section is set in response to the size of an insert sheet. Owing to this, the print sheet ejected from the ejection rollers onto the sheet tray falls onto the surface of the insert sheet. Further, when a booklet with an insert sheet placed therein is produced, an insert sheet is supplied to the sheet tray along the second conveying path. The shift amount of the execution position of center folding or the execution position of center stitching with respect to the sheet bundle is calculated in conformity to the finishing form of the booklet containing the insert sheet.

31 Claims, 30 Drawing Sheets

CENTER FOLDING MODE

FIG. 17a

| INSERT SHEET CONDITION | | SETTING | | | |
|---|---|---|---|---|---|
| INSERT SHEET | SHEET SIZE | CENTER FOLDING EXECUTION POSITION | CENTER STITCHING EXECUTION POSITION | IMAGE FORMING POSITION | TRIMMING EXECUTION POSITION |
| ABSENT | - | NO CHANGE | NO CHANGE | NO CHANGE | NO CHANGE |
| PRESENT | SMALLER THAN PRESCRIBED SIZE | NO CHANGE | NO CHANGE | NO CHANGE | NO CHANGE |
| PRESENT | PRESCRIBED SIZE OR LARGER | POSITION CHANGE | POSITION CHANGE | POSITION CHANGE | POSITION CHANGE |

FIG. 17b

| | CASE 1 | | CASE 2 | |
|---|---|---|---|---|
| SHEET SIZE OF PRINT SHEET "P" | A3 | - | A3 | - |
| INSERT PAGES / BOOKLET PAGES | 10 PAGES / 20 PAGES | 0.1 mm x 10 | 2 PAGES / 4 PAGES | 0.1 mm x 2 |
| SHEET SIZE OF INSERT SHEET "I" | A4 | 2.5 mm | A4 | 2.5 mm |
| TYPE OF INSERT SHEET "I" | 300g SHEET | 1.0 mm | 80g SHEET | 0.5 mm |
| CENTER FOLDING SHIFT AMOUNT | 4.5 mm | | 3.2 mm | |

FIG. 17c

| CENTER FOLDING SHIFT AMOUNT | CASE 1 | CASE 2 |
|---|---|---|
| →IMAGE SHIFT AMOUNT | 4.5 mm | 3.2 mm |
| →TRIMMING SHIFT AMOUNT | 9.0 mm | 6.4 mm |

FIRST SADDLE STITCHING MODE

FIG. 19a

| INSERT SHEET CONDITION | | SETTING | | | |
|---|---|---|---|---|---|
| INSERT SHEET | SHEET SIZE | CENTER STITCHING EXECUTION POSITION | CENTER FOLDING EXECUTION POSITION | IMAGE FORMING POSITION | TRIMMING EXECUTION POSITION |
| ABSENT | - | NO CHANGE | NO CHANGE | NO CHANGE | NO CHANGE |
| PRESENT | SMALLER THAN PRESCRIBED SIZE | NO CHANGE | NO CHANGE | NO CHANGE | NO CHANGE |
| PRESENT | PRESCRIBED SIZE OR LARGER | POSITION CHANGE | POSITION CHANGE | POSITION CHANGE | POSITION CHANGE |

FIG. 19b

| | CASE 1 | |
|---|---|---|
| SHEET SIZE OF PRINT SHEET "P" | A3 | - |
| SHEET SIZE OF INSERT SHEET "I" | A4 | 2.5 mm |
| TYPE OF INSERT SHEET "I" | 80g SHEET | 0.5 mm |
| CENTER STITCHING SHIFT AMOUNT | 3.0 mm | |

FIG. 19c

| CENTER STITCHING SHIFT AMOUNT | CASE 1 |
|---|---|
| →CENTER FOLDING SHIFT AMOUNT | 3.0 mm |
| →IMAGE SHIFT AMOUNT | 3.0 mm |
| →TRIMMING SHIFT AMOUNT | 6.0 mm |

SECOND SADDLE STITCHING MODE

FIG. 21a

| INSERT SHEET CONDITION | | SETTING | | | |
|---|---|---|---|---|---|
| INSERT SHEET | SHEET SIZE | CENTER STITCHING EXECUTION POSITION | CENTER FOLDING EXECUTION POSITION | IMAGE FORMING POSITION | TRIMMING EXECUTION POSITION |
| ABSENT | - | NO CHANGE | NO CHANGE | NO CHANGE | NO CHANGE |
| PRESENT | LARGER THAN PRESCRIBED SIZE | NO CHANGE | NO CHANGE | NO CHANGE | NO CHANGE |
| PRESENT | PRESCRIBED SIZE OR SMALLER | POSITION CHANGE | POSITION CHANGE | POSITION CHANGE | POSITION CHANGE |

FIG. 21b

| | CASE 1 | | CASE 2 | |
|---|---|---|---|---|
| SHEET SIZE OF PRINT SHEET "P" | A3 | - | A3 | - |
| SHEET SIZE OF INSERT SHEET "I" | A4 | -2.5 mm | A4 | -2.5 mm |
| TYPE OF INSERT SHEET "I" | 300g SHEET | -1.0 mm | 80g SHEET | -0.5 mm |
| OVERLAP AMOUNT OF INSERT SHEET "I" | 3.0 mm | -3.0 mm | 6.0 mm | -6.0 mm |
| CENTER STITCHING SHIFT AMOUNT | -6.5 mm | | -9.0 mm | |

FIG. 21c

| CENTER STITCHING SHIFT AMOUNT | CASE 1 | CASE 2 |
|---|---|---|
| →CENTER FOLDING SHIFT AMOUNT | -6.5 mm | -9.0 mm |
| →IMAGE SHIFT AMOUNT | -6.5 mm | -9.0 mm |
| →TRIMMING SHIFT AMOUNT | 13.0 mm | 18.0 mm |

POST-PROCESSING APPARATUS, CONTROL METHOD THEREOF AND IMAGE FORMING SYSTEM

This application is based on Japanese Patent Application No. 2009-234562 filed on Oct. 8, 2009, No. 2009-267512 filed on Nov. 25, 2009 and No. 2009-278518 filed on Dec. 8, 2009 with Japanese Patent Office, the entire content of which is hereby incorporated by reference.

BACKGROUND OF THE INVENTION

The present invention relates to a post-processing apparatus, the control method thereof and an image forming system equipped with the aforementioned post-processing apparatus.

There has been a widespread use of multi-functional peripherals composed mainly of a photocopier and further equipped with functions of a printer and facsimile. These multi-functional peripherals are provided with various forms of functions conforming to individual purposes of use for the purpose of realizing various user requirements in recent years. For example, one of the commonly known products is a post-processing apparatus for producing a booklet by a saddle stitching or center folding process, using print sheets as sheets with an image formed thereon by an image forming apparatus. In this type of post-processing apparatus, a prescribed number of sheets ejected from a sheet ejection section through the conveying path inside the apparatus are stacked on a sheet tray in the apparatus, and a bundle of these sheets are processed to form a booklet, in the generality of cases.

Incidentally, when such a booklet is produced, there is demand that questionnaire forms or sheets containing listed corrections of prints in the booklet should be inserted into the booklet as insert sheets. Since the insert sheets are to be placed between pages of the booklet, they are smaller than the external size of the booklet, namely, smaller than half the size of the print sheet. To insert such insert sheets into the booklet, insert sheets have to be placed between pages by manual work after production of the booklet. From the viewpoint of working efficiency improvement, it is required that the insert sheets in the state of being inserted in a booklet should be finished in a series of operations of producing a booklet by a post-processing apparatus.

For example, in one of the methods disclosed in the Japanese Unexamined Patent Application Publication No. 2004-10198, the sheet bundles having the same size are subjected to saddle stitching, whereby a booklet is produced. In the other method disclosed therein, a sheet having a size more than twice the size of a sheet bundle is center-folded to wrap the sheet bundles having the same size, whereby a booklet provided with a cover sheet is formed.

However, when an attempt is made to eject the insert sheet to the sheet tray together with the print sheets as base sheets of the booklet in order to finish the booklet with the insert sheet placed therein, the trailing edge of the next print sheet to be ejected might be located forward on the sheet tray as compared with the leading edge of the last ejected insert sheet. In this case, when the sheet bundle including the print sheet and the insert sheet is aligned, the trailing edge of the print sheet will interfere with the leading edge of the insert sheet, with the result that paper jams will occur or alignment between sheets may not be ensured. To avoid this problem, no process has been taken in the conventional post-processing apparatus to produce a booklet with an insert sheet placed therein.

The technique shown in the Japanese Unexamined Patent Application Publication No. 2004-10198 includes such a description that a plurality of sheets with different sizes are placed on a sheet tray and are subjected to processing, although no method is disclosed to finish a booklet with an insert sheet placed therein. However, according to the method, the position where the sheet is loaded is fixed on the sheet tray. Thus, even when such a method is applied to the case of inserting sheets in a booklet, the aforementioned problem occurs depending on the size of the sheet to be processed.

In view of the problems described above, it is an object of an embodiment of the present invention to finish a booklet with an insert sheet placed between the pages thereof when producing the booklet, by applying the process of saddle stitching or center folding to a print sheet as a sheet ejected from an image forming apparatus.

Incidentally, when finishing a booklet with an insert sheet sandwiched in-between, there are many variations in the finished forms desired by users. In this case, in a series of process of producing a booklet by a post-processing apparatus, the process of center folding or saddle stitching is applied at a prescribed position of the sheet bundle. Thus, when insertion of an insert sheet in such a series of process is taken into account, the finished form desired by the user may not be achieved.

Thus, in view of the problems described above, it is another object of an embodiment of the present invention to make it possible to finish a booklet with an insert sheet placed in-between and to allow the finished forms to be implemented in many variations when producing a booklet by applying the process of saddle stitching or center folding to a print sheet as a sheet ejected from an image forming apparatus.

As is widely known, in the post-processing apparatus, a plurality of sheets fed from the image forming apparatus and having an image formed thereon are aligned and formed in a bundle, and the central portion thereof is stitched by a stapler or others. After that, the bundle is folded at the stitched position and is formed into a booklet, which is then taken out of the apparatus.

In the aforementioned sheet center folding operation, the stitched portion of the sheet is normally pushed into the nip section of folding rollers by a folding knife and the sheet is folded into two parts. Thus, the two-folded portion of center folded sheet bundle faces in the direction of sheet ejection. Accordingly, the sheets are ejected on the tray directly from the sheet ejection section with the two-folded portion serving as the leading edge, and the sheets are stacked on the tray. Alternatively, the sheets are ejected on a conveying unit and are conveyed with the aforementioned two-folded portion facing downstream in the conveying direction. The sheets are then stacked on the loading section downstream of the conveying unit.

The aforementioned sheet bundle is center-folded into two parts, as shown in FIG. 31. This increases the swelling of the portion of the sheet bundle S near the two-folded portion Sa.

In the meanwhile, as described above, when such a sheet bundle S is stacked on the tray or the loading section downstream of the conveying unit with the two-folded portion serving as a leading edge, the bulk on the leading edge increases excessively and the sheets tends to collapse. Thus, the loading capacity is reduced, that is, the quantity of the booklets produced in one operation will be restricted.

For this reason, in one of such post-processing apparatuses known in the conventional art, while the sheet bundle is stacked on the loading tray after being ejected out of the apparatus with the two-folded portion thereof serving as the leading edge, the sheet bundle is reversed by a reversing unit so that the two-folded portion is made to face upstream in the conveying direction, for example, as shown in the Japanese Unexamined Patent Application Publication No. 2002-87679.

In the post-processing apparatus disclosed in the aforementioned Japanese Unexamined Patent Application Publication No. 2002-87679, the sheet bundle ejected from the sheet ejection section with the two-folded portion serving as a leading edge is stacked on the loading tray and is reversed by the reversing unit so that the two-folded portion is made to face upstream in the conveying direction. However, the sheet bundle to be reversed does not have an interleaf SS in the free state in the center-folded sheet, that is, the interleaf is not inserted in the state where saddle stitching or center folding has not been carried out, as in the case of the sheet bundle S of FIG. 31.

The open/close end face arranged on the sheet ejection port in the form biased in the close direction, or the sheet ejection rollers wherein the peripheral speed of the upper roller is higher than that of the lower roller is used as the reversing unit. When the sheet bundle passes through the reversing unit, the leading edge of the sheet bundle is forcibly directed downward, and the sheet bundle falls onto the tray by the own weight, with the result that the two-folded portion faces upstream in the conveying direction.

Thus, when the sheet bundle has fallen onto the tray by the own weight with the two-folded portion facing downward, the two-folded portion is not always so reversed as to face upstream in the direction of conveyance. The two-folded portion may fall downstream in the direction of conveyance. There is no denying that sheet bundle reversing operation may become unstable.

Accordingly, especially when this method is applied to the post-processing apparatus for acquiring the sheet bundle wherein the interleaf has been inserted in the free state in the center-folded sheet, as described above, the stacked sheet bundles may contain some incorrectly reversed sheet bundles, or because of feeding in the incorrectly reversed state, the interleaves in the center-folded sheets may fall from the sheet bundle.

To avoid the incorrect reversing of the sheet bundle by the reversing unit, a proposal has been made to combine the aforementioned open/close end face and sheet ejection rollers wherein the peripheral speed of the upper and lower rollers are different from each other, and to additionally install a pushing member for pushing forward the upper side of the intermediate portion of this sheet bundle when the two-folded portion located on the downstream side of the sheet bundle having passed through the aforementioned open/close end face has reached the tray, in addition to the reversing component parts of the aforementioned open/close end face and sheet ejection rollers. However, this proposal increases the number and parts and raises a cost problem. Not only that, this proposal raises a control difficulty in keeping balance between the open/close operation of the open/close end face and the operation of the sheet ejection rollers and pushing member, with the result that the control system is complicated and the costs are further increased.

Thus, it is a further object of an embodiment of the present invention to provide a post-processing apparatus for ensuring that the fall of the interleaves having been inserted in the free state in the center-folded sheet is prevented in the process of stacking the sheet bundle subsequent to the sheet ejection and that sheet bundles are stacked in a standing and leaning position in an orderly manner without the shape of the sheet bundle being collapsed and the loading volume is increased.

SUMMARY

To achieve at least one of the abovementioned objects, a post-processing apparatus reflecting one aspect of the present invention comprises the following.

The first embodiment of the invention is to provide a post-processing apparatus for producing a booklet by the process where the first sheets (for example, print sheets) which is the sheets ejected from an image forming apparatus are saddle-stitched or center-folded. This post-processing apparatus includes: a sheet tray for loading and storing sheets; a conveying path for conveying to the sheet tray, the first sheets, and the second sheets (for example, insert sheets which are to be inserted between pages of the booklet) which have a size in the direction of conveyance smaller than half the size of the first sheets; an sheet ejection section for ejecting to the sheet tray the first sheets and second sheets having been conveyed through the conveying path; a regulating section (for example, a trailing edge regulating section) wherein the sheets stacked on the sheet tray are aligned when brought in contact with the sheet; a drive section for moving the sheets having been loaded on the sheet tray in conformity to the movement of the regulating section when the regulating section is moved toward the leading edge side or trailing edge side of the sheet; a control section for controlling the drive section in response to the size of the second sheets to ensure that, when the third sheets (for example, print sheets) are ejected from the sheet ejection section to the sheet tray, the third sheets will fall onto the surface of the second sheet placed as the topmost sheet on the sheet tray; and a processing section for applying a process of saddle stitching or center folding to the first sheets, second sheets and third sheets stacked on the sheet tray and having been aligned by the regulating section, based on the size of the first sheets.

The second embodiment of the invention is to provide a post-processing apparatus for producing a booklet by applying the process of saddle stitching or center folding to a first sheet which is a sheet ejected from an image forming apparatus. This post-processing apparatus includes: a sheet tray for loading and storing sheets; a conveying path for conveying to the sheet tray the first sheets, and second sheets which have a size in the direction of conveyance different from the size of the first sheets; a processing section wherein, when the saddle stitching process is provided to produce a booklet, the sheet bundles stacked on the sheet tray are provided with center stitching and center folding; whereas, when the center folding process is provided to produce a booklet, the sheet bundles stacked on the sheet tray are provided with center folding; and a control section for calculating the shift amount of the execution position where, when a booklet is to be produced with the second sheet placed therein, the sheet bundle is provided with center folding or saddle stitching, in conformity to the form of the finished booklet including the second sheet thereof.

The post-processing apparatus of the third embodiment of the invention includes: a center folding unit which center-folds sheets; an sheet ejection section for ejecting a sheet bundle consisting of the aforementioned sheets center-folded by the center folding unit and the aforementioned interleaves inserted in the free state in the center-folded sheets; a sheet bundle collecting unit which sequentially receives the sheet bundles ejected from the sheet ejection section, in the vicinity of the sheet ejection section, and stacking the sheet bundles in a standing and leaning position; and a sheet ejection mechanism arranged on the sheet ejection section wherein the sheet bundles are ejected in the orientation so that the sheet bundles with the spread portion facing upward are stacked in the standing and leaning position by the sheet bundle collecting unit, when the centered-folded side of the sheet is assumed to be the folded portion, and the side opposite thereto is assumed to be the spread portion.

BRIEF DESCRIPTION OF THE DRAWINGS

FIGS. 17*a*-17*c* are explanatory diagrams showing a specific example of the center folding mode;

FIGS. 19*a*-19*c* are explanatory diagrams showing a specific example of the first saddle stitching mode.

FIGS. 21*a*-21*c* are explanatory diagrams showing a specific example of the second saddle stitching mode.

DETAILED DESCRIPTION OF THE PREFERRED EMBODIMENT

Figure 1A:
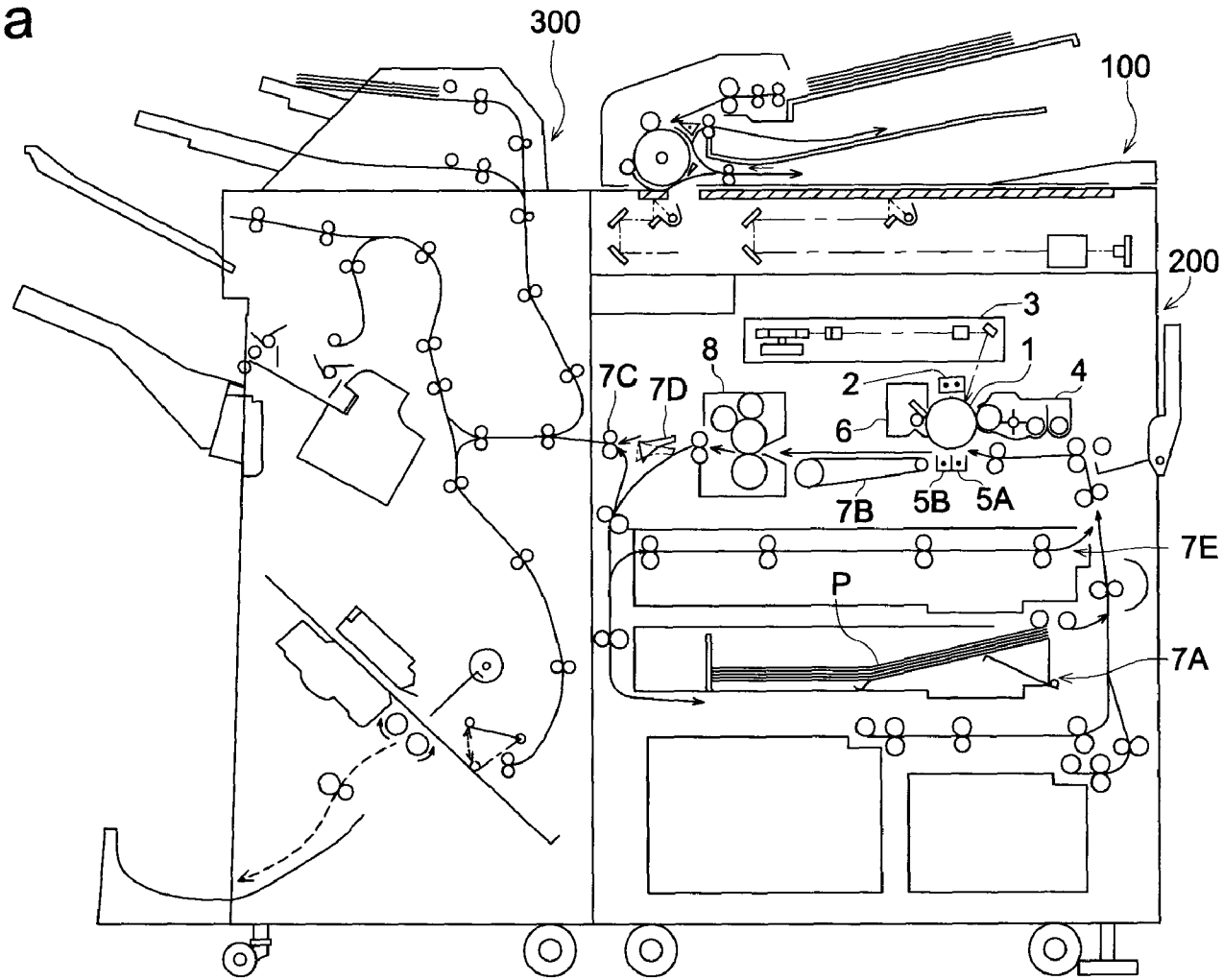
FIG. 1*a* is an explanatory diagram schematically showing the overall structure of an image forming system in a first Example.

The following describes the details of the aforementioned embodiments and other embodiments.

The first embodiment of the invention is preferably further provided with a rewinding section in such a way that a movable arm is swung every time sheets are ejected from the sheet ejection section to the sheet tray, and the ejected sheets are biased toward the trailing edge regulating section by this rewinding section.

The first embodiment of the invention is preferred to have the following structure. That is, the processing section includes a center folding section for center-folding the print sheet and insert sheet having been loaded on the sheet tray. In this case, the center folding section includes a pair of folding rollers and a folding plate which is arranged opposite to the pair of folding rollers which the sheet tray between them and the folding plate goes down toward a pair of folding rollers. The folding plate is moved down to the center of the print sheet with reference to the print sheet, and the print sheet and insert sheet placed on the sheet tray is pushed toward a pair of folding rollers, whereby center folding operation is performed.

Further, in the first embodiment of the invention, the trailing edge regulating section is preferably provided with a movable section for clamping the trailing edges of the sheets stacked on the sheet tray.

The first embodiment of the invention is preferably provided with an introducing section for introducing the insert sheet from the mage forming apparatus into the body of the post-processing apparatus.

Further, the first embodiment of the invention is preferably provided with an insert sheet supply section further including an insert sheet loading section for placing the insert sheet and a sheet feed section for supplying the insert sheet placed on the insert sheet loading section into the body of the post-processing apparatus.

Further, the first embodiment of the invention is preferably configured in such a way that the control section controls the drive section in response to the size of the insert sheet, without any sheet having been loaded on the sheet tray.

The second embodiment of the invention can have the following structure. That is, an acquiring section is further provided to acquire the information that a booklet is produced by the center folding process and the information on the sizes of the print sheet and insert sheet. In this case, based on the result of acquisition by the acquiring section, the control section preferably determines whether the central position of the sheet bundle with reference to the print sheet should be the execution position of center folding, or a position shifted from this central position of the sheet bundle should be the execution position of center folding.

In this case, preferably, the acquiring section further acquires the information on the total number of the booklet to be produced, the page for inserting an insert sheet and the type of the insert sheet. When it has been determined that a position shifted from this central position of the sheet bundle should be the execution position of center folding, the control section preferably calculates the shift amount of the execution position of center folding, from the central position of the sheet bundle, based on the information on the sizes of the print sheet and insert sheet, the total number of the booklet to be produced, the page for inserting an insert sheet and the type of the insert sheet.

Further, the second embodiment of the invention preferably has the following structure. That is, an acquiring section is further provided to acquire the information that a booklet is produced by the saddle stitching process and the information on the sizes of the print sheet and insert sheet as well as the information of whether the insert sheet is also to be center-stitched or not. In this case, based on the result of acquisition by the acquiring section, the control section determines whether the central position of the sheet bundle with reference to the print sheet should be the execution position of center stitching and the execution position of center folding or a position shifted from this central position of the sheet bundle should be the execution position of center stitching and execution position of center folding.

In this case, the acquiring section preferably further acquires the information on the type of the insert sheet. When the insert sheet is not center-stitched together and it has been determined that the execution position of center stitching and execution position of center folding should be shifted, the control section preferably sets the shift amount of the execution position of center stitching and execution position of center folding, from the central position of the sheet bundle, based on the information on the sizes of the print sheet and insert sheet, and the type of the insert sheet.

In the meantime, the acquiring section preferably further acquires information on the type of the insert sheet and the amount of overlap to designate the execution position of center stitching and execution position of center folding with reference to the leading edge of the insert sheet. When the insert sheet is also center-stitched and it has been determined that the execution position of center stitching and execution position of center folding should be shifted, the control section preferably calculates the shift amount of the execution position of center stitching and execution position of center folding, from the central position of the sheet bundle, based on the sizes of the print sheet and insert sheet, type of the insert sheet and the amount of overlap.

In the second embodiment of the invention, based on the calculated shift amount, the control section preferably calculates the shift amount of position of the image forming conducted by the image forming apparatus with respect to the print sheet.

Further, the second embodiment of the invention can be further provided with a trimming section for trimming an end of the front edge of the produced booklet. In this case, based on the calculated shift amount, the control section preferably calculates the shift amount of the execution position of trimming for the booklet.

Further, the second embodiment of the invention can be provided with: an sheet ejection section located above the sheet tray to eject to the sheet tray the print sheet or insert sheet having been conveyed through the conveying path; a trailing edge regulating section wherein the trailing edge position of the sheet bundle stacked on the sheet tray is aligned by the contact of the trailing edge of the sheet ejected from the sheet ejection section and the sheet bundle having been loaded on the sheet tray is moved by the movement of the traveling edge regulating section in the direction of the trailing edge or leading edge of the sheet ejected to the sheet tray; and a drive section for driving the trailing edge regulating section. In this case, the trailing edge regulating section is preferably so arranged that, when a sheet is loaded on the sheet tray, the trailing edge of the sheets ejected from the sheet ejection section to the sheet tray is located between the leading edge of the insert sheet having been loaded on the sheet tray and the trailing edge regulating section. Further, when the saddle stitching process or center folding process is to be performed, the control section preferably sets the position of the trailing edge regulating section by controlling the drive section based on the calculated shift amount and the central position of the sheet bundle with reference to the print sheet.

The sheet bundles of the aforementioned third embodiment are led to the sheet ejection section headed by the folded portion thereof. These sheet bundles are oriented for sheet ejection by the sheet ejection mechanism installed on the sheet ejection section and are then ejected onto the sheet bundle collecting unit in such a way that the sheet bundles, with the spread portion facing upward, are stacked in a standing and leaning position on the sheet bundle collecting unit.

The embodiment of the fourth invention as another embodiment provides an image forming system including an image forming apparatus for forming an image on a sheet and ejecting the image-formed sheet as a print sheet; and a post-processing apparatus that produces a booklet by applying a process of saddle stitching or center folding to the print sheet ejected from the image forming apparatus. The post-processing apparatus of the first embodiment in the invention can be used as this post-processing apparatus constituting the image forming system.

In the fourth embodiment of the invention, in the image forming apparatus, the sequence of the pages where an image is formed on print sheets is preferably modified in such a way that the page of a insert sheet inserted will be located on the side of the trailing edge regulating section, with reference to the print sheet having been loaded on the sheet tray of the post-processing apparatus.

The fifth embodiment of the invention provides an image forming system including: an image forming apparatus for forming an image on a sheet and ejecting an image-formed sheet as a print sheet; and a post-processing apparatus for producing a booklet by applying a process of saddle stitching or center folding to the print sheet ejected from the image forming apparatus. In this case, the post-processing apparatus includes: a sheet tray for loading and storing sheets; a conveying path for conveying to the sheet tray the print sheets and insert sheets which have a size in the direction of conveyance different from the size of the print sheets and which are to be inserted into the booklet; a processing section wherein, when a booklet is produced by the saddle stitching process, the sheet bundles stacked on the sheet tray are provided with center stitching and center folding; whereas, when a booklet is produced by center folding process, the sheet bundles stacked on the sheet tray are provided with center folding; and a control section for calculating the shift amount of the execution position where, when a booklet is to be produced with an insert sheet placed therein, the sheet bundle is provided with center folding or saddle stitching, in conformity to the form of the finished booklet including the insert sheet thereof.

In the fifth embodiment of the invention, based on the calculated shift amount, the control section can calculate the shift amount of the image forming position by the image forming apparatus with reference to the print sheet. At the same time, the shift amount of this image forming position can be notified to the image forming apparatus. Upon receipt of the information on the shift amount of the image forming position from the post-processing apparatus, the image forming apparatus shifts the position of an image to be formed on the print sheet in conformity to the shift amount of the position of image-forming.

The control section can notify the image forming apparatus of the calculated shift amount. Upon receipt of the information on the shift amount from the post-processing apparatus, the image forming apparatus calculates the shift amount of the image forming position with reference to the print sheet. At the same time, the image forming apparatus shifts the position of an image to be formed on the print sheet, in conformity to the shift amount of the position of image-forming.

The sixth embodiment of the invention provides a method of controlling a post-processing apparatus for producing a booklet by applying a process of saddle stitching or center folding to the print sheet which is the sheet ejected from the image forming apparatus. In this case, the post-processing apparatus includes: a sheet tray for loading and storing sheets; a conveying path for conveying to the sheet tray the print sheets and insert sheets which have a size in the direction of conveyance smaller than half the size of the print sheets and which is to be inserted between pages of the booklet; an sheet ejection section for ejecting to the sheet tray the print sheets and insert sheets having been conveyed through the conveying path; a trailing edge regulating section where the trailing edges of sheets stacked on the sheet tray are aligned when brought in contact with the trailing edge of the sheet, on the assumption that, when sheets are ejected from the sheet ejection section to the sheet tray, the leading edge side of the sheet in the direction of conveyance is the leading edge of the sheet and the trailing edge side of the sheet in the direction of conveyance is the trailing edge of the sheet; a drive section for moving the sheets having been loaded on the sheet tray in conformity to the movement of the trailing edge regulating section when the trailing edge regulating section is moved toward the leading edge side or trailing edge side of the sheet; and a processing section for applying a process of saddle-stitching or center-folding to the print sheets and insert sheets stacked on the sheet tray and having been aligned by the trailing edge regulating section, with reference to the sheet size of the print sheets. In this post-processing apparatus, control is provided in such a way that, when the information on the size of the insert sheet is acquired and the print sheet is ejected from the sheet ejection section to the sheet tray, the drive section is controlled in conformity to the sheet size of the insert sheet to ensure that the trailing edge of the print sheet will fall onto the surface of the insert sheet having been loaded as the topmost sheet on the sheet tray.

The seventh embodiment of the invention provides a method of controlling a post-processing apparatus for producing a booklet by applying a process of saddle stitching or center folding to the print sheet which is the sheet ejected from the image forming apparatus. In this case, the post-processing apparatus includes: a sheet tray for loading and storing sheets; a conveying path for conveying to the sheet tray the print sheets and insert sheets which have a size in the direction of conveyance different from the size of the print sheets and which is to be inserted between pages of the booklet; and a processing section where, when a booklet is produced by saddle stitching process, the sheet bundles stacked on the sheet tray are provided with center stitching and center folding; whereas, when a booklet is produced by center folding process, the sheet bundles stacked on the sheet tray are provided with center folding. In this case, control is provided in such a way that information is acquired as to whether or not a booklet is to be produced with an insert sheet placed therein, and if a booklet is to be produced with an insert sheet placed therein, a step is taken to calculate the shift amount of the execution position of the center folding or execution position of center stitching with reference to the sheet bundle, in conformity to the finished form of the booklet including the insert sheet.

The following describes the details of Examples:

EXAMPLE 1

FIG. 1*a* is an explanatory diagram schematically showing the overall structure of an image forming system in the first Example. The image forming system of the first Example is a photocopier provided with an image reading apparatus 100, image forming apparatus 200 and post-processing apparatus 300.

The image reading apparatus 100 is placed on the top of the image forming apparatus 200 and reads the image formed on a document to get image information. This image reading apparatus 100 is provided with an automatic document feed section for reading an image while moving the document.

Based on the image information acquired by the image reading apparatus 100, the image forming apparatus 200 forms an image on the sheet P. The image forming apparatus 200 includes a photoreceptor drum 1, charging section 2, image exposure section 3, development section 4, transfer section 5A, separation section 5B, cleaning apparatus 6 and fixing section 8.

The surface of the photoreceptor drum 1 is uniformly charged by the charging section 2. The image exposure section 3 applies a laser beam on the surface of the photoreceptor drum 1, and performs exposure scanning according to the image formation acquired by the image reading apparatus 100. Thus, a latent image is formed on the surface of the uniformly charged photoreceptor drum 1. The latent image is reversely-developed by the development section 4, whereby a toner image is formed on the surface of the photoreceptor drum 1.

The sheets P stored in the sheet storage section 7A are supplied to the transfer section 5A. The transfer section 5A allows the toner image on the surface of the photoreceptor drum 1 to be transferred onto the sheet P. After that, the separation section 5B ensures that the sheet P with a toner image transferred thereon is separated from the photoreceptor drum 1. The intermediate conveying section 7B conveys the separated sheet P to the fixing section 8. The fixing section 8 applies the process of heating and fixing to the sheet P. The sheet ejection section 7C allows the sheet P provided with heating and fixing process to be ejected to the post-processing apparatus 300. In the meantime, the cleaning apparatus 6 removes the toner remaining on the surface of the photoreceptor drum 1 after the toner image has been transferred to the sheet P by the transfer section 5A.

When an image is formed on both sides of a sheet P, the sheet P having been subjected to a heating and fixing process by the fixing section 8 is switched by the conveying path switching plate 7D over to the reverse conveying section 7E which is in a different conveyance direction from the sheet ejection section 7C. The reverse conveying section 7E reverses the front/rear surfaces of the sheet P by switch-back operation, and conveys the sheet P again to the transfer section 5A. The transfer section 5A forms an image on the rear surface of the sheet P. The sheet P having the image formed thereon is ejected from the sheet ejection section 7C to the post-processing apparatus 300 through the fixing section 8.

Figure 2A:
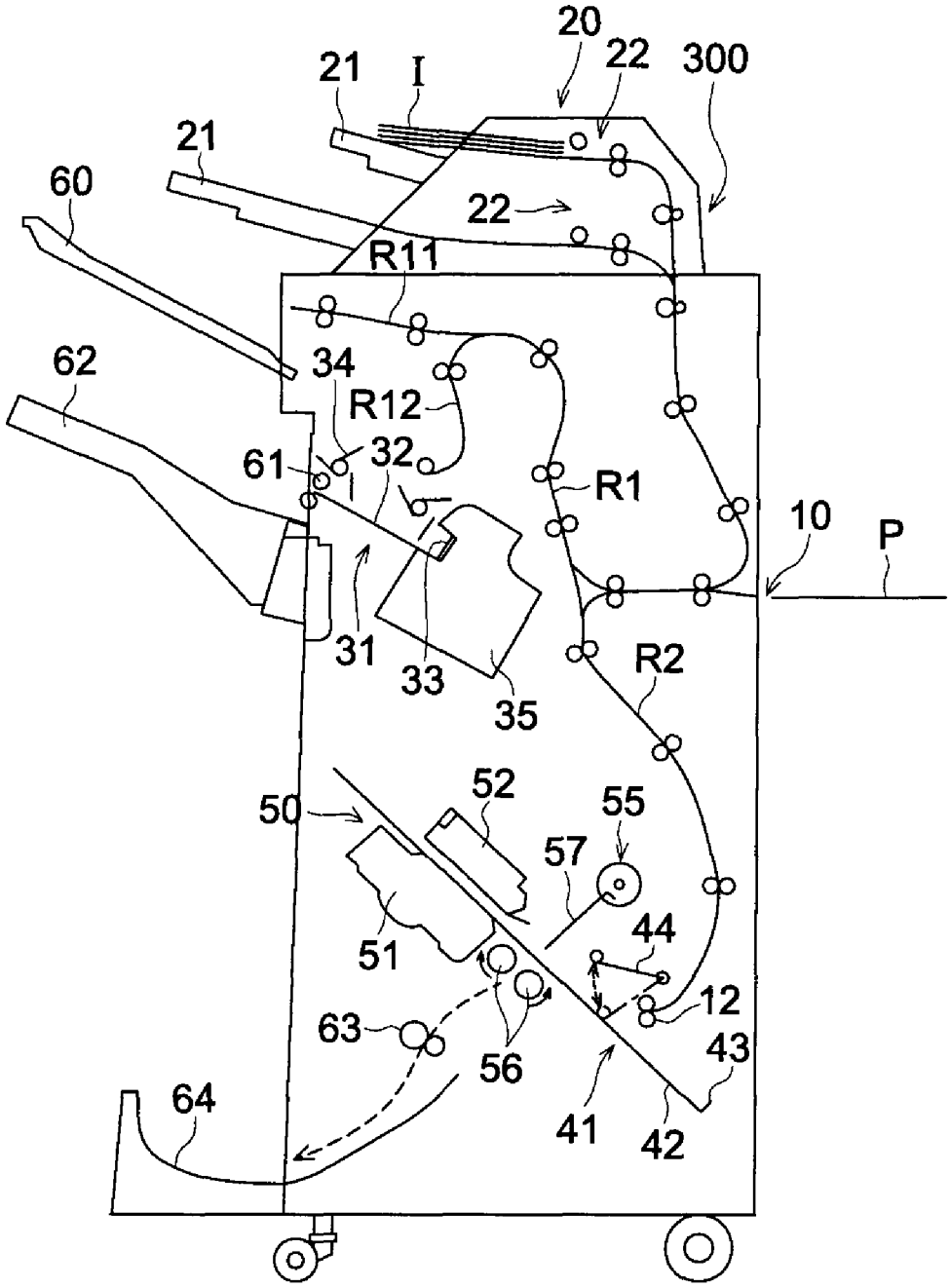
FIG. 2*a* is an explanatory diagram schematically showing the internal structure of a post-processing apparatus 300.

FIG. 2*a* is an explanatory diagram schematically showing the internal structure of a post-processing apparatus 300. The post-processing apparatus 300 applies various forms of post-processing in conformity to the operation mode, to the sheet P ejected from the image forming apparatus 200. The operation mode of this post-processing apparatus 300 includes: a normal mode wherein the sheet P ejected from the image forming apparatus 200 is ejected without any processing performed; an edge binding mode wherein stapling is provided at the vicinity of the edge of the sheets P after a prescribed number of sheets P ejected from the image forming apparatus 20 have been stacked; and a booklet mode wherein a booklet is produced by application of the process of center folding or saddle stitching to a prescribed number of stacked sheets P which have been ejected from the image forming apparatus 20 have been loaded. Here in the center folding process, a prescribed number of stacked sheets P are subjected to center folding, namely, are folded into two parts in the middle, whereby a booklet is produced. In the saddle stitching process, a prescribed number of stacked sheets P are stapled at the center of the sheet. After that, a booklet is produced by applying a center folding process to the sheets P.

One of the characteristics of the present Example is that, when the post-processing apparatus 300 operates in the booklet mode, a booklet is finished while the sheet having a size equal to or smaller than the external size of the booklet (i.e., half the size of the sheet P) is kept inserted between pages of the booklet. In the following description, the sheet inserted between the pages of the booklet is referred to as "insert sheet I". To define the difference from the sheet (insert sheet I) inserted between the pages of the booklet, the sheet P ejected from the image forming apparatus 200 and serving as a base sheet of the booklet is referred to as "print sheet P", for the sake of expediency. The insert sheet I and print sheet P will be collectively called "sheets".

The post-processing apparatus 300 is mainly composed of an introducing section 10, insert sheet supply unit 20, the first intermediate stacker 31, edge binding stapler 35, the second intermediate stacker 41, center stitching stapler 50, center folding section 55, and control section 81 (not illustrated in FIG. 1*a* or FIG. 2*a*).

The introducing section 10 introduces the print sheet P ejected from the image forming apparatus 200 into the post-processing apparatus 300. The introducing section 10 is positioned so as to positionally correspond to the sheet ejection section 7C of the image forming apparatus 200.

The following describes the conveyance paths inside the apparatus for the print sheet P introduced from the introducing section 10. The conveying path on the downstream side of the introducing section 10 is branched off into two, that is, a first conveying path R1 and a second conveying path R2. In response to the switching operation of the switching gate (not illustrated), the print sheet P introduced from the introducing section 10 is supplied to one of the first conveying path R1 and second conveying path R2. When the operation mode is the normal mode or edge binding mode, the switching gate is switched over to the first conveying path R1. When the operation mode is the booklet mode, the switching gate is switched over to the second conveying path R2. Each of the first conveying path R1 and the second conveying path R2 is made up of many conveyance rollers and guide members.

The first conveying path R1 is used to feed the print sheet P introduced from the introducing section 10 to the upper sheet ejection tray 60 or the first intermediate stacker 31. To put it more specifically, the first conveying path R1 is branched off into two systems of conveying paths R11 and R12 on the downstream side of the conveying path. In response to the switching operation of the switching gate (not illustrated), any one of the conveying paths R11 and R12 can be selected. When the operation mode is normal and a special print sheet P such as thick paper is to be ejected, this switching gate is selected to the conveying path R11 of one system. When the operation mode is normal and a great number of print sheets P are to be ejected, or when the operation mode is the edge binding mode, this switching gate is selected to the conveying path R12 of the other system.

In the first conveying path R1, when the print sheet P conveyed along the conveying path R11 of one system, the sheet P is ejected to the upper sheet ejection tray 60 which is fixed on the upper position of the apparatus. Because of the smaller sheet loading capacity, this upper sheet ejection tray 60 is mainly used to eject a special print sheet P such as thick paper which has a high utilization of small amount ejection.

By contrast, in the first conveying path R1, the print sheet P conveyed along the conveying path R12 of the other system is ejected to the first intermediate stacker 31. When the operation mode is normal, the print sheet P ejected to the first intermediate stacker 31 is pushed out toward the sheet ejection rollers 61 every time the print sheet P is ejected. After that, the print sheet P is ejected to the middle sheet ejection tray 62 by the sheet ejection rollers 61. In the meantime, when the edge binding mode is used, the print sheets P ejected to the first intermediate stacker 31 are subjected to edge binding after a prescribed number of sheets have been stacked. After that, a plurality of print sheets P having been subjected to edge binding are pushed out toward the sheet ejection rollers 61, and are ejected to the middle sheet ejection tray 62 by the sheet ejection rollers 61. The middle sheet ejection tray 62 is located on the middle level outside the apparatus and can be moved in the stacking direction in order to permit a large number of sheets to be ejected.

The second conveying path R2 is used to ensure that the print sheet P introduced from the introducing section 10 or the insert sheet I coming from the insert sheet supply unit 20 (to be described later) is conveyed to the second intermediate stacker 41. The sheet ejection section of the second conveying path R2 as the last-stage position of the second conveying path R2 is provided with sheet ejection rollers 12. The sheet ejection rollers 12 are located above the second intermediate stacker 41 (specifically above the upper surface (sheet stacking surface) side of the sheet tray 42 to be described later). The print sheet P or insert sheet I having been conveyed in the apparatus along the second conveying path R2 is ejected to the sheet tray 42.

The print sheet P and insert sheet I ejected to the second intermediate stacker 41 are finished into a booklet with the insert sheet I placed between the pages of the booklet-shaped print sheet P. This booklet is ejected to the lower sheet ejection nay 64 by the sheet ejection rollers 63. The lower sheet ejection tray 64 is fixed to the lower portion outside the apparatus.

The insert sheet supply unit 20 has a function of supplying the insert sheet I into the post-processing apparatus 300, and is composed of an insert sheet loading section 21 and sheet feed section 22. Insert sheets I are stacked on the insert sheet loading section 21, and one topmost sheet of the insert sheets I placed on the insert sheet loading section 21 is fed by the sheet feed section 22. This sheet is then supplied to the third conveying path R3. In the present Example, two sets of insert sheet loading section 21 and sheet feed section 22 are provided so that the insert sheet I placed on individual insert sheet loading section 21 can be supplied.

The third conveying path R3 is made of many conveyance rollers and guide members. The third conveying path R3 is used to convey to the second conveying path R2, the insert sheet I supplied from the sheet feed section 22. The insert sheet I conveyed by the third conveying path R3 is conveyed to the second intermediate stacker 41 along the second conveying path R2, similarly to the case of the print sheet P introduced from the introducing section 10.

As a supply method, the insert sheet I can be supplied to the post-processing apparatus 300 by the image forming apparatus 200 in addition to the insert sheet supply unit 20. To put it more specifically, the image forming apparatus 200 stores the insert sheet I in a sheet supply tray different from that of the print sheet P of the sheet storage section 7A. In the process of the print sheets P being ejected to the post-processing apparatus 300, the insert sheet I is allowed to be present as one of the sheets. Thus, the insert sheet supply unit 20 can be configured to be mounted on the post-processing apparatus 300 on a selective basis. An insert sheet supply unit 20 can be installed if the insert sheet I is a sheet that is not suitable to pass through the fixing section 8 inside the image forming apparatus 200, as in the case of a sheet with paste like a sticker. This will enhance convenience of the post-processing apparatus 300.

The first intermediate stacker 31 includes sheet tray 32, trailing edge regulating section 33 and alignment member 34. The print sheets P conveyed along the first conveying path R1 and R12 are loaded on the sheet tray 32. The following describes the operation wherein sheets are loaded on the sheet tray 32. In this connection, when sheets has been ejected from the sheet ejection rollers 12 to the sheet tray 32, the leading edge side in the direction of sheet feed is referred to as the leading edge of the sheet, while the trailing edge side in the direction of sheet feed is referred to as the trailing edge of the sheet. When the sheet is loaded on the sheet tray 32, the end of the sheet tray 32 corresponding to the sheet leading edge side is called the tray leading edge, while the end of the sheet tray 32 corresponding to the sheet trailing edge side is called the tray trailing edge (the same applies to sheet tray 42 in the second intermediate stacker 41 to be described later).

The trailing edge regulating section 33 is provided on the trailing edge side of the sheet tray 32. When the trailing edge of the print sheet P having been loaded on the sheet tray 32 has been brought in contact with it, the trailing edge position of the print sheet P is aligned. Further, the trailing edge regulating section 33 moves on the sheet tray 32 toward the tray leading edge, as required, whereby the print sheet P having been loaded on the sheet tray 32 is pushed out toward the sheet ejection milers 61. For example, by rotating, the alignment member 34 causes the trailing edge of the print sheet P to be pressed against the trailing edge regulating section 33, whereby the trailing edge of the print sheet P is aligned.

Prescribed positions close to the ends of a plurality of the print sheets P aligned on the sheet tray 32 are stapled in a prescribed direction by the edge binding stapler 35, whereby edge binding is performed. For example, the edge binding stapler 35 performs edge binding close to the trailing edge of the print sheet P. A plurality of print sheets P whose ends are bound by the edge binding stapler 35 are ejected out of the apparatus by the sheet ejection rollers 61, and are ejected to the middle sheet ejection tray 62.

The major components of the second intermediate stacker 41 includes sheet tray 42, trailing edge regulating section 43 and rewinding section 44. The sheet tray 42 stores the sheet ejected from the sheet ejection rollers 12 along the second conveying path R2. The sheets having been loaded on the sheet tray 42 includes the print sheet P ejected from the image forming apparatus 200 and the insert sheet I supplied from the insert sheet supply unit 20 (or image forming apparatus 200). The sheet tray 42 is arranged in such a slanted position that the tray leading edge is located above the tray trailing edge.

In the sheet tray 42, the trailing edge regulating section 43 is arranged on the tray trailing edge side. When brought in contact with the trailing edges of the sheets ejected from the sheet ejection rollers 12, the trailing edge positions of the sheets having been loaded on the sheet tray 42 are aligned by the trailing edge regulating section 43. The trailing edge regulating section 43 is driven by the drive unit (trailing edge drive section 83 to be described later (FIG. 3*a*)), whereby the trailing edge regulating section 43 is allowed to travel on the sheet tray 42 toward the leading edge of the tray or the trailing edge of the tray. This arrangement enables the trailing edge regulating section 43 to move the sheets having been loaded on the sheet tray 42 as a result of its own movement.

In the present Example, the trailing edge regulating section 43 moves, as required, to the positions shown in the following three patterns in conformity to the form of processing of the sheet. The first pattern indicates the position for storing the sheets (print sheet P and insert sheet I) on the sheet tray 42, and is set according to the size of the insert sheet I (length in the direction of conveyance). The second pattern denotes the position where center stitching is performed by the center stitching stapler 50, and is so set that the central portion of the sheet with reference to the size of the print sheet P corresponds to the position to be stapled by the center stitching stapler 50. The third pattern represents the position wherein center folding is performed by the center folding section 55, and is so set that the central portion of the sheet with reference to the size of the print sheet P corresponds to the position of center folding by the center folding section 55.

The rewinding section 44 includes a movable arm which is swingable in the vertical direction around the fixed end, and is arranged above the upper surface of the sheet tray 42. This rewinding section (movable arm) 44 is driven by the drive unit (arm drive section 86 to be described later (FIG. 3*a*)). Thus, every time the sheet is ejected from the sheet ejection rollers 12, the following operation is performed. To put it more specifically, the movable arm is normally placed in the standby mode at the position (home position) above away from the sheet tray 42. When the sheet is ejected to the sheet tray 42, the movable arm swings in the downward direction (in the direction of the sheet tray 42). When the movable arm swings downward and the leading edge thereof is pressed against the sheet on the topmost surface of the sheets having been loaded on the second intermediate stacker 41 (sheet tray 42), the ejected sheet is biased toward the trailing edge regulating section 43. This ensures alignment of the trailing edges of the ejected sheets. Upon completion of a series of operations of biasing the sheet, the movable arm goes back to the home position.

The center stitching stapler 50 is located on the tray leading edge side of the sheet tray 42, and staples the central portion of the sheet with reference to the print sheet P on the sheet tray 42, whereby saddle stitching is performed. The center stitching stapler 50 is made up of a driver 51 and clincher 52. These two units are placed opposed to each other through the sheet tray 42. The center stitching stapler 50 allows the driver 51 to drive staples (needles) through the sheets. The clincher 52 bends the top of the staple driven through the print sheets P. Thus, the print sheets P are stapled. The sheet tray 42 is provided with a slit (not illustrated) capable of inserting the staples used for stapling operations by the center stitching stapler 50.

The center folding section 55 is located at an approximately central portion of the sheet tray 42, and performs center folding operation with reference to the print sheet P of the sheet tray 42. This center folding section 55 includes a pair of folding rollers 56 arranged on the lower surface (opposite to the sheet loading surface) side of the sheet tray 42; and a folding plate 57 arranged on the upper surface side of the sheet tray 42 so as to be opposed to a pair of folding rollers 56. The axial direction of a pair of folding rollers 56 and the direction where the folding plate 57 is arranged are perpendicular to the direction of conveyance. Further, the sheet tray 42 is provided with a slit (not illustrated) capable of inserting the folding plate 57 used for center folding operations.

A pair of the aforementioned folding rollers 56 are driven by the drive unit (folding roller drive section 85 to be described later (FIG. 3*a*)) so that they will rotate facing each other. The folding plate 57 is driven by the drive unit (folding plate drive section 84 to be described later (FIG. 3*a*)), and can be operated in the direction perpendicular to the sheet tray 42. When this center folding section 55 is used for center folding, the folding plate 57 is lowered so that the sheet central portion is pushed inside between a pair of folding rollers 56, and the rollers 56 are rotated in the direction of rotation, whereby the sheet is center-folded. The center folded sheet is conveyed by the sheet ejection rollers 63, and is ejected to the lower sheet ejection tray 64 outside the apparatus.

Figure 3A:
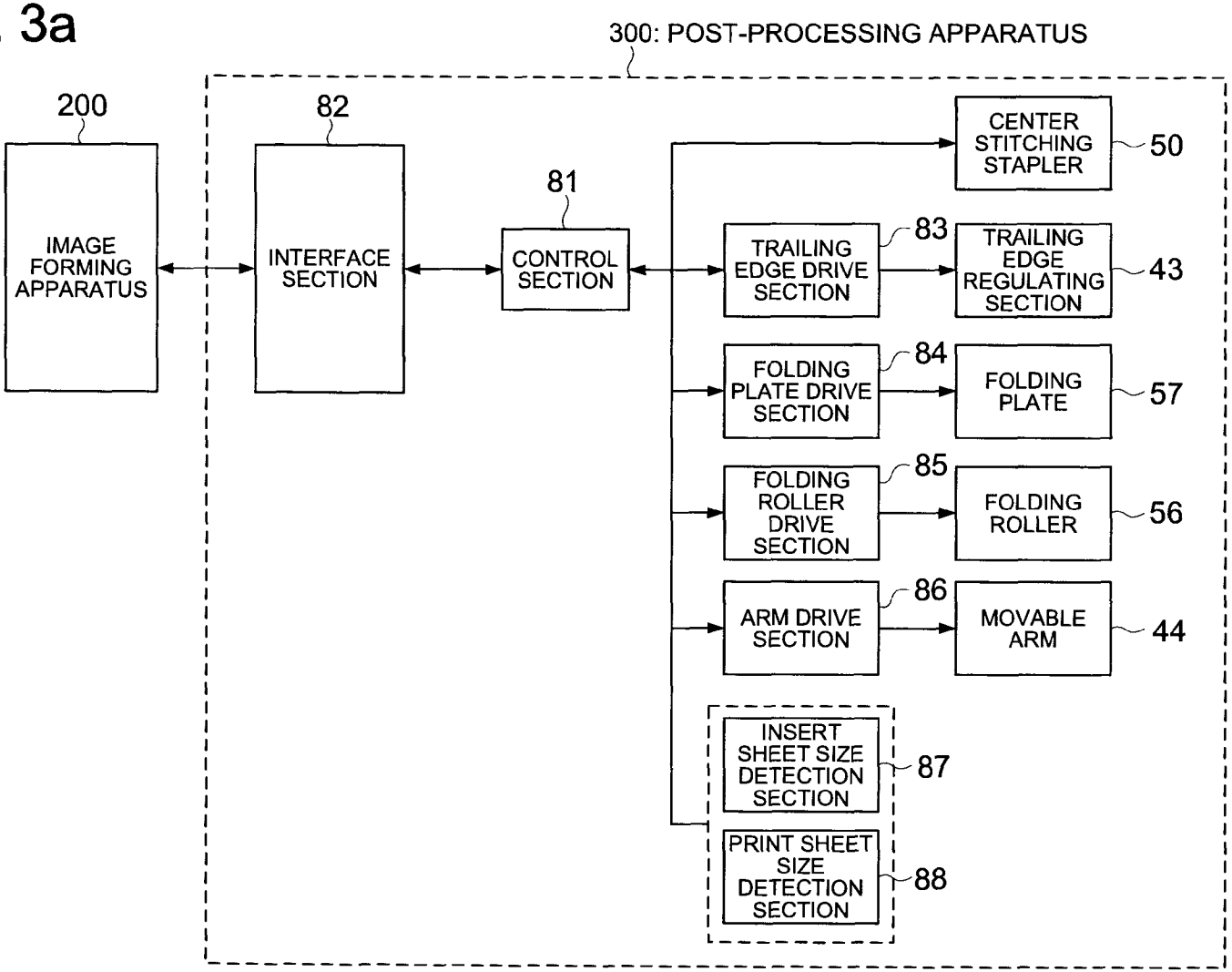
FIG. 3*a* is a block diagram showing the functional structure (especially the major portions for producing a booklet) of the post-processing apparatus 300.

FIG. 3*a* is a block diagram showing the functional structure of the post-processing apparatus 300, particularly describing the major portions for producing a booklet. The control section 81 takes charge of overall control of the post-processing apparatus 300. The control section 81 can use a microcomputer mainly composed of a CPU, ROM, RAM and I/O interface. This control section 81 performs various forms of calculation according to the control program stored in the ROM, and controls the operations of the post-processing apparatus 300 based on the result of this calculation.

To put it more specifically, the control section 81 can exchange signals with the image forming apparatus 200 via the interface section 82. This arrangement allows the control section 81 to get various forms information on the operation mode of the post-processing apparatus 300, the position (between pages) where the insert sheet I is to be inserted, the timing for supplying the insert sheet I along the second conveying path R2, and the timing for the last print sheet P to be ejected.

Further, the control section 81 controls the time interval for ejecting the insert sheet I or print sheet P to the sheet tray 42, and the operations of each of the drive sections 83 through 86 and center stitching stapler 50. The trailing edge drive section 83 drives the trailing edge regulating section 43 in the direction of the leading edge and trailing edge of the tray. The folding plate drive section 84 drives the folding plate 57 in the vertical direction and the folding roller drive section 85 drives a pair of folding rollers 56 to rotate. The aim drive section 86 drives the rewinding section (movable arm) 44.

The insert sheet size detection section 87 includes a sensor (not illustrated) located on the insert sheet loading section 21, for example, and detects the size of the insert sheet I supplied from the insert sheet supply unit 20. Further, the print sheet size detection section 88 includes a sensor (not illustrated) arranged on the second conveying path R2, for example, and is used to detect the size of the print sheet P supplied from the image forming apparatus 200. If information on the size of the print sheet P or insert sheet I can be obtained by exchange of signals with the image forming apparatus 200, these detectors 87 and 88 need not be provided.

The following describes the specific operations of the post-processing apparatus 300 when producing a booklet with an insert sheet I inserted between the pages thereof. The following description uses an example wherein a booklet is produced by saddle stitching employing two print sheets P. This is the case where the insert sheet I is inserted between the pages consisting of the first and second print sheets P, and is not the case where the insert sheet I is inserted between pages in the middle of the booklet, as shown in FIG. 5. For the sake of expediency, FIG. 4 shows only the major portions related to production of a booklet in the post-processing apparatuses 300 of FIG. 2*a*. At the same time, the alphabets attached to the Fig. number are used to represent the processes in chronological order. Reference numerals are assigned only in the FIG. 4*a*, and are omitted in other figures.

In the first place, the control section 81 picks up the signals from the image forming apparatus 200 to get the information denoting that the processing mode is a booklet mode using the process of saddle stitching, the information on the position where the insert sheet I is inserted, and the information on the sizes of the insert sheet I and print sheet P. As described above, the sizes of the insert sheet I and print sheet P can be acquired from the insert sheet size detection section 87 and print sheet size detection section 88, respectively, in conformity to the apparatus configuration.

Figure 4A:
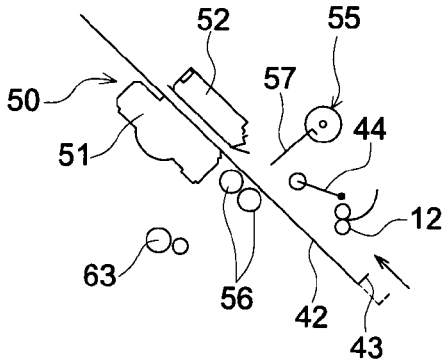
FIGS. 4*a*-4*h* are explanatory diagrams chronologically showing the operation of the major portions for producing a booklet in the post-processing apparatus 300.
Figure 5:
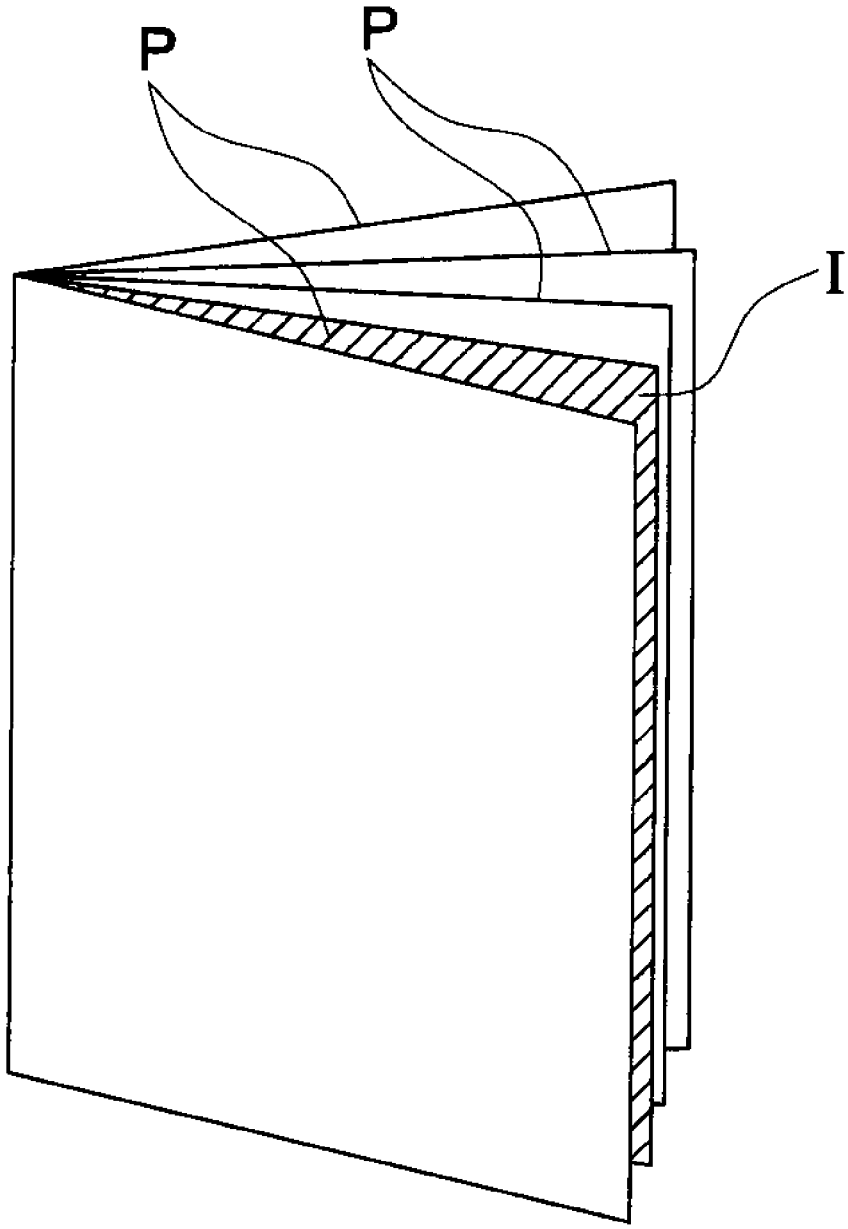
FIG. 5 is an explanatory diagram showing a finished booklet with an insert sheet I inserted between pages thereof.

As shown in FIG. 4*a*, the control section 81 controls the trailing edge drive section 83 to move the trailing edge regulating section 43, and thereby the position thereof is set. To put it more specifically, the control section 81 sets the position of the trailing edge regulating section 43 in response to the size of the insert sheet I in such a way that, when the second print sheet P is ejected from the sheet ejection rollers 12 to the sheet tray 42, the trailing edge of the print sheet P will be positioned between the leading edge of the insert sheet I having been loaded on the sheet tray 42 and the trailing edge regulating section 43 (on the surface of the insert sheet I). In this case, a test and simulation are conducted and calculation is made in advance to find the amount of shift of the trailing edge regulating section 43 from the initial position in conformity to the insert sheets I of various sizes. The relationship between the size of the insert sheet I and the shift amount of the trailing edge regulating section 43 is stored in the ROM of the control section 81. When the sheet is loaded actually, the control section 81 controls the trailing edge drive section 83 based on the relationship of the correspondence, stored in the ROM, and the size of the insert sheet I to be inserted actually, and sets the position of the trailing edge regulating section 43 when sheets are loaded.

Figure 4B:
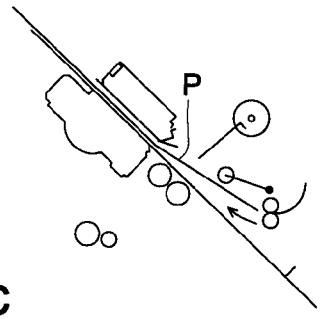
Figure 4C:
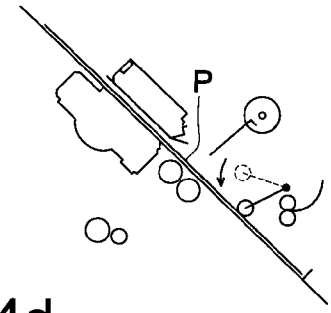
Figure 4D:
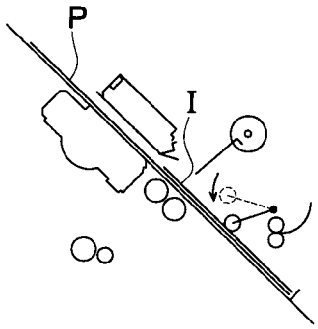
Figure 4E:
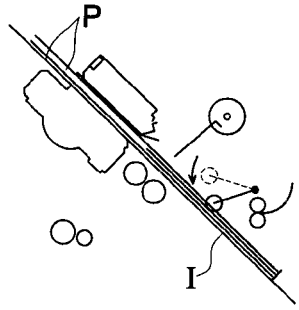

This is followed by the step shown in FIG. 4*b*. As illustrated, when the first print sheet P has been ejected to the sheet tray 42 by the sheet ejection rollers 12, the control section 81 controls the arm drive section 86 as shown in FIG. 4*c*, and performs the operation of biasing the first print sheet P. When the insert sheet I has been ejected to the sheet tray 42 by the sheet ejection rollers 12, the control section 81 controls the aim drive section 86, as shown in FIG. 4*d*, whereby the operation is performed to bias the insert sheet I. When the second print sheet P has been ejected to the sheet tray 42 by the sheet ejection rollers 12, the control section 81 controls the arm drive section 86, as shown in FIG. 4*e*, whereby the operation is performed to apply bias to the second print sheet P.

Figure 4F:
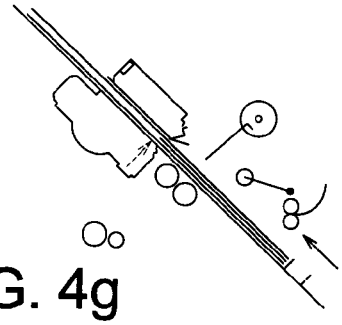
Figure 4G:
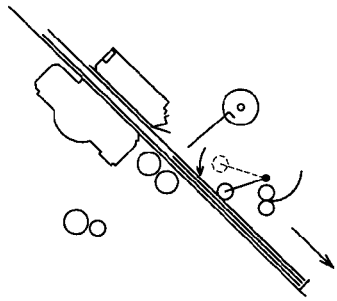

With reference to the print sheet P having been loaded on the sheet tray 42, the control section 81 performs the operation of center stitching as one step in the saddle stitching process. To put it more specifically, as shown in FIG. 4*f*, the control section 81 controls the trailing edge drive section 83 to move the trailing edge regulating section 43, and sets the position of the trailing edge regulating section 43 in response to the size of the print sheet P to ensure that the central position of the sheet with reference to the size of the print sheet P, corresponds to the position to be stapled by the center stitching stapler 50. In this case as well, a test and simulation are conducted and calculation is made in advance to find the amount of shift of the trailing edge regulating section 43 from the loading position in conformity to the print sheets P of various sizes. The relationship between the size of the print sheet P and the shift amount of the trailing edge regulating section 43 is stored in the ROM of the control section 81. When the sheet is center-stitched actually, the control section 81 sets the position of the trailing edge regulating section 43, based on the relationship of the correspondence stored in the ROM and the size of the print sheet P to be center stitched actually. When this position has been set, the sheet having been loaded on the sheet tray 42 moves. When the central portion of the print sheet P has moved to the position where the central portion is to be stapled, the control section 81 controls the center stitching stapler 50 to staple the sheets.

Further, the control section 81 performs center folding operation as one step in the saddle stitching process with reference to the print sheet P having been loaded on the sheet tray 42. To put it more specifically, as shown in FIG. 4, the control section 81 controls the trailing edge drive section 83 to move the trailing edge regulating section 43, and sets the position of the trailing edge regulating section 43 in response to the size of the print sheet P to ensure that the central portion of the sheet with reference to the size of the print sheet P, corresponds to the position of center folding of the center folding section 55. In this case as well, a test and simulation are conducted and calculation is made in advance to find the amount of shift of the trailing edge regulating section 43 from the center-stitching position of the trailing edge regulating section 43 in conformity to the print sheets P of various sizes. The relationship between the size of the print sheet P and the shift amount of the trailing edge regulating section 43 is stored in the ROM of the control section 81. When the sheet is actually center-folded, the control section 81 sets the position of the trailing edge regulating section 43, based on the relationship of the correspondence, stored in the ROM and the size of the print sheet P to be center-folded. In addition to the aforementioned operations, the control section 81 controls the arm drive section 86, whereby the sheet is biased by the rewinding section 44. Thus, assistance is provided to ensure that the sheets having been loaded on the sheet tray 42 moves in conformity to the movement of the trailing edge regulating section 43. The sheets are moved on the sheet tray 42 by the aforementioned operations of the trailing edge regulating section 43 and rewinding section 44, and the central portion of the print sheet P moves to the position of center folding.

Figure 4H:
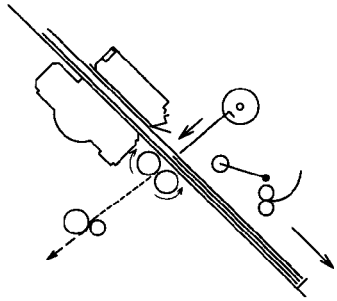

As shown in FIG. 4*h*, the control section 81 controls the folding roller drive section 85 so that a pair of folding rollers 56 may rotate facing each other. Further, the control section 81 controls the folding plate drive section 84 so that the folding plate 57 may be lowered. This operation allows the center of the sheet to be inserted between a pair of folding rollers 56 by the folding plate 57, and the sheet is center-folded by the rotation of the rollers 56. Since the folding plate 57 is located on the upper surface side of the sheet tray 42, lowering of this folding plate 57 allows the center folded sheet (booklet) to be ejected from a pair of folding rollers 56, with the end of the folded side facing downward. The booklet ejected from a pair of folding rollers 56 is conveyed by the sheet ejection rollers 63, and is ejected onto the lower sheet ejection tray 64. This procedure produces a booklet having the insert sheet I inserted between the pages of the two print sheets P.

Figure 6A:
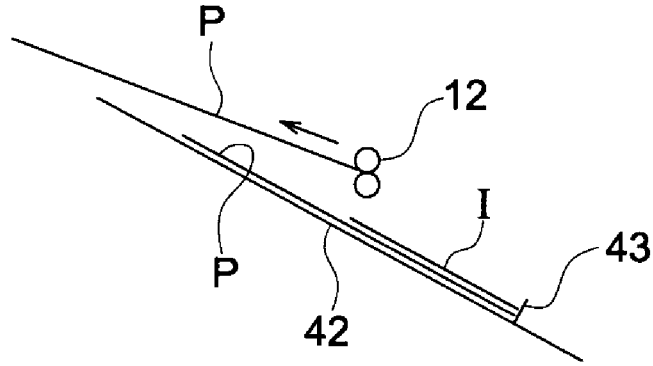
FIGS. 6*a*-6*c* are explanatory diagrams showing the concept of the operation of a trailing edge regulating section 43.
Figure 6B:
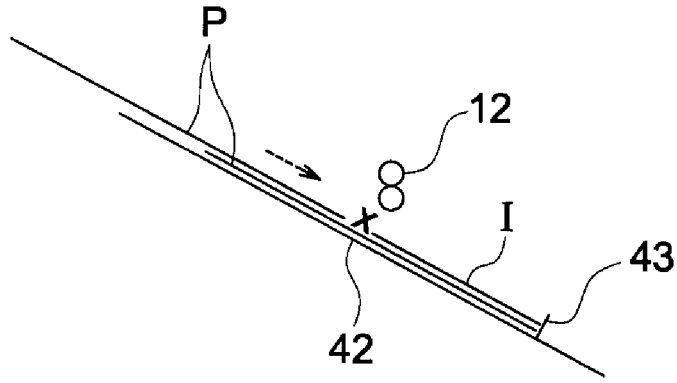
Figure 6C:
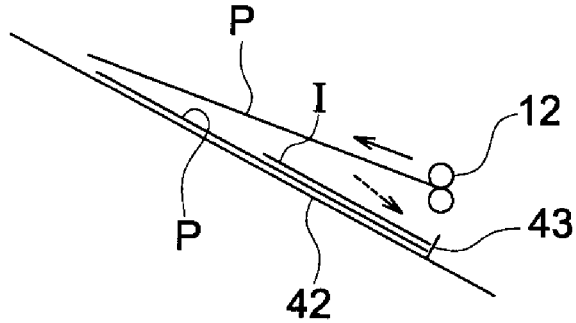

The post-processing apparatus 300 of the present Example can produce a booklet in the state where the booklet has the insert sheet I of a size equal to or smaller than that of the booklet, inserted between the pages thereof, as shown in FIG. 5. In the conventional art, for example, when the print sheet P and insert sheet I having a size different from that of the print sheet P are loaded on the sheet tray 42, the following problem may arise, depending on the positional relationship between the trailing edge regulating section 43 and sheet ejection rollers 12 at the time of sheet loading. To put it more specifically, as shown in FIG. 6, print sheet P is ejected from the sheet ejection rollers 12 to the sheet tray 42. When the print sheet P has fallen onto the surface of the sheets having been loaded on the sheet tray 42, the trailing edge position of the print sheet P may be located closer to the leading edge of the tray than the leading edge position of the insert sheet I having been loaded on the sheet tray 42. In this case, as shown in FIG. 6*b*, if a print sheet P is ejected after an insert sheet I, the sheet trailing edge of the print sheet P falls onto a forward position of the leading edge of the insert sheet I (leading edge side of the sheet tray 42). When the print sheet P in this position is aligned toward the trailing edge regulating section 43, the trailing edge of the print sheet P and the leading edge of the insert sheet I may interfere with each other to cause paper jams or alignment failure between sheets.

In the present Example, however, when the print sheet P is loaded on (ejected to) the sheet tray 42, the position of the trailing edge regulating section 43 is set in conformity to the size of the insert sheet I. This allows the sheet to fall in such a way that the trailing edge of the print sheet P ejected from the sheet ejection rollers 12 to the sheet tray 42 is located between the leading edge of the insert sheet I having been loaded on the sheet tray 42 and the trailing edge regulating section 43, namely, on the surface of the insert sheet I, as shown in FIG. 6. This prevents interference from occurring between the leading edge of the insert sheet I and the trailing edge of the print sheet P. Thus, the print sheet P and insert sheet I having difference sizes can be loaded and stored in the sheet tray 42, without any paper jam or alignment failure. As a result, the sheets having been loaded on the sheet tray 42 (print sheet P and insert sheet I) can be processed, so that a booklet in the state where the booklet has the insert sheet I inserted between the pages thereof can be finished.

In the present Example, in the center folding section 55, the folding plate 57 is placed on the upper surface side of the sheet tray 42 so as to be opposed to a pair of folding rollers 56 through the sheet tray 42. When the print sheet P is center-folded, the folding plate 57 is lowered and the print sheet P having been loaded on the sheet tray 42 is pushed toward a pair of folding rollers 56. This configuration allows the center-folded sheets (booklet) to be ejected from a pair of folding rollers 56, with the end of the folded side facing downward. Thus, center folding is performed so that the end of the folded side faces downward. This reduces the possibility of the insert sheet I of being removed from the booklet in the booklet producing process, and enhances the finishing accuracy of the booklet containing the insert sheet I inserted therein.

In the aforementioned case, the booklet provided with saddle stitching process has been described with reference to the case where the insert sheet I is incorporated between the pages made of the first print sheet P and second print sheet P. However, the present invention is not restricted thereto. The form of the booklet produced and the form of inserting the insert sheet I can be designed in various variations, as will be shown below:

[Form of Booklet: Booklet by Saddle Stitching; Form of Insertion: Between Pages in the Middle of the Booklet]

Figure 7A:
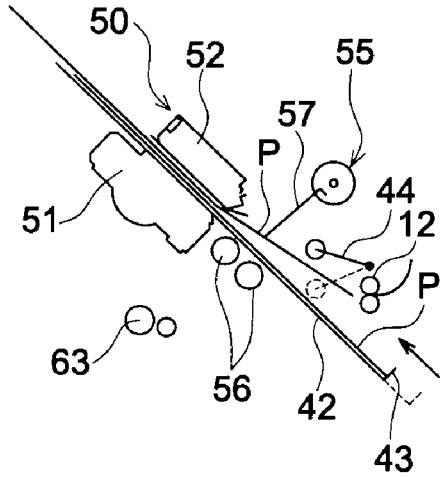
FIGS. 7*a*-7*d* are explanatory diagrams chronologically showing the operations of the major portions for producing a booklet in a post-processing apparatus 300.
Figure 7B:
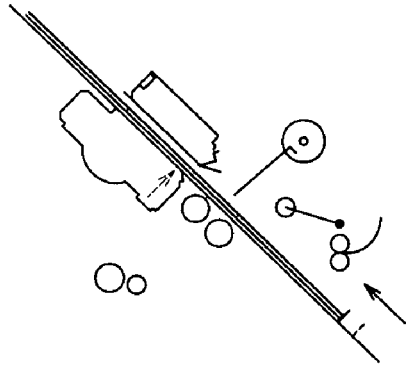

FIGS. 7*a*-7*b* are explanatory diagrams chronologically showing the operations of the major portions for booklet production in the post-processing apparatus 300. In these figures, the attached alphabets to the Fig. number are used to represent the processes in chronological order. Reference numerals are assigned only in the FIG. 7*a*, and are omitted in other figures. (The same applies to FIG. 8*a* through FIG. 10*d* to be described later).

In the first place, the control section 81 picks up the signals from the image forming apparatus 200 to get the information denoting a booklet mode using the process of saddle stitching in the processing mode, the information on the position wherein the insert sheet I is inserted, and the information on the sizes of the insert sheet I and print sheet P.

Next, the control section 81 sets the position of the trailing edge regulating section 43 in conformity to the size of the insert sheet I in such a way that, when the second print sheet P is ejected from the sheet ejection rollers 12 to the sheet tray 42, the trailing edge of the print sheet P is located between the leading edge of the insert sheet I having been loaded on the sheet tray 42 and the trailing edge regulating section 43 (on the surface of insert sheet I). When the insert sheet I is to be inserted between the pages in the middle of the booklet, the insert sheet I is ejected to the sheet tray 42 after the last print sheet (second print sheet) P. In this case, since there is no possibility of the insert sheet I interfering with the print sheet P, the control section 81 is allowed to set the trailing edge drive section 83, for example, at the regular sheet loading position.

When the first print sheet P has been ejected from the sheet ejection rollers 12 to the sheet tray 42, the control section 81 controls the arm drive section 86 to apply bias to the first print sheet P. As shown in FIG. 7*a*, when the second print sheet P is ejected from the sheet ejection rollers 12 to the sheet tray 42, the control section 81 controls the arm drive section 86, whereby the second print sheet P is biased.

As shown in FIG. 7*b*, the control section 81 controls the trailing edge drive section 83 to move the trailing edge regulating section 43. Thus, the control section 81 sets the position of the trailing edge regulating section 43 in conformity to the size of the print sheet P in such a way that the central portion of the print sheet P may correspond to the position to be stapled by the center stitching stapler 50.

Figure 7C:
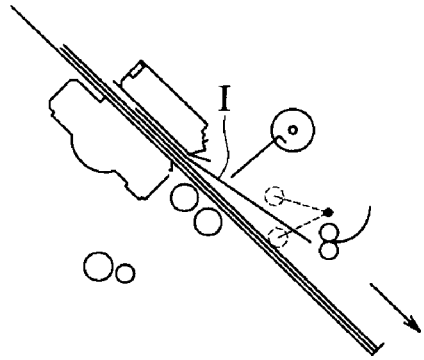

As shown in FIG. 7*c*, the insert sheet I is ejected to the sheet tray 42 by the sheet ejection rollers 12. The control section 81 controls the trailing edge drive section 83 to move the trailing edge regulating section 43. Thus, The control section 81 sets the position of the trailing edge regulating section 43 in conformity to the sheet size of the print sheet P in such a way that the central portion of the sheet with reference to the size of the print sheet P may correspond to the position where the center folding operation is performed by the center folding section 55. At the same time, the control section 81 controls the aim drive section 86 to perform biasing operations using the rewinding section 44. In addition to the operation of biasing the insert sheet I to the trailing edge regulating section 43, assistance is provided to ensure that the sheets having been loaded on the sheet tray 42 may move in conformity to the movement of the trailing edge regulating section 43. Then the sheets are moved on the sheet tray 42 by the aforementioned operations and the central portion of the print sheet P moves to the position of center folding.

Figure 7D:
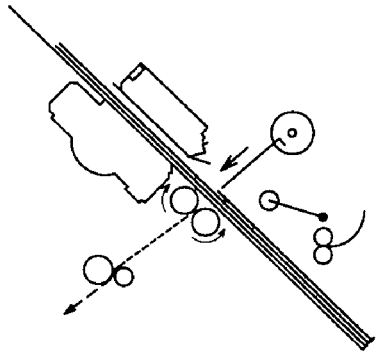

After that, as shown in FIG. 7*d*, the control section 81 controls the folding roller drive section 85 so that a pair of folding rollers 56 will rotate facing each other. At the same time, the control section 81 controls the folding plate drive section 84 so that the folding plate 57 is lowered to perform the center folding operation.

According to this technique, with consideration given to the fact that the insert sheet I is inserted between the pages in the middle of the booklet, the print sheet P is subjected to center stitching before the insert sheet I is ejected to the sheet tray 42. This technique permits the ejection of the insert sheet I to the sheet tray 42, alignment of the end position and movement of the sheets to the folding position to be implemented in one process, whereby booklet production throughput is improved.

[Form of Booklet: Booklet by Center Folding; Form of Insertion: Between Pages in the Middle of the Booklet]

Figure 8A:
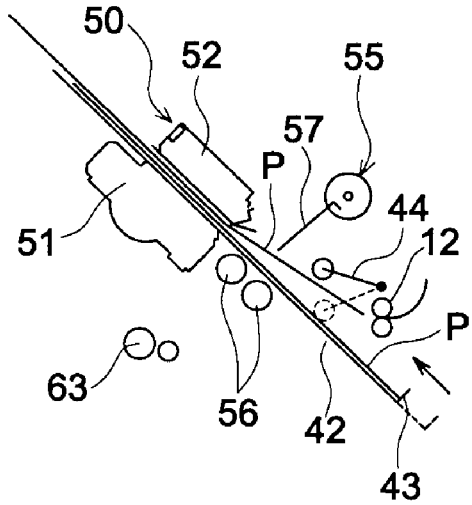
FIGS. 8*a*-8*c* are explanatory diagrams chronologically showing the operations of the major portions for producing a booklet in a post-processing apparatus 300.
Figure 8B:
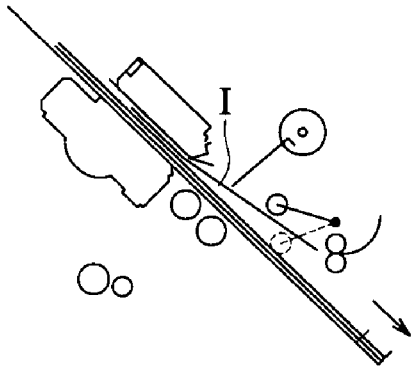

FIGS. 8*a*-8*b* are explanatory diagrams chronologically showing the operations of the major portions for booklet production in the post-processing apparatus 300. In the first place, the control section 81 picks up the signals from the image forming apparatus 200 to get the information denoting a booklet mode using the process of center folding in the processing mode, the information on the position where the insert sheet I is inserted, and the information on the sizes of the insert sheet I and print sheet P.

Then the control section 81 controls the trailing edge drive section 83 to move the trailing edge regulating section 43 so that the position thereof may be set. To put it more specifically, the control section 81 sets the position of the trailing edge regulating section 43 in response to the size of the insert sheet I in such a way that, when the second print sheet P is ejected from the sheet ejection rollers 12 to sheet tray 42, the trailing edge of the print sheet P may be located between the leading edge of the insert sheet I having been loaded on the sheet tray 42 and the trailing edge regulating section 43 (on the surface of the insert sheet I). Similarly to the case of the aforementioned technique, when the insert sheet I is inserted between the pages in the middle of the booklet, the control section 81 can set trailing edge drive section 83 at the regular position at the time of sheet loading.

When the first print sheet P has been ejected to the sheet tray 42 by the sheet ejection rollers 12, the control section 81 controls the arm drive section 86 to apply bias to the first print sheet P. As shown in FIG. 8*a*, when the second print sheet P has been ejected to the sheet tray 42 by the sheet ejection rollers 12, the control section 81 controls the arm drive section 86, thereby applying bias to the second print sheet P.

As shown in FIG. 8*b*, the insert sheet I is ejected to the sheet tray 42 by the sheet ejection rollers 12. The control section 81 controls the trailing edge drive section 83 to move the trailing edge regulating section 43. Thus, the control section 81 sets the position of the trailing edge regulating section 43 in response to the size of the insert sheet I in such a way that the central portion of the sheet with reference to the size of the print sheet P may correspond to the position of center folding by the center folding section 55. In this case as well, a test and simulation are conducted and calculation is made in advance to find the amount of shift of the trailing edge regulating section 43 from the loading position in conformity to the print sheets P of various sizes. The relationship between the size of the print sheet P and the shift amount of the trailing edge regulating section 43 is stored in the ROM of the control section 81. When the sheet is actually center-folded, the control section 81 sets the position of the trailing edge regulating section 43, based on the relationship of the correspondence, stored in the ROM, and the size of the print sheet P to be center-folded. In addition to the aforementioned operations, the control section 81 controls the arm drive section 86, whereby the sheet is biased by the rewinding section 44. These operations allows the insert sheet I to be biased to the trailing edge regulating section 43. Thus, assistance is provided to ensure that the sheets having been loaded on the sheet tray 42 may move in conformity to the movement of the trailing edge regulating section 43. Thus, the sheets are moved onto the sheet tray 42 and the central portion of the print sheet P moves to the position of center folding.

Figure 8C:
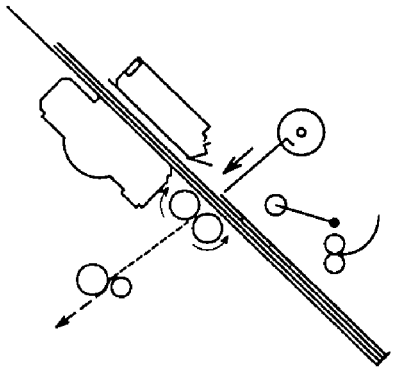

After that, as shown in FIG. 8*c*, the control section 81 controls the folding roller drive section 85 so that a pair of folding rollers 56 may rotate facing each other. At the same time, the control section 81 controls the folding plate drive section 84 so that the folding plate 57 may be lowered to perform the center folding operation.

This technique permits the insert sheet I to be ejected to the sheet tray 42, alignment of the end position and movement of the sheet to the folding position to be implemented in one process, whereby booklet production throughput is improved.

[Form of Booklet: Booklet by Center Folding; Form of Insertion: Between the First and Second Print Sheets P]

Figure 9A:
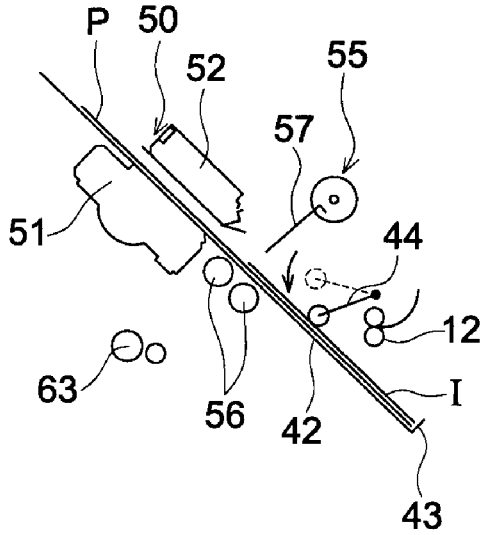
FIGS. 9*a*-9*c* are explanatory diagrams chronologically showing the operations of the major portions for producing a booklet in a post-processing apparatus 300.
Figure 9B:
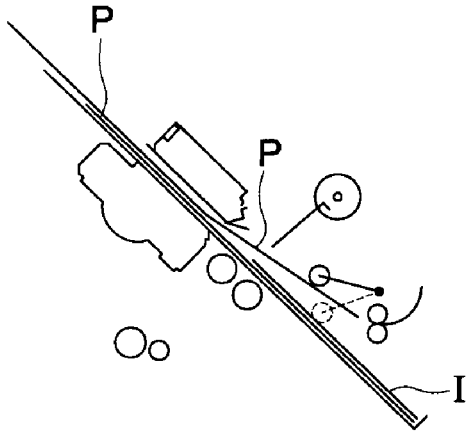

FIGS. 9*a*-9*b* are explanatory diagrams chronologically showing the operations of the major portions for booklet production in the post-processing apparatus 300. The following explanation is based on the assumption that, when the trailing edge regulating section 43 has been moved to the position where the print sheet P is to be center-folded, the trailing edge of the sheet ejected from the sheet ejection rollers 12 to the sheet tray 42 is located between the leading edge of the insert sheet I having been loaded on the sheet tray 42 and the trailing edge regulating section 43.

In the first place, the control section 81 picks up the signals from the image forming apparatus 200 to get the information denoting a booklet mode using the process of center folding in the processing mode, the information on the position where the insert sheet I is inserted, and the information on the sizes of the insert sheet I and print sheet P.

The control section 81 controls the trailing edge drive section 83 to move the trailing edge regulating section 43 and sets the position of the trailing edge regulating section 43 in response to the size of the print sheet P in such a way that the central portion of the print sheet P having been loaded on the sheet tray 42 may correspond to the position of center folding of the center folding section 55. In this case as well, a test and simulation are conducted and calculation is made in advance to find the amount of shift of the trailing edge regulating section 43 from the initial position of the trailing edge regulating section 43 in conformity to the print sheets P of various sizes. The relationship between the size of the insert sheet I and the shift amount of the trailing edge regulating section 43 is stored in the ROM of the control section 81. When the sheet is loaded, the control section 81 controls the trailing edge drive section 83, based on the relationship of the correspondence, stored in the ROM, and the size of the insert sheet I to be inserted, and sets the position of the trailing edge regulating section 43 when sheets are loaded.

When the first print sheet P has been ejected to the sheet tray 42 by the sheet ejection rollers 12, the control section 81 controls the arm drive section 86, and thereby applies bias to the first print sheet P. When the insert sheet I has been ejected to the sheet tray 42 by the sheet ejection rollers 12, the control section 81 controls the arm drive section 86, and thereby applies bias to the insert sheet I, as shown in FIG. 9*a*. When the insert sheet I has been ejected to the sheet tray 42 by the sheet ejection rollers 12, the control section 81 controls the arm drive section 86, and thereby applies bias to the insert sheet I, as shown in FIG. 9*a*.

When the second print sheet P has been ejected to the sheet tray 42, the control section 81 controls the arm drive section 86, and applies bias to the second print sheet P, as shown in FIG. 9*b*.

Figure 9C:
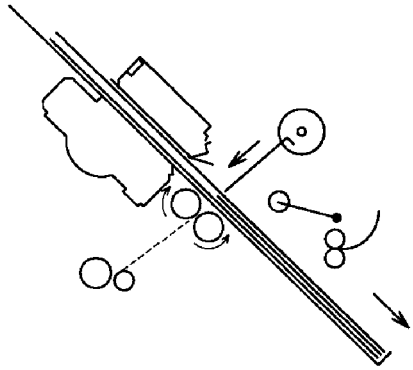

As shown in FIG. 9*c*, the control section 81 controls the folding roller drive section 85 so that a pair of folding rollers 56 may rotate facing each other. At the same time, the control section 81 controls the folding plate drive section 84 so that the folding plate 57 may be lowered to perform the center folding operation.

This technique permits the sheets to be loaded to the position where the sheets are subjected to center folding. Thus, after sheets have been loaded on the sheet tray 42, sheets can be directly center-folded without the sheets being moved by the trailing edge regulating section 43. This procedure reduces the number of steps in producing a booklet, and hence improves the throughput.

EXAMPLE 2

FIGS. 10*a*-10*d* are explanatory diagrams chronologically showing the operations of the major portions for producing a booklet in a post-processing apparatus 300 of the second Example. The following describes the image forming system in the second Example as an embodiment of the present invention. The difference of the image forming system of the present Example from the first Example is found in the configuration of the trailing edge regulating section 45 provided on the second intermediate stacker 41 of the post-processing apparatus 300. To put it more specifically, the trailing edge regulating section 45 of the present Example is equipped with a movable section for clamping the trailing edge of the sheets having been loaded on the sheet tray 42. When this movable section is driven, the sheets having been loaded on the sheet tray 42 can be clamped wherever required. Further, this trailing edge regulating section 45 has the function similar to that of the trailing edge regulating section 43 in the first Example.

The following describes the specific operations of the post-processing apparatus 300 in the present Example in connection with production of a booklet having an insert sheet I inserted into the pages thereof. The present case uses an example of producing a booklet by center folding using two print sheets P. Here the insert sheet I is inserted between the pages made up of a first print sheet P and second print sheet P, as shown in FIG. 5, not between the pages in the middle of the booklet.

In the first place, the control section 81 picks up the signals from the image forming apparatus 200 to get the information denoting a booklet mode using the process of center folding in the processing mode, the information on the position where the insert sheet I is inserted, and the information on the sizes of the insert sheet I and print sheet P.

Next, the control section 81 sets the position of the trailing edge regulating section 45 in conformity to the size of the insert sheet I in such a way that, when the second print sheet P is ejected from the sheet ejection rollers 12 to the sheet tray 42, the trailing edge of the print sheet P is located between the leading edge of the insert sheet I having been loaded on the sheet tray 42 and the trailing edge regulating section 45 (on the surface of insert sheet I).

Figure 10A:
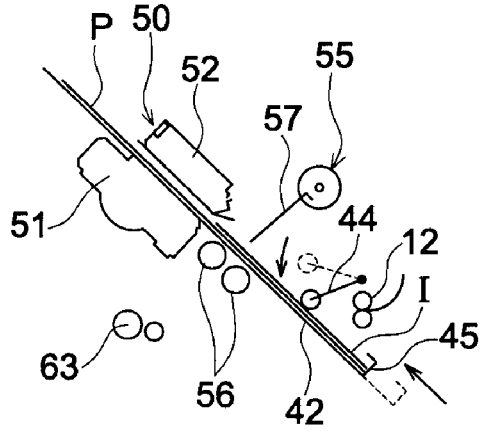
FIG. 10*a*-10*d* are explanatory diagrams chronologically showing the operations of the major portions for producing a booklet in a post-processing apparatus 300 of a second Example.

When the first print sheet P has been ejected from the sheet ejection rollers 12 to the sheet tray 42, the control section 81 controls the arm drive section 86 to apply bias to the first print sheet P. As shown in FIG. 10*a*, when the insert sheet I has been ejected from the sheet ejection rollers 12 to the sheet tray 42, the control section 81 controls the arm drive section 86, whereby the insert sheet I is biased.

Figure 10B:
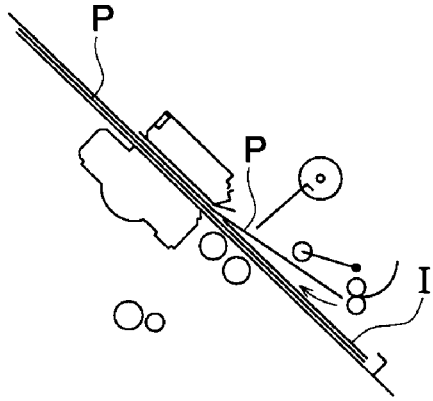
Figure 10C:
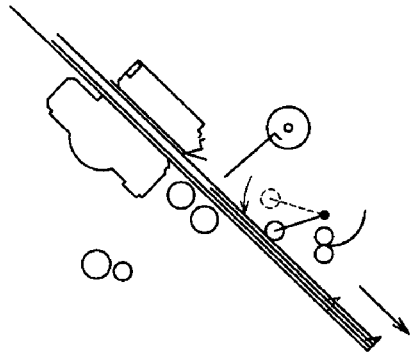

As shown in FIG. 10*b*, the second print sheet P is ejected to the sheet tray 42 by the sheet ejection rollers 12. As shown in FIG. 10*c*, the control section 81 controls the trailing edge drive section 83 to move the movable section of the trailing edge regulating section 45. The trailing edge regulating section 45 is moved while the sheets on the sheet tray 42 are clamped. Thus, the control section 81 sets the position of the trailing edge regulating section 45 in conformity to the size of the print sheet P in such a way that the central portion of the sheets with reference to the size of the print sheet P may correspond to the position of center folding by the center folding section 55. Upon completion of position setting, the control section 81 terminates clamping of the sheets by the movable section.

Figure 10D:
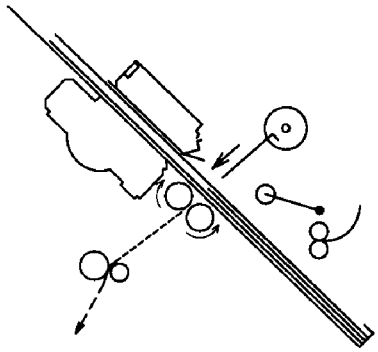

After that, as shown in FIG. 10*d*, the control section 81 controls the folding roller drive section 85 so that a pair of folding rollers 56 may rotate facing each other. At the same time, the control section 81 controls the folding plate drive section 84 so that the folding plate 57 may be lowered to perform the center folding operation.

When a booklet is formed using the process of center folding and sheets are moved on the sheet tray 42, alignment may not be maintained in moving individual sheets since the sheets are not stapled. However, the present Example has a movable section for clamping the sheets in the trailing edge regulating section 45. This arrangement ensures the sheets to be moved with the minimized variance of individual sheets, and produces a booklet where the individual sheets are aligned.

EXAMPLE 3

The following describes the image forming system in the third Example as an embodiment of the present invention. The difference of the image forming system of the present Example from the first or second Example is found in that, in response to the position where the insert sheet I is inserted between the pages of a booklet, the order of the pages where images are formed on the print sheets P is changed by the image forming apparatus 200.

Figure 11B:
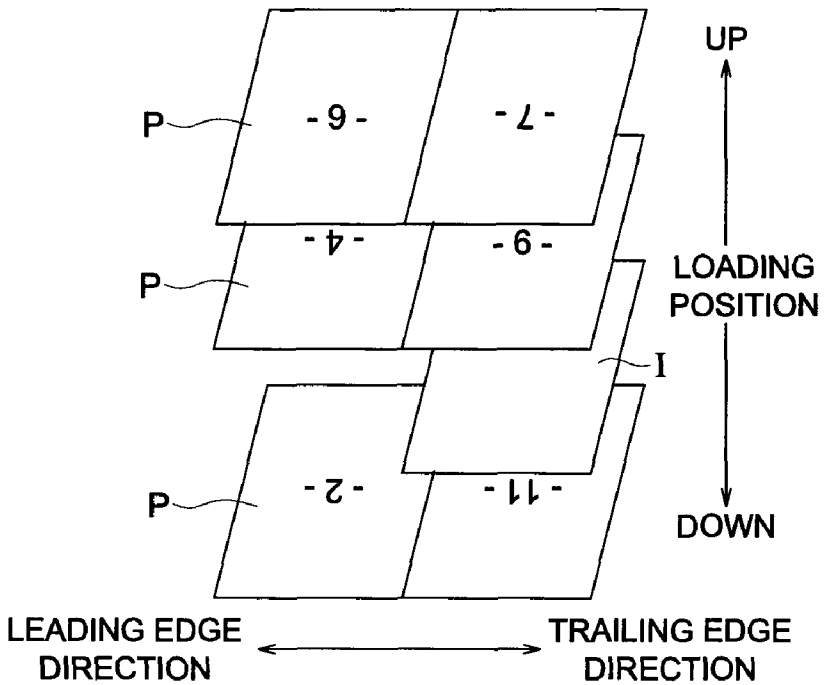
FIGS. 11*a* and 11*b* are explanatory diagrams chronologically showing the concept of processing in a third Example.
Figure 11A:
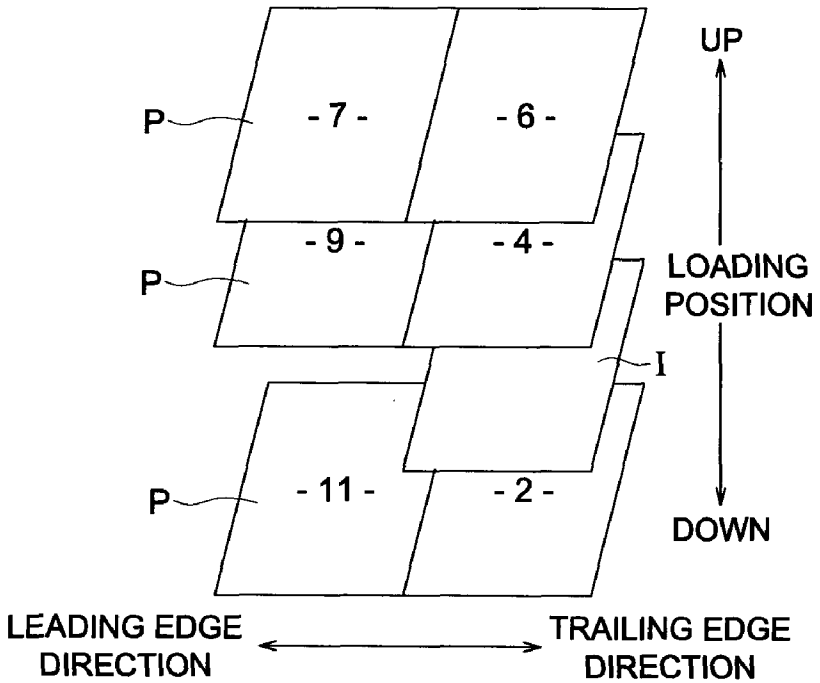

FIGS. 11*a* and 11*b* are explanatory diagrams showing the concept of processing in the present Example. As described with reference to the aforementioned Examples, the position of the sheets having loaded on the sheet tray 42 is aligned by the trailing edge regulating section 43. Owing to this, although the insert sheet I can be inserted between the pages corresponding to the side of the trailing edge of the print sheet P, but cannot be inserted between the pages corresponding to the side of the leading edge. For example, as shown in FIG. 11*a*, in a booklet, the insert sheet I can be inserted between the second page (the page indicated by "-2-" in the figure) and the third page (the back side of the page indicated by "-4-" in the figure) or between the fourth page (the page indicated by "-4-" in the figure) and the fifth page (on the back side of the page indicated by "-6-" in the figure). However, in a booklet, the insert sheet I cannot be inserted between the eighth page (the back side of the page indicated by "-7-") and ninth page (page indicated by "-9-" in the figure), or the tenth page (the back side of the page indicated by "-9-") and eleventh page (page indicated by "-11-" in the figure).

In the present Example, as shown in FIG. 11*b*, the order of the pages where images are formed on the print sheets P is changed by the image forming apparatus 200 to ensure that the pages between which the insert sheet I is inserted may be positioned on the side of the trailing edge regulating section 43 with reference to the print sheet P having been loaded on the sheet tray 42 of the post-processing apparatus 300. Thus, in the post-processing apparatus 300, a booklet can be produced after the insert sheet I is inserted between the pages, where the insert sheet I cannot be inserted in the regular order of pages where images are formed.

EXAMPLE 4

Figure 1B:
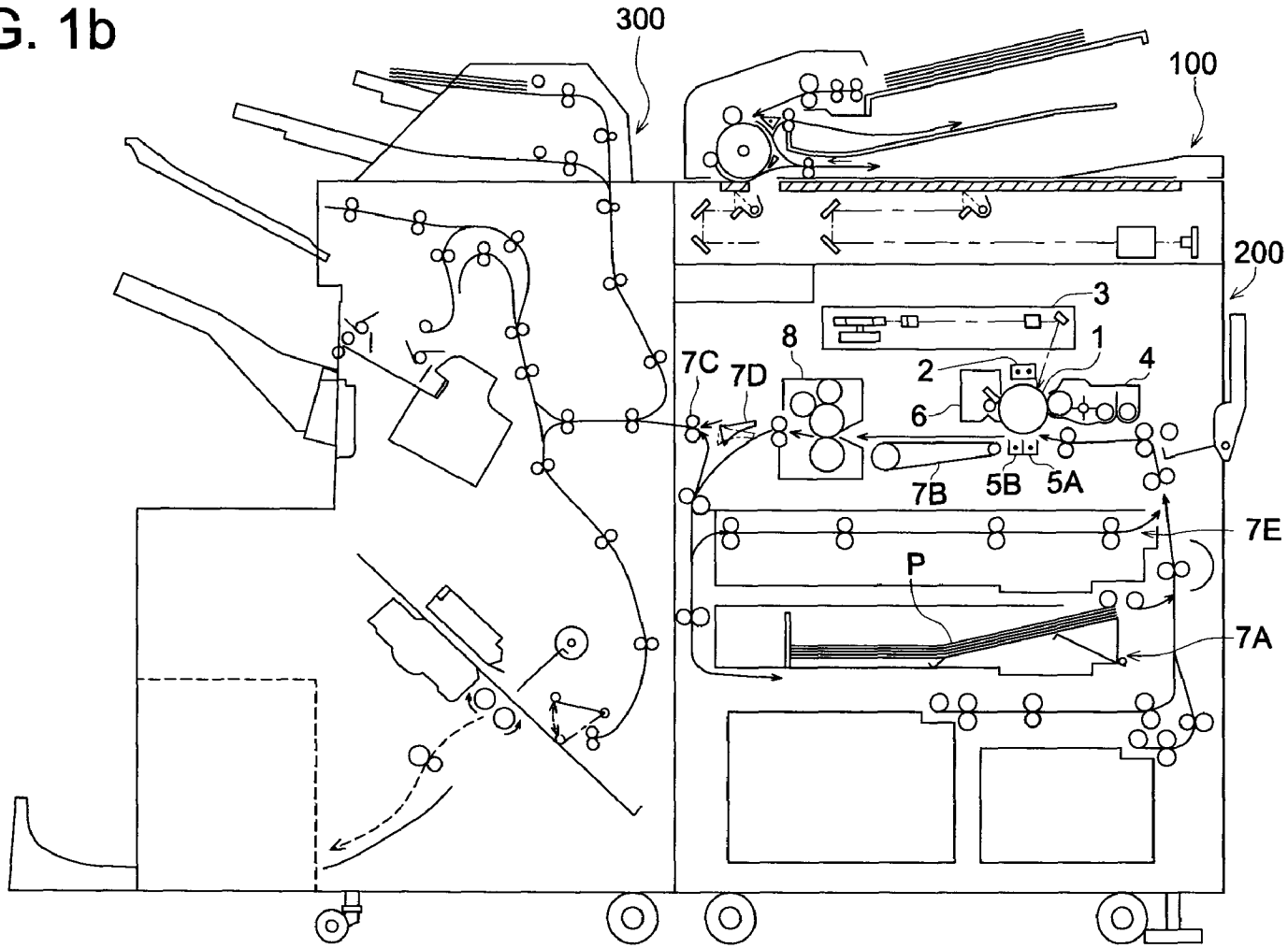
FIG. 1*b* is an explanatory diagram schematically showing the overall structure of an image forming system.
Figure 2B:
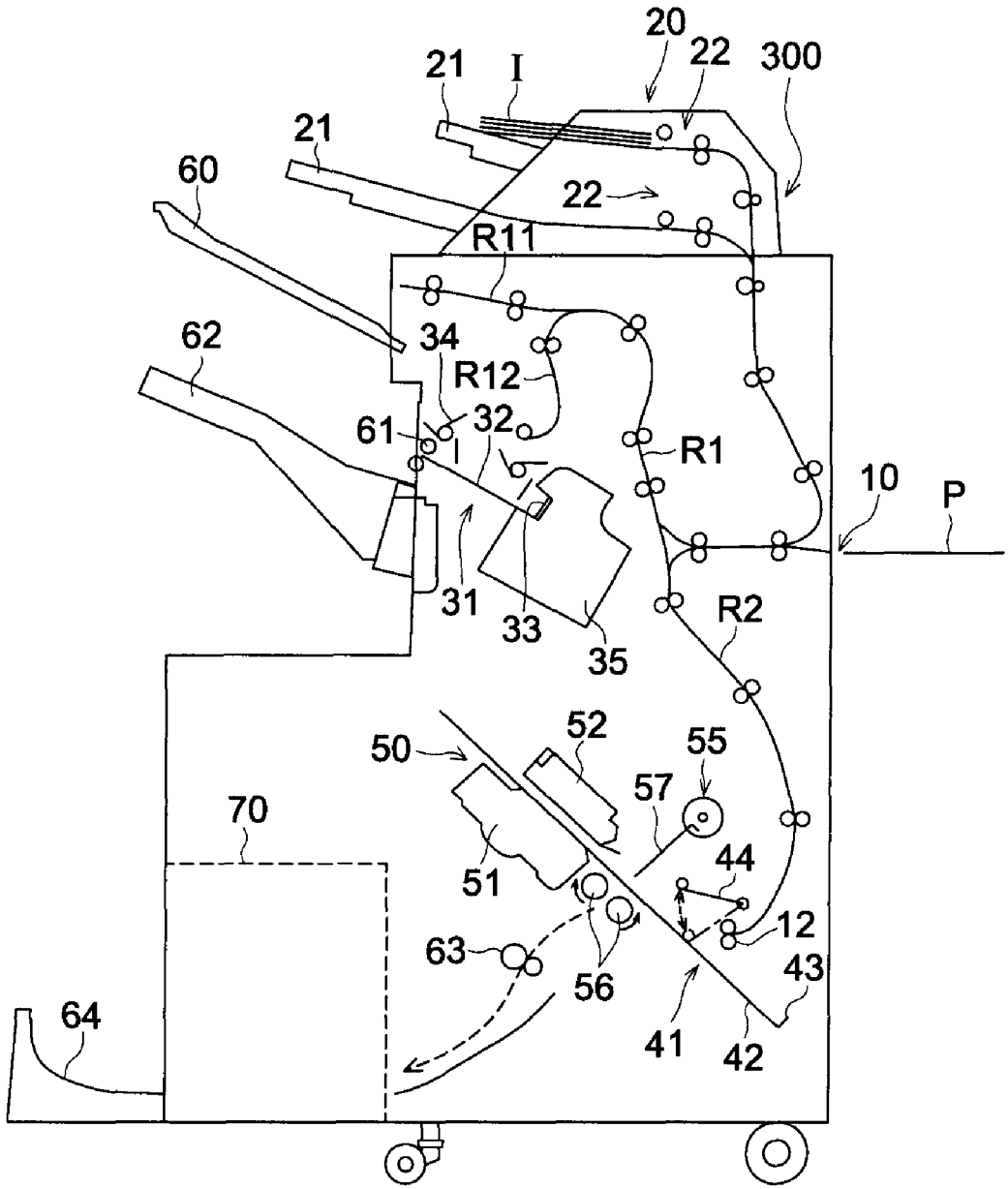
FIG. 2*b* is an explanatory diagram schematically showing the internal structure of a post-processing apparatus 300.
Figure 3B:
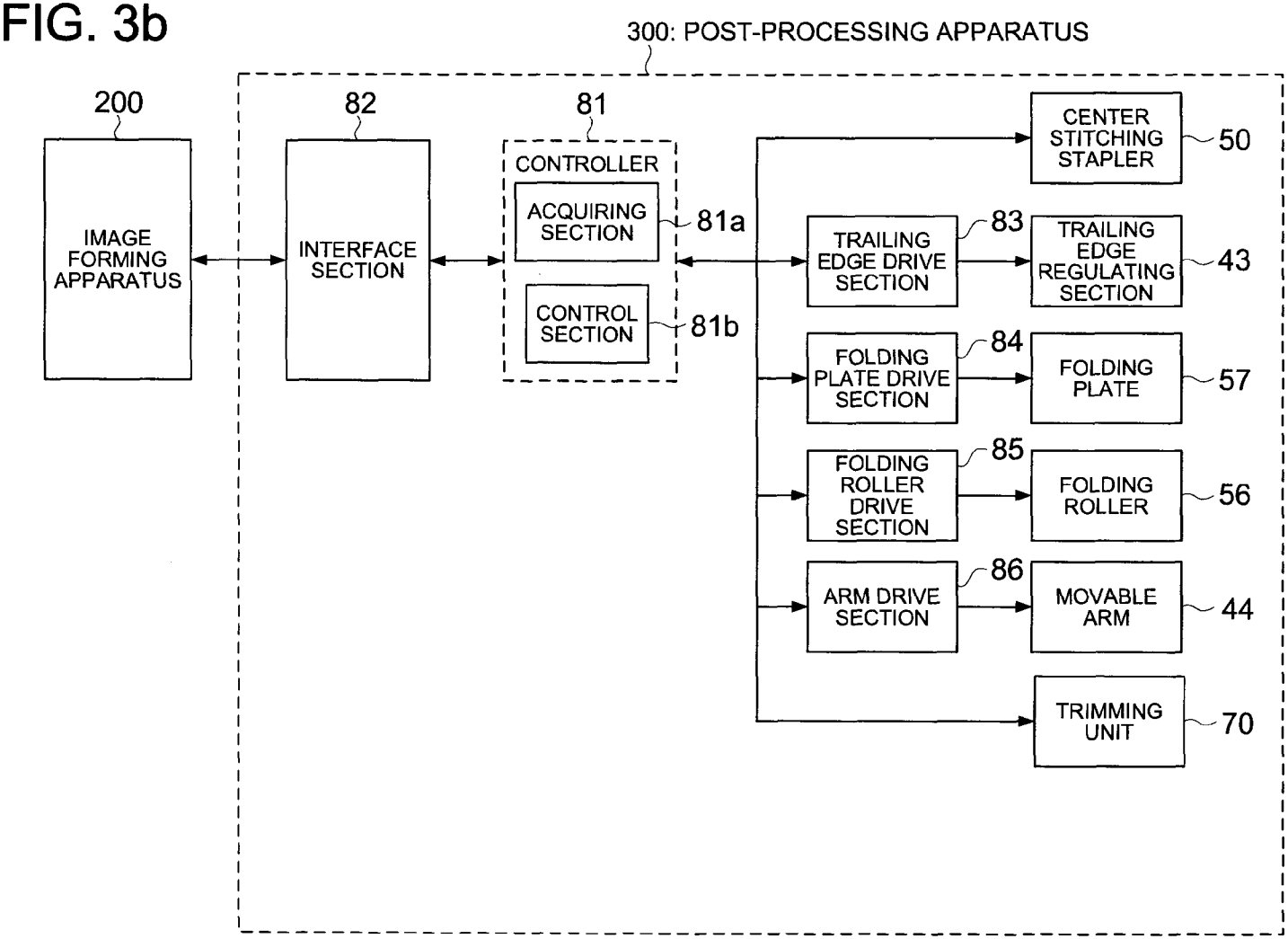
FIG. 3*b* is a block diagram showing the functional structure of the post-processing apparatus 300.

The following describes the fourth Example with reference to FIG. 1*b*, FIG. 2*b* and FIG. 3*b*. FIG. 1*b*, FIG. 2*b* and FIG. 3*b* are similar to FIG. 1*a*, FIG. 2*a* and FIG. 3*a* respectively. Only the differences will be described.

The trimming unit 70 includes, for example, a conveying unit (not illustrated) for conveying a booklet and a trimming unit (not illustrated). A prescribed position at the end on the front edge side in the produced booklet is trimmed by the trimming blade. The conveying unit includes a conveying belt for conveying a booklet, and a driver roller and driven roller around which the conveying belt is wound. The conveying unit conveys to the trimming unit, the booklet supplied from the center folding section 55. In addition, the booklet whose front edge side has been trimmed by the trimming unit is conveyed to the lower sheet ejection tray 64 by the conveying unit. The trimming unit trims off the prescribed trimming execution position (e.g., a position apart from the end on the front edge side by a prescribed distance (trimming standard position)) of the booklet having been conveyed by the conveying unit, as required. The trimming unit includes, for example, a movable blade, fixed blade, and a motor for driving the movable blade in the vertical direction. The end portion on the front edge side of the booklet is cut off by the cutting edge of the lowering movable blade and the cutting edge of the fixed blade.

FIG. 3*b* is a block diagram showing the functional structure of the post-processing apparatus 300, particularly showing the major portions for producing a booklet. The controller 81 takes charge of overall control of the post-processing apparatus 300. The controller 81 can use a microcomputer mainly composed of a CPU, ROM and RAM. This controller 81 performs various forms of calculation according to the control program stored in the ROM, and controls the operations of the post-processing apparatus 300 based on the result of this calculation. When viewed from the standpoint of function, the controller 81 includes an acquiring section 81*a* and control section 81*b*.

The acquiring section 81*a* can exchange signals with the image forming apparatus 200 through the interface section 82. This arrangement allows the acquiring section 81*a* to get various forms of information (information specified by the user through the input section 210 to be described later) which the image forming apparatus 200 has.

The aforementioned image forming apparatus 200 is provided with the touch panel type input section 210 that allows input operations to be performed in conformity to the information given on the display, for example. The user employs this input section 210 to input operation commands for the image forming system (image forming apparatus 200 and post-processing apparatus 300).

Figure 12:
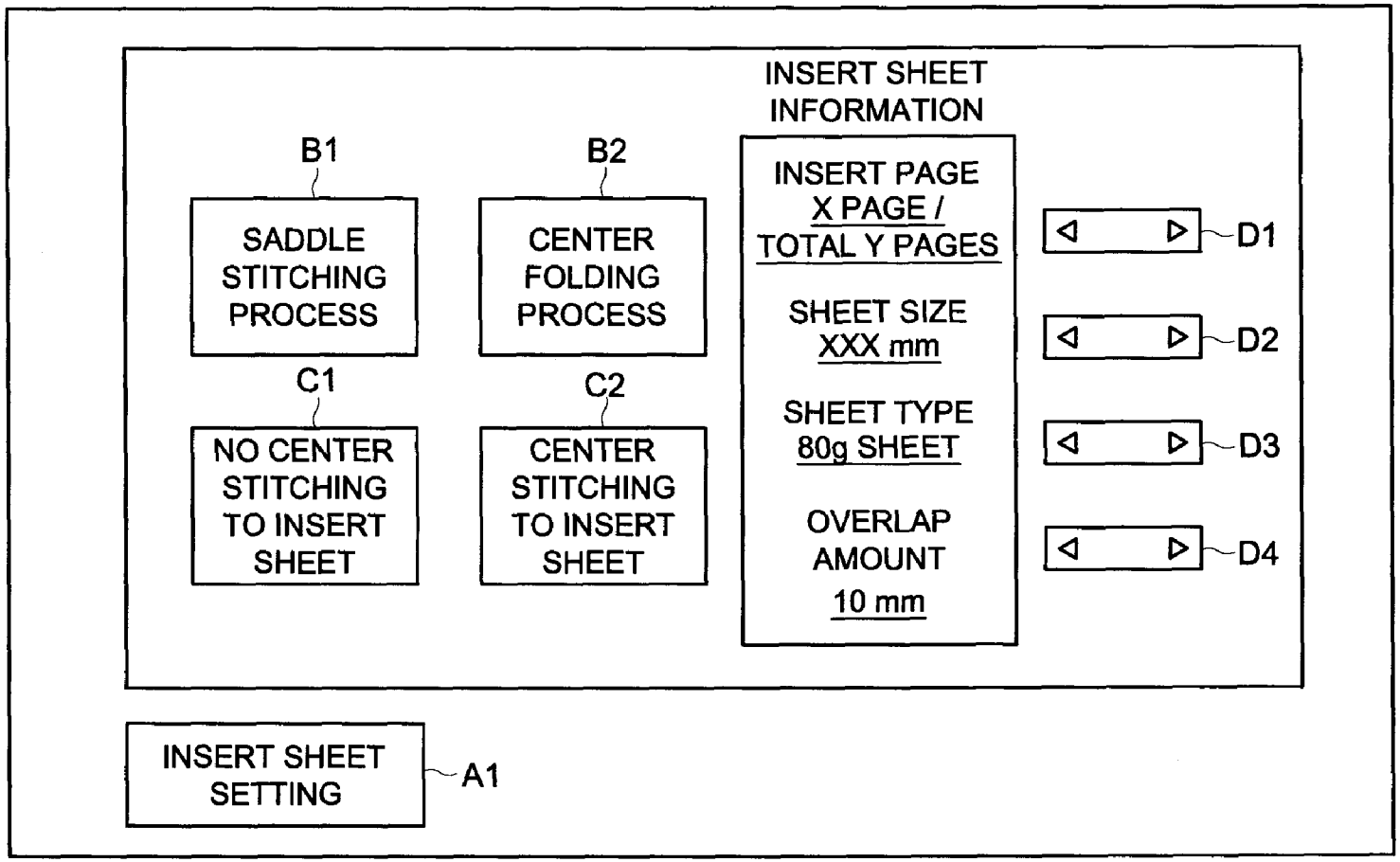
FIG. 12 is an explanatory diagram schematically showing an input section 210.

The user can operate the input section 210 to specify the operation mode of the post-processing apparatus 300 in connection with the present Example. When the user has specified the booklet mode as an operation mode, the user is allowed to specify the size of the print sheet P as a base sheet of the booklet. Further, as shown in FIG. 12, when the user has specified the booklet mode as an operation mode, the user is allowed to employ the input section 210 to specify whether or not the insert sheet I is to be inserted in the booklet (e.g., operation area A1). The user is also allowed to operate the input section 210 to specify whether or not the booklet is to be produced by saddle stitching or by center folding as a form of finishing the booklet containing the insert sheet I (e.g., operation areas B1 and B2), and whether or not the insert sheet I is also to be subjected to saddle stitching, if saddle stitching process is used (e.g., operation areas C1 and C2).

The user is also allowed to operate the input section 210 to input the information on the total pages of the booklet to be produced, the page for inserting the insert sheet I, the size and type of the insert sheet I and the amount of overlap (operation areas D1 through D4). Information on the total pages of the booklet to be produced, and the page for inserting the insert sheet I can be selected from among various numerical values. Sheet size can be selected from among the regular sizes such as A3 and B5, or can be selected from among various numeral values when the sheet having a size other than the regular sizes is used. The type of the sheet can be selected from among the regular types such as an 80-gram sheet and 300-gram sheet. The amount of overlap is used to specify the saddle stitching position with reference to the leading edge of the insert sheet I, when a booklet is produced by the process of saddle stitching and the insert sheet I is also subjected to saddle stitching. A desired numerical value can be selected.

Based on the information acquired by the acquiring section 81*a*, the control section 81*b* controls the time interval for ejecting the insert sheet I or print sheet P to the sheet tray 42. The control section 81*b* also controls the operation of the drive sections 83 through 86, center stitching stapler 50 and trimming unit 70. The trailing edge drive section 83 drives the trailing edge regulating section 43 in the direction of the leading edge or trailing edge of the tray. The folding plate drive section 84 drives the folding plate 57 in the vertical direction and the folding roller drive section 85 drives a pair of folding rollers 56. Further, the arm drive section 86 drives the rewinding section (movable arm) 44.

When a booklet is produced, the control section 81*b* can calculate the shift amount of the position where the sheet bundle is subjected to center stitching, or the shift amount of the position where the sheet bundle is subjected to center folding, in conformity to the form of finishing the booklet including the insert sheet I defined based on the conditions specified by the user (information acquired by the acquiring section 81*a*). Further, the control section 81*b* can calculate the shift amount of the position where trimming is performed by the trimming unit 70 or the shift amount of the position where an image is formed on the print sheet P by the image forming apparatus, in conformity to the shift amount of the execution position where the sheet bundle is subjected to saddle stitching or center folding.

Figure 13:
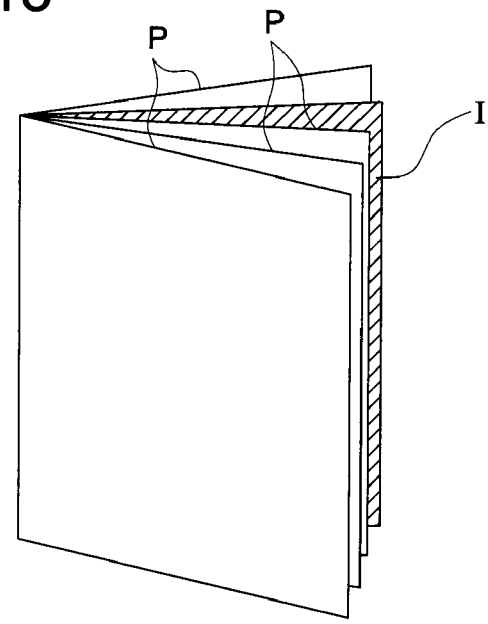
FIG. 13 is an explanatory diagram showing the finished status of a booklet.
Figure 14:
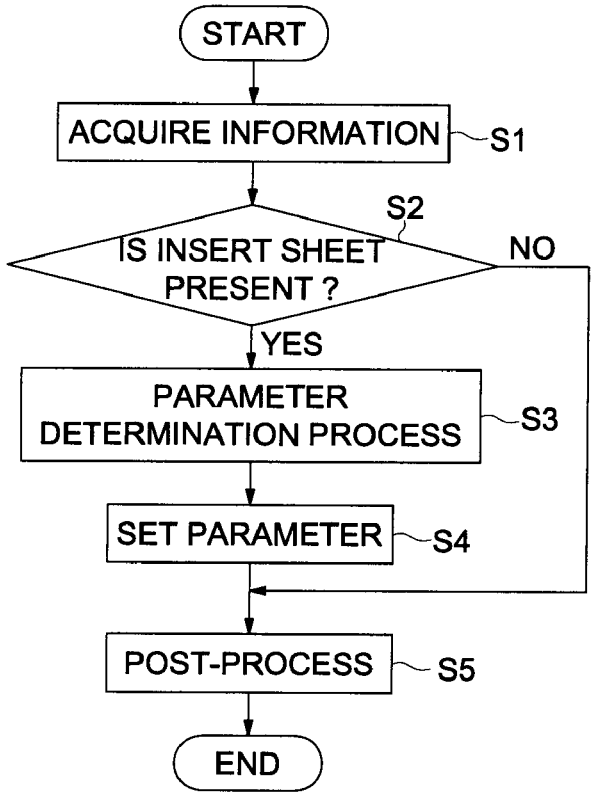
FIG. 14 is a flow chart representing a series of operations for producing a booklet by the post-processing apparatus 300.

The following describes the specific operations of the post-processing apparatus 300 in producing a booklet with an insert sheet I inserted therein. In the following description, an example of producing a booklet using two print sheets P will be given. As shown in FIG. 13, the example is concerned with the case of inserting an insert sheet I between the pages made up of the first print sheet P and second print sheet P, not between pages in the middle of the booklet. FIG. 14 is a flow chart representing a series of operations for producing a booklet by the post-processing apparatus 300 related to the fourth Example. The processing of this flow chart is carried out by the controller 81 of the post-processing apparatus 300.

In Step 1 (S1), the acquiring section 81*a* gets necessary information from the image forming apparatus 200. To put it more specifically, the acquiring section 81*a* acquires the information that booklet mode will be used as the operation mode of the post-processing apparatus 300; and the booklet will be finished in the state where an insert sheet I is inserted therein. The acquiring section 81*a* further acquires information on whether the booklet is to be produced by saddle stitching or center folding, or whether or not the insert sheet I is also subjected to the process of saddle stitching. The acquiring section 81*a* also acquires information on the total number of the booklets, the size of the print sheet P and insert sheet I, the pages where the insert sheet I is to be inserted, and the size and type of the insert sheet I.

In Step 2(S2), based on the information obtained by the acquiring section 81*a*, the control section 81*b* determines the presence of an insert sheet I, i.e., whether or not the booklet is to be produced with the insert sheet I inserted therein. If the result of the decision is affirmative in the Step 2, i.e., if there is an insert sheet I, the operation goes to the Step 3 (S3). If the decision is negative in Step 2, i.e., if there is no insert sheet I, Step 3 and Step 4 (S4) will be skipped and the operation proceeds to the Step 5 (S5) to be described later.

Figure 15:
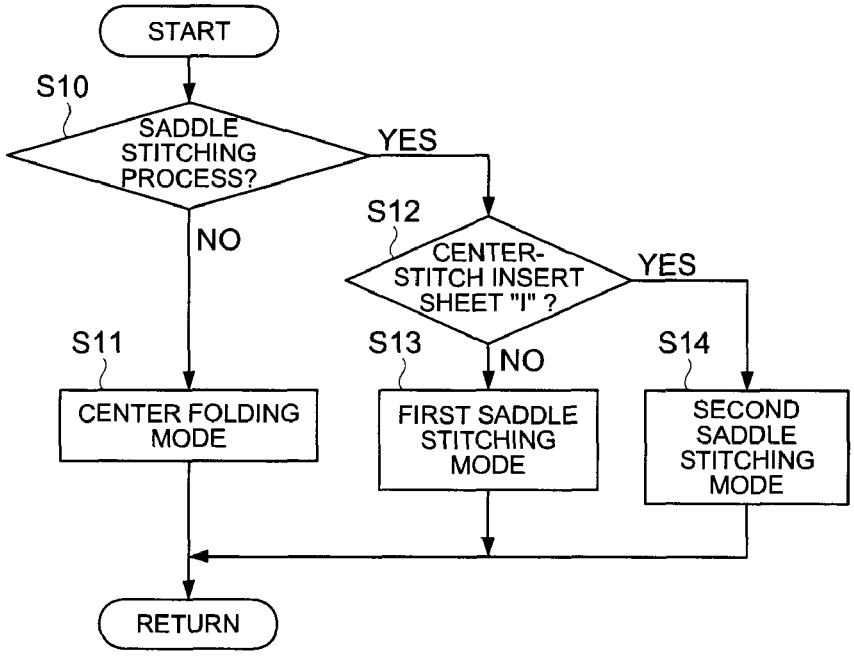
FIG. 15 is a flow chart representing the details of determining process of the parameters in Step 3.

In Step 3, the control section 81*b* determines the parameter for producing the booklet containing an insert sheet I (parameter determination process). FIG. 15 is a flow chart representing the details of determining the parameters in Step 3.

In Step 10 (S10), based on the information acquired by the acquiring section 81*a*, the control section 81*b* determines if the booklet is to be produced by saddle stitching. If the result of this decision is negative in Step 10, i.e., if the booklet is produced by center folding, the operation goes to Step 11 (S11) to determine the parameter corresponding to the center folding (center folding mode). If the result of this decision is affirmative in Step 10, i.e., if the booklet is produced by saddle stitching, the operation goes to Step 12 (S12).

In Step 12, based on the information acquired by the acquiring section 81*a*, the control section 81*b* determines whether or not the insert sheet I is also subjected to saddle stitching in the process of saddle stitching. If the result is negative, i.e., the insert sheet I is not subjected to saddle stitching, the operation goes to Step 13 (S13) to determine the parameter corresponding to the process of saddle stitching (without the insert sheet I being saddle-stitched) (the first saddle stitching mode). If the result is affirmative in Step 12, i.e., the insert sheet I is also subjected to saddle stitching, the operation goes to Step 14 (S14) to determine the parameter corresponding to the process of saddle stitching (with the insert sheet I to be saddle-stitched) (the second saddle stitching mode).

In Step 11, the control section 81*b* determines the parameter corresponding to the center folding mode. Execution of the process in Step 11 determines the shift amount for center folding, shift amount of an image and shift amount for trimming. In this case, the shift amount for center folding can be defined as a distance of the movement of the execution position of center folding from the standard position, i.e., the center of the sheet bundle with reference to the print sheet P.

Figure 16:
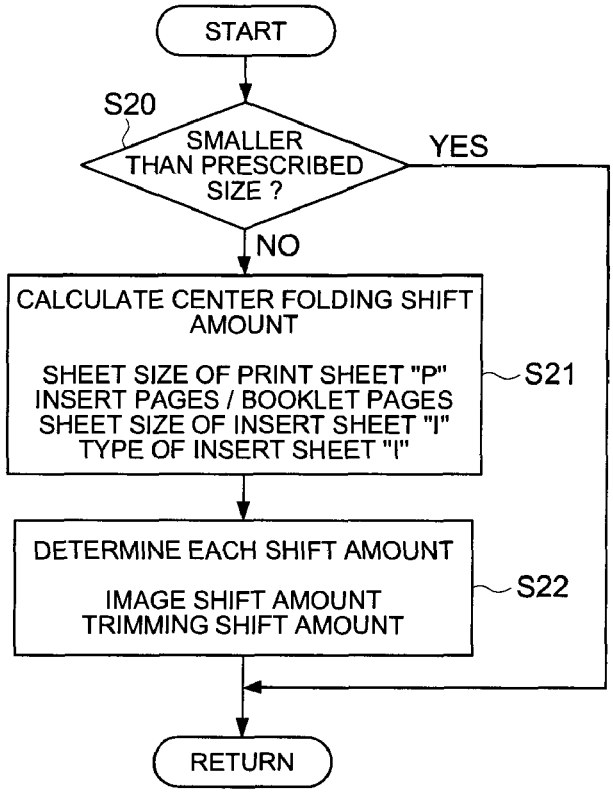
FIG. 16 is a flow chart representing the details of processing in Step 11.

The shift amount of an image signifies the distance of the movement of the image forming position on a print sheet P in the image forming apparatus 200. The shift amount for trimming means the distance of movement of the execution position of trimming. In this case, FIG. 16 is a flow chart representing the details of processing in Step 11. FIGS. 17*a* and 17*c* are explanatory diagrams specifically showing a concrete example of the center folding mode.

In Step 20 (S20), the control section 81*b* determines whether or not the size of the insert sheet I is smaller than a prescribed size. This prescribed size is defined as the size for determining if the execution position of center folding should be changed or not. To put it more specifically, the prescribed size is determined with reference to the print sheet P which is a base sheet for the booklet (e.g., half the size of the print sheet P).

If the result of decision in Step 20 is affirmative, i.e., if the size of the insert sheet I is smaller than a prescribed size, this routine is skipped. In this case, the shift amount for center folding is zero and the execution position of center folding is determined to remain at the standard position (center of the sheet bundle with reference to the print sheet P without any change, as shown in FIG. 17*a*, similarly to the case where there is no insert sheet I. Further, the shift amount for image and shift amount for trimming are also zero, and the position of image-forming and execution position of trimming are also determined to remain unchanged. If the result of Step 20 is negative, i.e., if the size of the insert sheet I is greater than or equal to a prescribed value, the system goes to the steps of and after Step 21 (S21). In this case, as shown in FIG. 17*a*, it is assumed that the center folding position requires to change from the standard position. The position of image-forming and execution position of trimming are also assumed to require change, as a result of the execution position of center folding having been changed.

In Step 21, the control section 81*b* calculates the shift amount for center folding to ensure that the execution position of center folding may be set on the forward side of the leading edge position of the insert sheet I. The shift amount for the center folding is determined in conformity to the size of the print sheet P, pages for insertion, pages of the booklet, and the size and type of the insert sheet I. As shown in FIG. 17*b*, the shift amount for center folding is calculated as a total amount of the margin conforming to the pages for insertion (e.g., 0.1 mm ensured for each page); the margin conforming to the size of the print sheet P (e.g., 2.5 mm if the size of the insert sheet I is half that of the print sheet P); and the margin conforming to the type of the insert sheet I (i.e., thickness of the insert sheet I) (e.g., 1.0 mm if the insert sheet I is a 300-gram sheet, and 0.5 mm if the insert sheet I is a 80-gram sheet). In Case 1, the shift amount for center folding is calculated as 4.5 mm. In Case 2, the shift amount for center folding is calculated as 3.2 mm. If the shift amount for center folding is calculated as a positive value, the execution position of center folding is set to a position shifted toward the print sheet leading edge from the standard position.

In Step 22 (S22), based on the calculated shift amount for center folding, the control section 81*b* determines the shift amount of an image and shift amount for trimming. To put it more specifically, as shown in FIG. 17*c*, the shift amount of an image is determined to be the same value as the shift amount for center folding, and the shift amount for trimming is determined to be the value obtained by doubling the shift amount for center folding.

Figure 18:
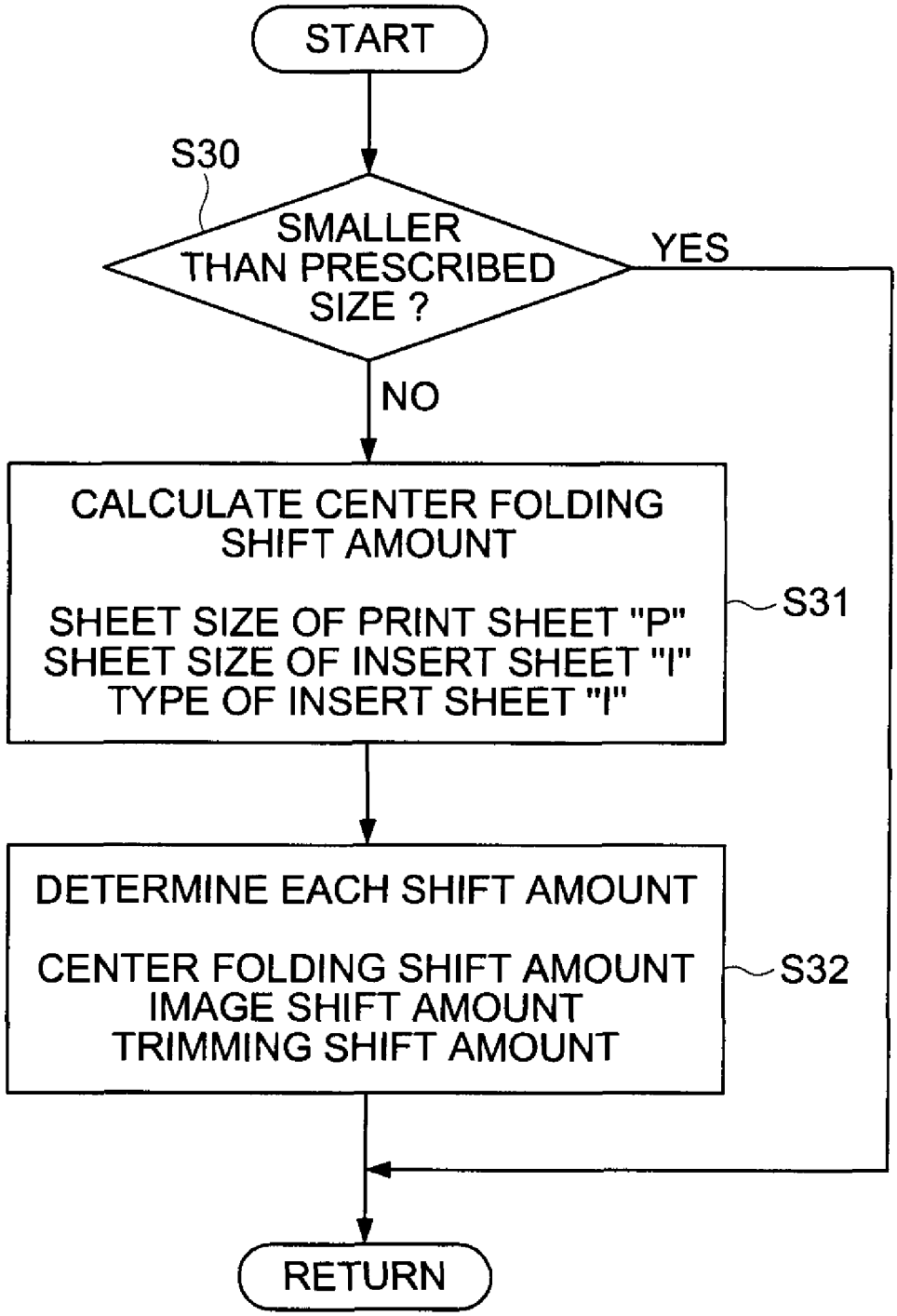
FIG. 18 is a flow chart representing the details of processing in Step 13.

In Step 13, the control section 81*b* determines the parameter conforming to the first saddle stitching mode. Processing in Step 13 determines the shift amount for center stitching, shift amount for center folding, shift amount of an image and shift amount for trimming. In this case, the shift amount for center stitching can be defined as a distance of the movement of the execution position of center stitching from the standard position, i.e. the center of the sheet bundle with reference to the print sheet P. FIG. 18 is a flow chart representing the details of processing in Step 13. FIGS. 19*a*-19*c* are explanatory diagrams specifically showing a specific example of the first saddle stitching mode.

In Step 30 (S30), the control section 81*b* determines whether or not the size of the insert sheet I is smaller than a prescribed size. This prescribed size is defined as the size for determining if the execution position of center stitching should be changed or not. To put it more specifically, the prescribed size is determined with reference to the print sheet P which is a base sheet for the booklet (e.g., half the size of the print sheet P).

If the result of decision in Step 30 is affirmative, i.e., if the size of the insert sheet I is smaller than a prescribed size, this routine is skipped. In this case, the shift amount for center stitching is zero and the execution position of center folding is determined to remain the same as the standard position without any change, as shown in FIG. 19*a*, similarly to the case where there is no insert sheet I. Further, the shift amount for center folding, shift amount of an image and shift amount for trimming is also zero, and the execution position of center folding, position of image-forming and execution position of trimming are also determined to remain unchanged. If the result of Step 30 is negative, i.e., if the size of the insert sheet I is greater than or equal to a prescribed value, the system goes to the Step 31 (S31) and thereafter. In this case, as shown in FIG. 19*a*, the execution position of center stitching is assumed to require change from the standard position. The execution position of center folding, position of image-forming and execution position of trimming are also assumed to require change, as a result of the execution position of center stitching having been changed.

In Step 31, the control section 81*b* calculates the shift amount for center stitching to ensure that the execution position of center stitching may be set on forward side of the leading edge position of the insert sheet I. The shift amount for the center stitching is determined in conformity to the sizes of the print sheet P and insert sheet I, and type of the insert sheet I. As shown in FIG. 19*b*, the shift amount for center stitching is calculated as a total amount of the margin conforming to the size of the print sheet P (e.g., 2.5 mm if the size of the insert sheet I is half that of the print sheet P); and the margin conforming to the type of the insert sheet I (i.e., thickness of the insert sheet I) (e.g., 1.0 mm if the insert sheet I is a 300-gram sheet, and 0.5 mm if the insert sheet I is a 80-gram sheet). In Case 1, the shift amount for center stitching is calculated as 3.0 mm. If the shift amount for center stitching is calculated as a positive value, the execution position of center stitching is set to the position shifted toward the print sheet leading edge from the standard position.

In Step 32 (S32), based on the calculated shift amount for center stitching, the control section 81*b* determines the shift amount for center folding, shift amount of an image and shift amount for trimming. To put it more specifically, the shift amount for center folding and shift amount of an image are determined as the same as the shift amount for center stitching. The shift amount for trimming is determined as the value obtained by doubling the shift amount for center stitching.

Figure 20:
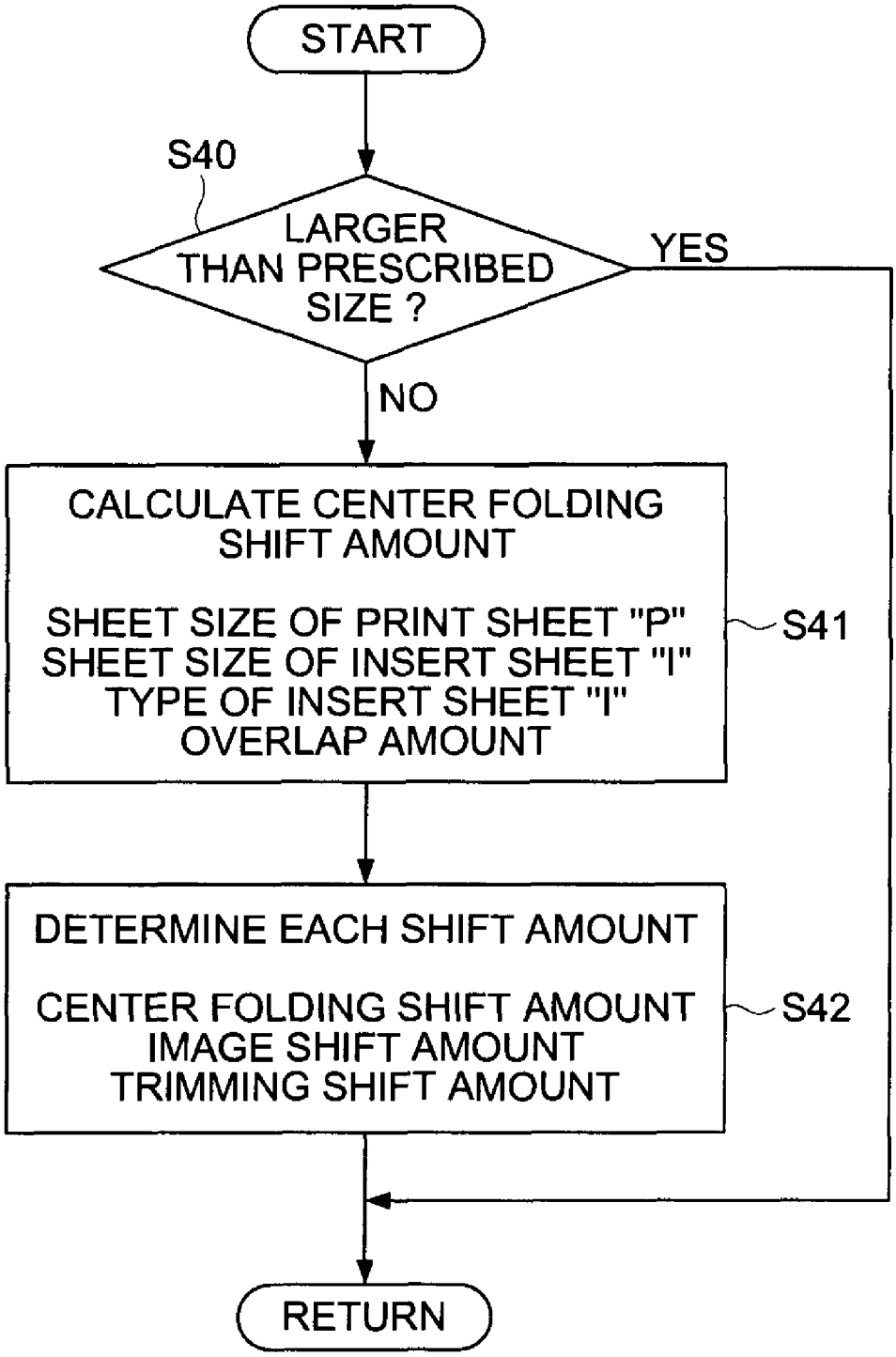
FIG. 20 is a flow chart representing the details of processing in Step 14.

In Step 14, the control section 81*b* determines the parameter corresponding to the second saddle stitching mode. Processing of this Step 14 determines the shift amount for center folding, shift amount for center stitching, shift amount of an image and shift amount for trimming. FIG. 20 is a flow chart representing the details of processing in Step 14. FIGS. 21*a*-21*c* are explanatory diagrams specifically showing a specific example of the second saddle stitching mode.

In Step 40 (S40), the control section 81*b* determines whether or not the size of the insert sheet I is greater than a prescribed size. The prescribed size is defined as the sheet size for determining whether or not the saddle stitching position should be changed (e.g., half the size of the print sheet P), similarly to the case of Step 30.

If the result of decision in Step 40 is affirmative, i.e., if the size of the insert sheet I is greater than a prescribed size, this routine is skipped. In this case, the shift amount for center stitching is zero and the execution position of center stitching is determined to remain the same as the standard position without change, as shown in FIG. 21*a*, similarly to the case where there is no insert sheet I. Further, the shift amount for center folding, shift amount of an image and shift amount for trimming is also zero, and the execution position of center folding, position of image-forming and execution position of trimming are also determined to remain unchanged. If the result of Step 40 is negative, i.e., if the size of the insert sheet I is equal to or smaller than a prescribed value, the system goes to the Step 41 (S41) and thereafter. In this case, as shown in FIG. 21*a*, the execution position of center stitching is assumed to require change from the standard position. The execution position of center folding, position of image-forming and execution position of trimming are also assumed to require change, as a result of the execution position of center stitching having been changed.

In Step 41, the control section 81*b* calculates the shift amount for center stitching to ensure that the saddle stitching position is set on the backward side of the leading edge position of the insert sheet I. The shift amount for center stitching is determined by the sizes of the print sheet P and insert sheet I, the type of the insert sheet I and the amount of overlap. As shown in FIG. 21*b*, the shift amount for center stitching is calculated as a total amount of the margin conforming to the size of the insert sheet I (e.g., −2.5 mm if the size of the insert sheet I is half that of the print sheet P); the margin conforming to the type of the insert sheet I (i.e., thickness of the insert sheet I) (e.g., −1.0 mm if the insert sheet I is a 300-gram sheet, and −0.5 mm if the insert sheet I is a 80-gram sheet); and the amount of overlap (e.g., the amount specified by the user). In Case 1, the shift amount for center stitching is calculated as −6.5 mm. In Case 2, the shift amount for center stitching is calculated as −9.0 mm. If the shift amount for center stitching is calculated as a negative value, the center folding position is set to the position shifted toward the print sheet trailing edge from the standard position.

In Step 42 (S42), based on the calculated shift amount for center stitching, the control section 81*b* determines the shift amount for center folding, shift amount of an image and shift amount for trimming. To put it more specifically, the shift amount for center folding and shift amount of an image are determined to be the same value as that of the shift amount for center stitching. The shift amount for trimming is determined as the value (absolute value) obtained by doubling the shift amount for center stitching.

Referring again to FIG. 14, in Step 4, the control section 81*b* sets the parameter determined in the parameter determination process (Step 3). To put it more specifically, the control section 81*b* sends information on the calculated shift amount of an image to the image forming apparatus 200, whereby the image forming apparatus 200 is instructed to shift the image forming position on the print sheet P for booklet production, from the regular image forming position by the shift amount of an image. Further, based on the result of calculation, the control section 81*b* sets the shift amount for center folding, shift amount for center stitching, and shift amount for trimming as control parameters.

In Step 5, the control section 81*b* controls production of a booklet (post-processing) after the print sheet P and insert sheet I whose image forming positions have been shifted in response to the shift amount of an image by the image forming apparatus 200 are loaded on the sheet tray 42.

Figure 22A:
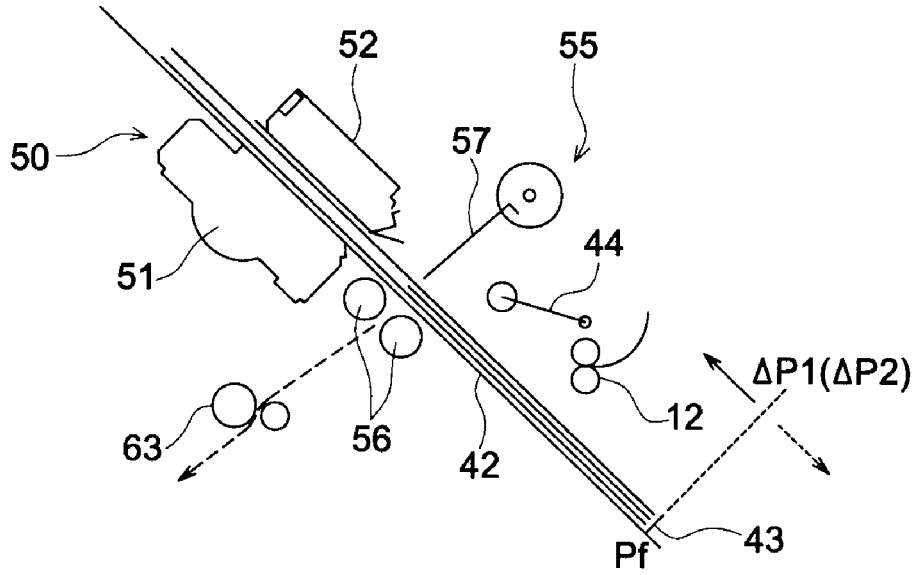
FIGS. 22*a* and 22*b* are explanatory diagrams schematically showing the state of the center folding and saddle stitching operations.

When a booklet is produced by center folding, the control section 81*b* controls the trailing edge drive section 83 to move the trailing edge regulating section 43, whereby the position of the trailing edge regulating section 43 is set. In this case, a test and simulation are conducted to acquire in advance the positional relationship of the trailing edge regulating section 43, where the central position of the print sheet P corresponds to the processing position of the center folding section 55 (folding plate 57 lowering position), in response to the print sheets P of various sizes. The control section 81*b* sets the position of the trailing edge regulating section 43 based on this positional relationship, the size of the print sheet P to be saddle-stitched and the shift amount for center folding. As shown in FIG. 22*a*, the trailing edge regulating section 43 is normally set at the position Pf where the center of the sheet bundle based on the print sheet P corresponds to the processing position by the center folding section 55. Except for the case where the shift amount for center folding ΔP1 is zero, the trailing edge regulating section 43 is set at the position shifted from the position Pf by shift amount for center folding ΔP1.

The control section 81*b* controls the folding roller drive section 85 so that a pair of folding rollers 56 may rotate facing each other. Further, the control section 81 controls the folding plate drive section 84 so that the folding plate 57 may be lowered. This operation allows the sheet bundle to be pushed into between a pair of folding rollers 56 by the folding plate 57, and permits the sheet bundle to be center-folded by the rotation of the rollers 56. Since the folding plate 57 is located on the upper surface side of the sheet tray 42, lowering of this folding plate 57 allows the center folded sheet (booklet) to be ejected from a pair of folding rollers 56, with the end of the folded side facing downward. The booklet ejected from a pair of folding rollers 56 is conveyed by the sheet ejection rollers 63, and is supplied to the trimming unit 70.

Figure 22B:
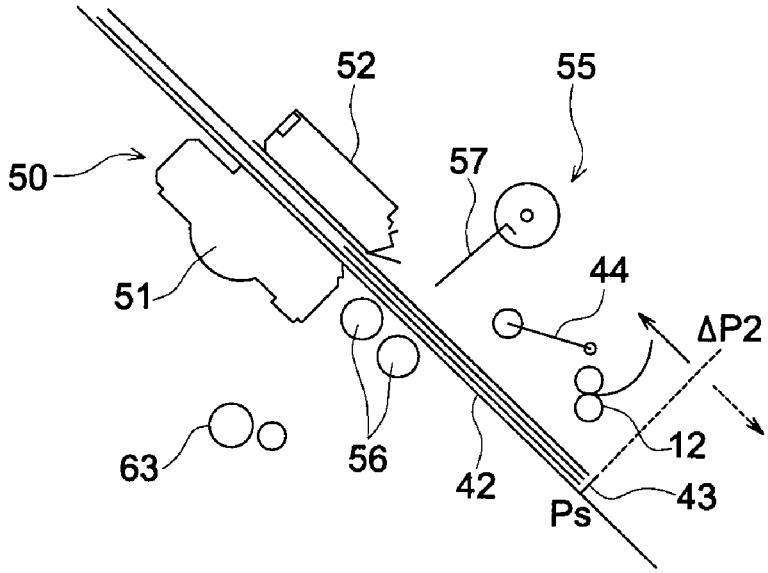

When a booklet is produced by saddle stitching, the control section 81*b* performs center stitching as a step of saddle stitching process. To put it more specifically, the control section 81*b* controls the trailing edge drive section 83 to move the trailing edge regulating section 43, whereby the position of the trailing edge regulating section 43 is set. In this case, a test and simulation are conducted to acquire in advance the positional relationship of the trailing edge regulating section 43 where the central position of the print sheet P corresponds to the position processed by the center stitching stapler 50 (stapling position), in response to the print sheets P of various sizes. The controller 81 sets the position of the trailing edge regulating section 43 based on this positional relationship, the size of the print sheet P to be saddle-stitched and the shift amount for center stitching. As shown in FIG. 22*b*, the trailing edge regulating section 43 is normally set at the position Ps where the center of the sheet bundle based on the print sheet P corresponds to the position to be processed by the center stitching stapler 50. Except for the case where the shift amount for center stitching ΔP2 is zero, the trailing edge regulating section 43 is set at the position shifted from the position Ps by shift amount for center stitching ΔP2. Then the control section 81*b* controls the center stitching stapler 50 to staple the sheet bundle.

Then the control section 81*b* performs center folding as a step of saddle stitching process. The control section 81*b* controls the trailing edge drive section 83 to move the trailing edge regulating section 43, whereby the position of the trailing edge regulating section 43 is set. As shown in FIG. 22*a*, the trailing edge regulating section 43 is normally set at the position Pf wherein the central position of the sheet bundle based on the print sheet P is the execution position of center folding. Except when the shift amount for center stitching ΔP2 is zero, the trailing edge regulating section 43 is set at the position shifted from the position Ps by the shift amount for center stitching ΔP2.

When a booklet has been finished with an insert sheet I inserted therein by center folding or saddle stitching, this booklet is supplied to the trimming unit 70. When the booklet has been supplied to the trimming unit 70, the control section 81*b* controls to trim off the front edge side of the booklet. To put it more specifically, the control section 81*b* controls the trimming unit 70 to start trimming operation at a position shifted by the shift amount for trimming from the trimming standard position on the front edge side (e.g., the endmost on the front edge). The booklet having been trimmed off is ejected to the lower sheet ejection tray 64.

Figure 23A:
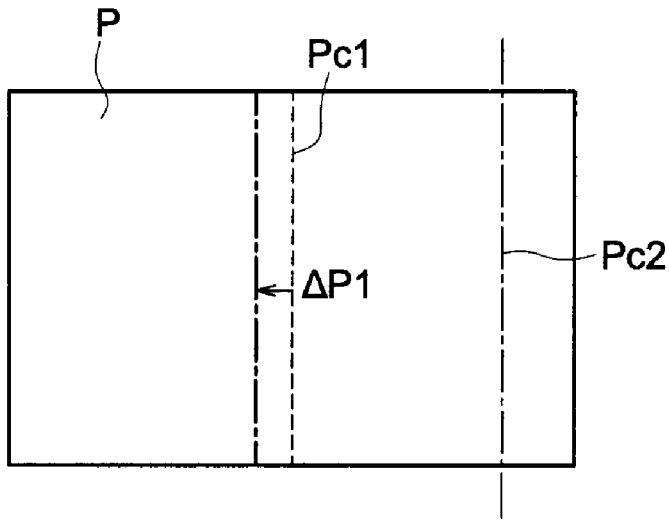
FIGS. 23*a*-23*c* are explanatory diagrams showing the execution position of center-folding, execution position of center stitching and execution position of trimming.

Thus, a booklet having an insert sheet I inserted therein is produced by a series of the aforementioned steps. As shown in FIG. 23*a*, when a booklet is formed by center folding and the insert sheet I having the half size of the print sheet P, for example, is to be inserted in the booklet, the execution position of center folding is set at a position shifted from the central position Pc1 of the sheet bundle with reference to the print sheet P by the shift amount for center folding ΔP1 to the side of the sheet leading edge (the left side in the figure). In this case, the image forming position on the print sheet P is also shifted by the shift amount of an image (ΔP1). Further, the execution position of trimming is set to the position Pc2 shifted by the shift amount for trimming (ΔP1×2) from the endmost on the front edge side of the booklet.

Figure 23B:
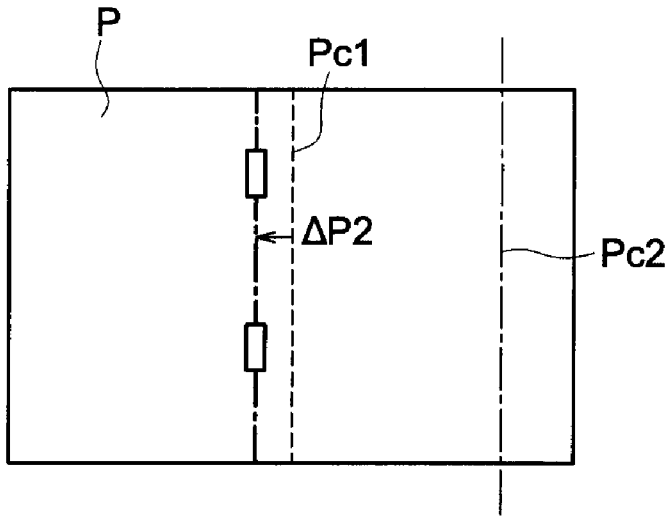

As shown in FIG. 23*b*, when a booklet is produced by saddle stitching without the insert sheet I being saddle-stitched together, for example, when an insert sheet I having the half size of the print sheet P is inserted in the booklet, the execution position of center stitching is set at a position shifted from the central position Pc1 of the sheet bundle with reference to the print sheet P by the shift amount for center stitching ΔP2 to the side of the sheet leading edge (to the left of the figure). In this case, the execution position of center folding is set to the position shifted from the central position Pc1 of the sheet bundle with reference to the print sheet P by the shift amount for center folding (ΔP2) to the side of the sheet leading edge (left side of the figure). Further, the image forming position on the print sheet P is also set at the position shifted by the shift amount of an image (ΔP2). The execution position of trimming is also set at the position Pc2 shifted from the endmost on the front edge side of the booklet by the shift amount for trimming (ΔP2×2).

Figure 23C:
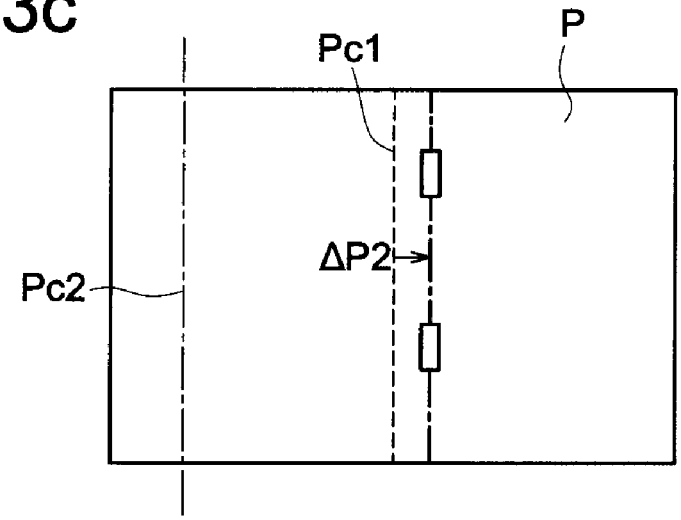

As shown in FIG. 23*c*, when a booklet is produced by saddle stitching with the insert sheet I to be saddle-stitched together, for example, when an insert sheet I having the half size of the print sheet P is inserted in the booklet, the execution position of center stitching is set at the position shifted from the central position Pc1 of the sheet bundle with reference to the print sheet P by the shift amount for center stitching ΔP2 to the side of the sheet trailing edge (to the central right of the figure). In this case, the execution position of center folding is set to the position shifted from the central position Pc1 of the sheet bundle with reference to the print sheet P by the shift amount for center folding (ΔP2) to the side of the sheet trailing edge (right side of the figure). Further, the position of an image formed on the print sheet P is also set at the position shifted by the shift amount of an image (ΔP2). The execution position of trimming is also set at the position Pc2 shifted from the endmost on the front edge side of the booklet by the shift amount for trimming (ΔP2×2).

As described above, according to the present Example, the insert sheet I is supplied to the sheet tray 42 along the second conveying path R2, whereby a booklet with an insert sheet I inserted therein is finished in a series of booklet production processes. When a booklet with an insert sheet I inserted therein is to be produced, the shift amount of the position of the sheet bundle for center folding or saddle stitching is calculated in response to the finished form of the booklet with an insert sheet I inserted therein. This ensures that the position of the sheet bundle for center folding or saddle stitching can be shifted as required, and provides many variations in the finished form of the booklet with an insert sheet I inserted therein. This procedure allows a booklet to be produced with an insert sheet I inserted therein in the form meeting various user requirements.

In the present Example, based on the result of acquisition by the acquiring section 81*a* (information on the production of a booklet by center folding, and information on the sizes of the print sheet P and insert sheet I), the control section 81*b* determines whether the central position of the sheet bundle with reference to the print sheet P or the position shifted from the central position of the sheet bundle will be the execution position of center folding. When a booklet is formed by center folding, some users may not require the insert sheet I to be center folded together. In this case, whether the insert sheet I is center-folded or not depends on sizes of the print sheet P and insert sheet I. From the aforementioned information, a step is taken to determine if the execution position of center folding is shifted or not. This makes it possible to automatically determine the situation where the execution position of center folding should be shifted.

When a decision has been made to shift the execution position of center folding, the control section 81*b* calculates the shift amount of the execution position of center folding, from the central position of the sheet bundle, based on the sizes of the print sheet P and insert sheet I, the total number of pages of the booklet to be produced, the pages where the insert sheet I is to be inserted, and the type of the insert sheet. This an ensures appropriate calculation of the execution position of center folding since the sizes of the print sheet P and insert sheet I, the total number of pages of the booklet to be produced, the pages where the insert sheet I is to be inserted, and the type of the insert sheet are taken into account. To put it another way, this arrangement produces a booklet with the insert sheet I inserted therein, without the insert sheet I being center-folded, and without the position being shifted excessively. The shift amount of the execution position of center folding is a parameter also related to the shift amount of the position of image-forming and execution position of trimming. The optimum calculation of these shift amounts can be provided by appropriate calculation of the shift amount of the execution position of center folding.

In the present Example, based on the result of acquisition by the acquiring section 81*a* (information on the production of a booklet by saddle stitching, information on the sizes of the print sheet P and insert sheet I, and information on whether the insert sheet I is also to be saddle-stitched or not), the control section 81*b* determines whether the central position of the sheet bundle with reference to the print sheet P or the position shifted from the central position of the sheet bundle will be the execution position of center stitching and execution position of center folding. When a booklet is formed by saddle stitching, some users require the insert sheet I to be saddle-stitched together, and other users do not. In this case, whether the insert sheet I is saddle stitched or not depends on sizes of the print sheet P and insert sheet I. From the aforementioned information, a step can be taken to determine the situation where the execution position of center stitching and the execution position of center folding is shifted.

When the insert sheet I is not center-stitched together and a decision has been made that the execution position of center stitching and execution position of center folding should be shifted, the control section 81*b* calculates the shift amount of the execution position of center stitching and execution position of center folding from the central position of the sheet bundle, based on the information on the sizes of the print sheet P and insert sheet I, and the type of the insert sheet I. This arrangement ensures appropriate calculation of the shift amount of the execution position of center stitching and the execution position of center folding since the sizes of the print sheet P and insert sheet I, and the type of the insert sheet I are taken into account. To put it another way, this arrangement produces a booklet with the insert sheet I inserted therein, without the insert sheet I being saddle stitched or center folded, and without the position being shifted excessively. The shift amount of the execution position of center stitching and execution position of center folding is a parameter also related to the shift amount of the position of image-forming and execution position of trimming. Thus, the optimum calculation of these shift amounts can be provided by appropriate calculation of the shift amount of the execution position of center stitching and the execution position of center folding.

When the insert sheet I is also to be center-stitched, and a decision has been made that the execution position of center stitching and execution position of center folding should be shifted, the control section 81*b* calculates the shift amount of the execution position of center stitching and execution position of center folding, from the central position of the sheet bundle, based on the sizes of the print sheet P and I, the type of the insert sheet I and the amount of overlap. This arrangement ensures appropriate calculation of the shift amount of the execution position of center stitching and execution position of center folding since the sizes of the print sheet P and insert sheet I, the type of the insert sheet I and the amount of overlap are taken into account. To put it another way, this arrangement produces a booklet with the insert sheet I inserted therein, wherein the insert sheet I is center-stitched and center-folded, without the position being shifted excessively.

In the present Example, based on the calculated shift amount, the control section 81*b* calculates the shift amount of the position of an image formed on the print sheet P by the image forming apparatus 200. The image forming apparatus 200 normally forms an image on each page with reference to the central position of the print sheet P. As described above, when the execution position of center folding or saddle stitching has been shifted, the position of an image to be formed on each page of the booklet could be shifted from the center of the page. However, the shift amount of the position of image-forming can be calculated and the result of this calculation can be reflected on the processing by the image forming apparatus 200, whereby shift of the image from the center of the page can be minimized.

In the present Example, the post-processing apparatus 300 is further provided with a trimming unit 70 to trim off the end on the front edge side of the produced booklet. In this case, the control section 81*b* sets the shift amount of the execution position of trimming on the booklet, based on the calculated shift amount. As described above, if there is a shift from the execution position of center folding or saddle stitching, the end on the front edge side of the booklet is shifted so that the lengths of the right and left pages of the booklet may differ. However, the end on the front edge side of the booklet can be kept aligned by setting the shift amount of the execution position of trimming for the trimming unit 70.

In the present Example, the trailing edge regulating section 43 is arranged in such a way that, when sheets are loaded on the sheet tray 42, the trailing edge position of sheets ejected from the sheet ejection rollers 12 to the sheet tray 42 is located between the leading edge position of the insert sheet I having been loaded on the sheet tray 42 and the trailing edge regulating section 43.

For example, when a print sheet P and a insert sheet I with a size different from that of the print sheet P are loaded on the sheet tray 42, the following problem may occur due to the positional relationship between the trailing edge regulating section 43 at the time of sheet loading and the sheet ejection rollers 12. To put it more specifically, the trailing edge of the sheet ejected from the sheet ejection rollers 12 to the sheet tray 42 is located closer to the tray leading edge than the leading edge position of the insert sheet I having been loaded on the sheet tray 42. In this case, when the ejection of the insert sheet I is followed by that of the print sheet P, the trailing edge of the print sheet P may be located on the forward side of the leading edge of the insert sheet I. When this print sheet P is aligned toward the trailing edge regulating section 43, there will be interference between the trailing edge of the print sheet P and leading edge of the insert sheet I. This may result in a paper jam or misalignment between sheets.

According to the present Example, however, the trailing edge of the sheet ejected from the sheet ejection rollers 12 to the sheet tray 42 is located between the leading edge position of the insert sheet I having been loaded on the sheet tray 42 and the trailing edge regulating section 43, that is, the trailing edge is found on the surface of the insert sheet I. This arrangement prevents the interference between the leading edge of the insert sheet I and the trailing edge of the print sheet P. This ensures that the print sheet P and insert sheet I of mutually different sizes is loaded on the sheet tray 42, with the possible occurrence of a paper jams or misalignment kept minimized. Thus, the sheet bundle (print sheet P and insert sheet I) on the sheet tray 42 can be processed, and a booklet can be finished while containing an insert sheet I placed between the pages thereof.

In the aforementioned Example, when a booklet is produced by saddle stitching, center stitching precedes center folding. Accordingly, calculation is made to find out the shift amount of the execution position of center stitching. Based on the result of calculation, various parameters (shift amounts of the execution position of center folding, position of image-forming and execution position of trimming) are determined. However, center stitching can be performed after center folding. In this case, the shift amount of the execution position of center folding is determined under the same conditions as those of the shift amount of the execution position of center stitching. Based on this decision, parameters (shift amounts for the execution position of center stitching position of image-forming and execution position of trimming) may be determined. In the process of saddle stitching, there is a relation where the execution position of center stitching and the execution position of center folding correspond to each other, and therefore, both shift amounts can be set simultaneously. Further, independently of the order of performing the operation of center folding and saddle stitching, any one of the shift amount can be determined. After that, the remaining shift amount can be determined accordingly.

When the insert sheet I is supplied from the image forming apparatus 200 and an image is formed on the insert sheet I by the image forming apparatus 200, the printing position of the insert sheet I can be shifted in conformity to the page where the insert sheet I is to be inserted. To be more specific, if there are a great total number of pages in a booklet, the amount to be trimmed off by the trimming unit 70 can be more reduced, when the insert sheets I are to be inserted in the central portion of the booklet rather than the portion near the final or first page of the booklet, because of the thickness in the lapped portion of a plurality of print sheets P. Thus, depending on the pages where the insert sheet I is placed, the image formed on the insert sheet I may be cut off. To eliminate this possibility, the position of printing on the insert sheet I is shifted in conformity to the pages where the insert sheet I is placed. This arrangement solves such a problem.

In the aforementioned Example, the image forming system is provided with the trimming unit 70 as a function of the post-processing apparatus 300. This trimming unit 70 can be included as a device (trimmer) in the image forming system independent of the post-processing apparatus 300.

In the aforementioned Example, the control section 81*b* of the post-processing apparatus 300 calculates the shift amount of the position of image-forming in conformity to the shift amount of the execution position of center folding or the execution position of center stitching. This information is given to the image forming apparatus 200. However, without being restricted to the present Example, only the shift amount of the execution position of center folding or the execution position of center stitching can be supplied to the image forming apparatus 200 by the control section 81*b* of the post-processing apparatus 300, for example. In this case, based on the shift amount supplied from the post-processing apparatus 300, the image forming apparatus 200 calculates the shift amount of the position of an image formed on the print sheet P, and the position of the image formed on the print sheet P may be shifted in conformity to the shift amount of the position of image-forming.

To calculate the shift amount of the execution position of center folding or the execution position of center stitching, the range of the image formed on the print sheet I can be used as the limit. This will minimize the cases where the image assigned to each page is interfered by center folding or saddle stitching operation.

EXAMPLE 5

The following describes in details of the fifth Example of the present invention with reference to drawings.

Figure 2C:
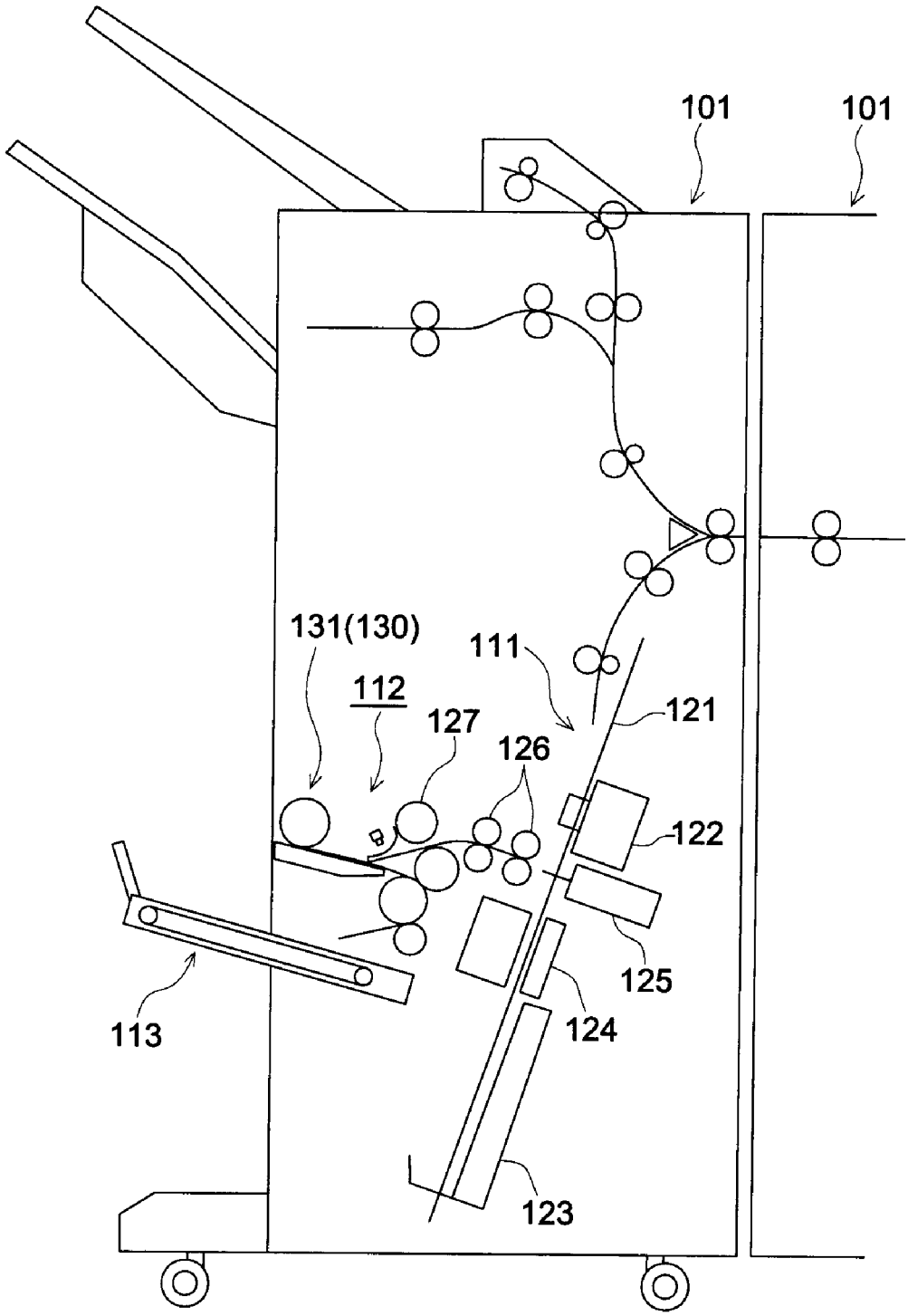
FIG. 2*c* is a schematic explanatory diagram showing the overall structure of a post-processing apparatus in an embodiment of the present invention.

The post-processing apparatus 101 of FIG. 2*c* is connected to the image forming apparatus 100, and includes a book binding section 111 for bundling a required number of image-formed sheets fed from the image forming apparatus 100, and a sheet ejection section 112 for ejecting the bookbound sheet bundle S outside the apparatus.

A sheet bundle collecting unit 113 is located close to the portion under the aforementioned sheet ejection section 112. This sheet bundle collecting unit 113 sequentially receives the sheet bundles S ejected from the sheet ejection section 112 to the outside and collects these sheet bundles in a standing and leaning position.

The aforementioned book binding section 111 includes a sheet receiving tray 121 for receiving a required number of the image-formed sheets conveyed from the image forming apparatus 100 and collects these sheets under the control of the control unit of the image forming apparatus 100, a sheet width aligning member 122 for aligning each of the sheets introduced into the sheet receiving tray 121 one by one, a positioning guide 123 for receiving and aligning the lower ends of the sheets introduced to the sheet receiving tray 121, and moving the collected sheets to the position of saddle stitching or position of center folding, for determining the position thereof, a stapler 124 for stapling at the central portions of the stacked sheets for the process of saddle stitching; and a folding knife 125 and folding rollers 126 as a center folding unit for folding the stitched sheet bundle into two at the stitched position as the process of center folding.

When a required number of image-formed sheets have been stacked on the aforementioned sheet receiving tray 121, this post-processing apparatus 101 moves the positioning guide 123 to the position wherein the central portions of the stacked sheets will be placed opposed to the stapler 124, and the stacked sheets are stitched at the central portions by the stapler 124.

Upon completion of the sheet stitching, the positioning guide 123 moves to the place wherein the stitched positions of the sheets are placed opposed to the folding knife 125. Then, the stitched positions of the sheets are pushed into the nip section of the folding rollers 126 by the folding knife 125, and the sheets are folded into two by the folding rollers 126, whereby bookbinding operation is performed. In the example of FIG. 2*c*, the folding rollers 126 are arranged in multistage.

Figure 31:
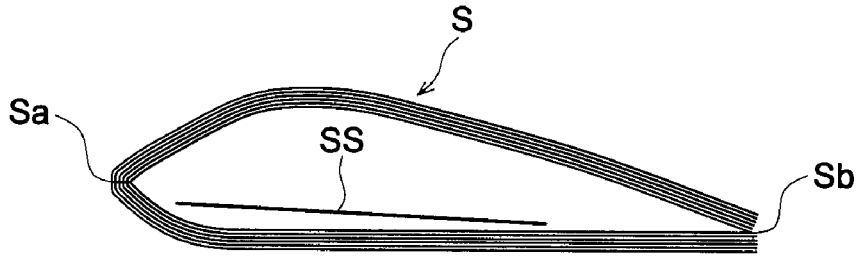
FIG. 31 is a side view showing a saddle-stitched and center-folded sheet bundle.

In the center-folded sheet bundle S having been bookbound by center stitching and center folding, the interleaf SS is inserted in the free state; that is, the interleaf SS is inserted without being center-stitched or center folded, as shown in FIG. 31. This interleaf SS is supplied from an inserter (not illustrated) provided on the post-processing apparatus 101 or from the aforementioned image forming apparatus 100, to the aforementioned sheet receiving tray 121 to be lapped over a required number of sheets stacked and set.

The lower end of the interleaf SS is aligned together with the sheets having been loaded onto the sheet receiving tray 121 by the positioning guide 123. Since the height thereof does not exceed the size of the loaded sheets, the sheets are subjected to center stitching and center folding operation, whereby the interface SS is inserted in the center folded sheets of the double-folded sheet bundles S in the free state, as described above.

As described above, the sheets are center-folded by being folded into two by the folding knife 125, while the stitched position of the sheet is pushed into the nip section of the folding rollers 126. The sheet bundle S is fed to the aforementioned sheet ejection section 112 from the folding rollers 126, with the folded portion Sa taking the lead, namely, with the folded portion Sa facing in the sheet ejection direction.

This sheet ejection section 112 is provided with the sheet ejection mechanism 130, which ejects the aforementioned sheet bundle S having been introduced with the folded portion Sa taking the lead, in the sheet ejection orientation wherein the sheet bundles S are stacked in a standing and leaning position on the aforementioned sheet bundle collecting unit 113, with the spread portion Sb facing upward, which is the opposite side to the folded portion Sa.

In the present Example, the aforementioned sheet ejection mechanism 130 includes a switch-back mechanism 131 as a reversing section. After having received the aforementioned sheet bundles S introduced with the folded portion Sa taking the lead as described above, this switch-back mechanism 131 switches the sheet bundles S back, and conveys the sheet bundles S onto the aforementioned sheet bundle collecting unit 113, with the spread portion Sb taking the lead, namely, with the spread portion Sb facing in the direction of sheet ejection.

Figure 24:
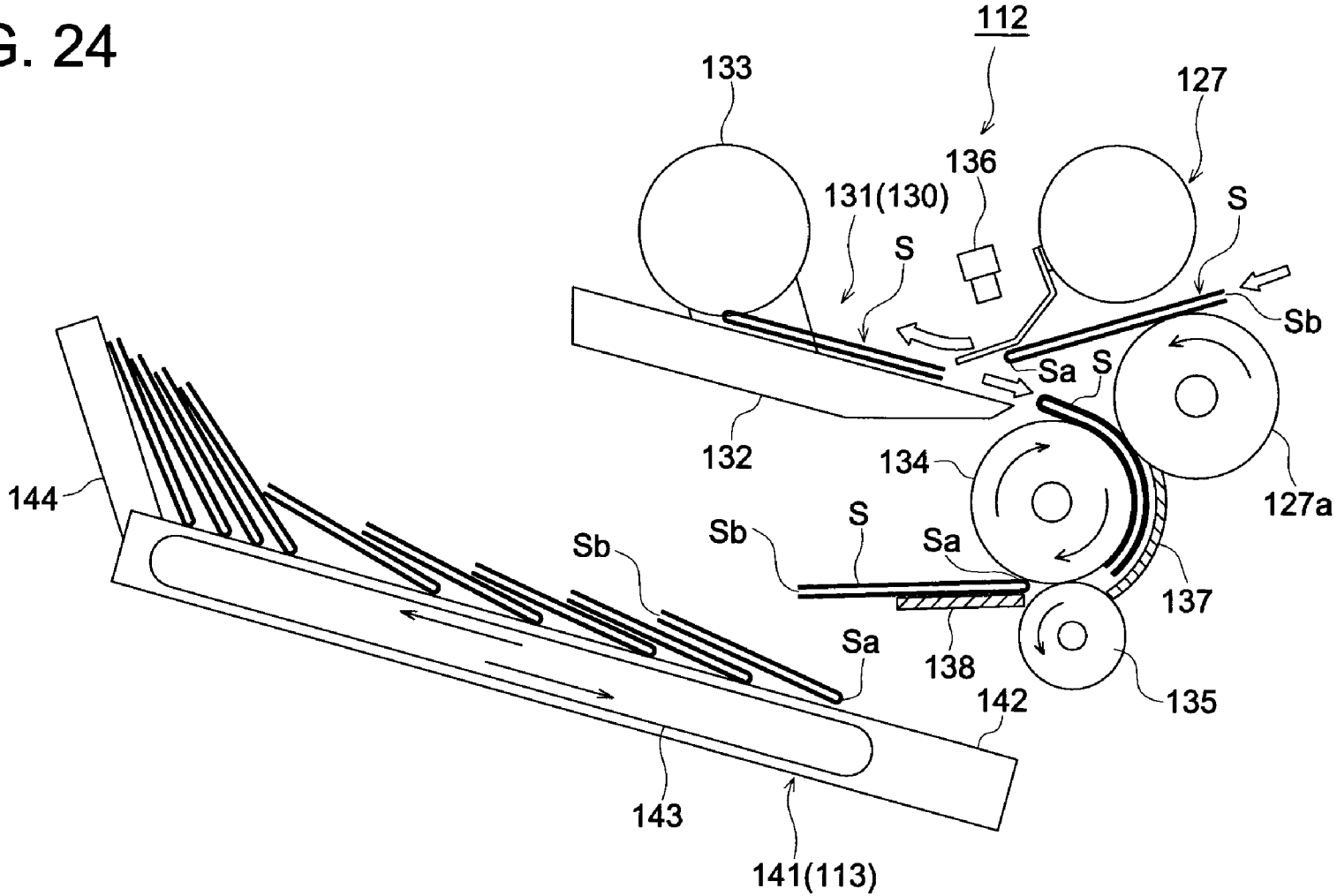
FIG. 24 is a schematic explanatory diagram showing the fifth Example of the sheet ejection unit.

As shown in FIG. 24, the switch-back mechanism 131 includes an inclined reversing tray 132 inclined with the front side higher for receiving sheet bundles S fed out from the sheet ejection guide rollers 127 with the folded portion Sa taking the lead; a switch back roller 133 that, after holding the leading edge of the sheet bundles S fed into the reversing tray 132, reverse-feeds the sheet bundles S to under the sheet ejection guide rollers 127 along the inclination of the reversing tray 132; and feed rollers 134 and 135 that introduces the leading edges of the sheet bundles S having been switched back in collaboration with the lower roller 127*a* of the sheet ejection guide rollers 127, and feeds the sheet bundles out toward the sheet ejection port.

The aforementioned switch back roller 133 is driven in the forward or reverse direction in response to the detection of the switch back sensor 136 provided closed to the outlet of the nip section of the sheet ejection guide rollers 127.

When the sheet bundle S, with the two-folded portion taking the lead, has been fed out from the sheet ejection guide rollers 127 onto the reversing tray 132, and the leading edge thereof has been detected by the switch back sensor 136, the switch back roller 133 is driven in the forward direction. The leading edge of the sheet bundle S coming up on the reversing tray 132 is sandwiched between this the switch back roller 133 and the reversing tray 132, and the sheet bundle S is drawn to a prescribed position. If the trailing edge of the sheet bundle S has passed through the switch back sensor 136, the switch back roller 133 starts to be driven in the reverse direction due to the detection by the switch back sensor 136. Thus, the sheet bundle S is reverse-fed to under the sheet ejection guide rollers 127 along the inclination of the reversing tray 132. The spread portion Sb which is the leading edge is fed to the nip section between the lower roller 127*a* of the sheet ejection guide rollers 127 and feed roller 134. The sheet bundle S having been fed out by the lower roller 127*a* and feed roller 134 is deflected toward the nip section between the feed rollers 134 and 135 by the feed guide 137 which extends around the feed roller 134. The sheet bundle S fed out of the nip section of the feed rollers 134 and 135 is placed by the sheet ejection guide 138 in the sheet ejection condition where the spread portion Sb which is on the leading edge side faces sideways. The sheet bundle S, with the spread portion Sb taking the lead, is then ejected onto the sheet bundle collecting unit 113 from the sheet ejection port.

In the present Example, a general-purpose conveying unit 141 using a belt conveyor is used as the aforementioned sheet bundle collecting unit 113.

To put it another way, the conveying unit 141 is arranged in such a way that the side of the trailing edge thereof is located close to the lower side of the aforementioned sheet ejection section 112. To put it more specifically, the conveying unit 141 is placed close to the lower side of the sheet ejection port (not illustrated). The conveying unit 141 is provided with a conveying section 142 that sequentially receives the sheet bundles S ejected from the sheet ejection section 112 and uses a conveyor 143 to convey the sheet bundles S in a lying state, and a loading section 144 which is provided on the downstream side (leading edge) of the conveying section 142 and which faces upward diagonally.

The aforementioned conveying section 142 is arranged inclined at a prescribed angle so that the downstream side in the direction of conveyance may face upward to facilitate conveyance of the sheet bundle S having an interleaf SS inserted in the free state in the center-folded sheets.

The aforementioned configuration allows the book binding section 111 to center-stitch and center-fold the sheet bundle S. Further, the sheet bundle S having an interleaf SS inserted in the five state in the center-folded sheets is led into the sheet ejection section 112, with the folded portion Sa taking the lead.

In this sheet ejection section 112, the sheet bundle S having passed through the sheet ejection guide rollers 127 is fed onto the reversing tray 132 of the switch-back mechanism 131 and is switched back by the switch back roller 133. Headed by the spread portion Sb, the sheet bundle S is fed to the nip section between the feed rollers 134 and 135, and is placed by the sheet ejection guide 138 in the sheet ejection condition where the spread portion Sb on the leading edge is facing downstream in the direction of conveyance. Then the sheet bundle S is ejected onto the conveying section 142 of the conveying unit 141.

The bookbinding operation of the sheets in the aforementioned book binding section 111 and ejection of the sheets from the sheet ejection section 112 onto the conveying section 142 are controlled by the control unit of the image forming apparatus 100. The sheets are fed from the sheet ejection section 112 at such a time interval that the leading edge of the succeeding sheet bundle S will overlap the trailing edge of the preceding sheet bundle S ejected earlier on the conveying section 142.

Headed by the spread portion Sb, namely, with the spread portion Sb facing downstream in the direction of conveyance, the sheet bundle S having been ejected facing sideways to the conveying section 142 is conveyed in a lying condition to the loading section 144 on the downstream side by the belt conveyer 143. After having reached the loading section 144, the sheet bundles S are sequentially stacked in a standing and leaning position along the rising inclination.

Figure 29A:
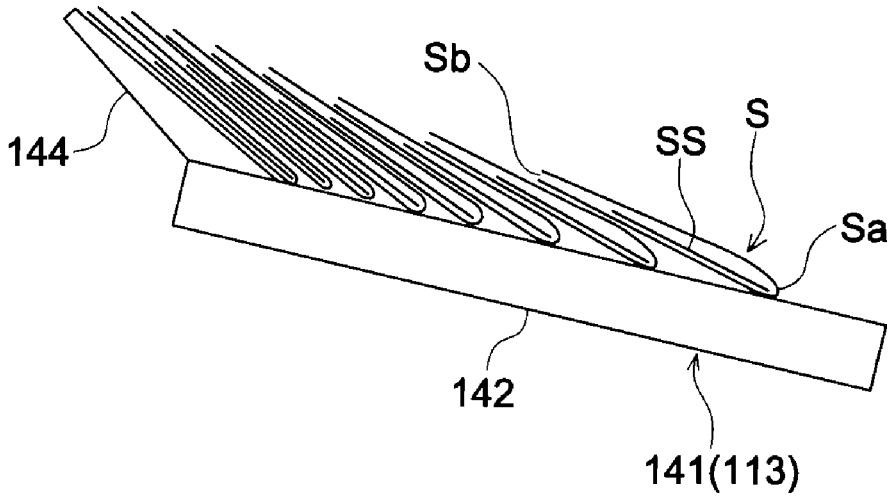
FIGS. 29*a* and 29*b* are perspective diagrams showing the sheet bundles in the process of being stacked by a sheet bundle collecting unit and the state of being loaded.

As described above, with the spread portion Sb facing downstream in the direction of conveyance, the sheet bundles S are conveyed in a lying condition, and are stacked with the spread portion Sb facing upward. As shown in FIG. 29*a*, this arrangement ensures the sheet bundles S to be stacked in an appropriate manner, where the interleaf SS having been inserted in center-folded sheets of the sheet bundle S is protected against slipping down from the spread portion Sb during the process of stacking. In the present Example, the structure is characterized by a rising inclination where the downstream side of the aforementioned conveying section 142 in the direction of conveyance faces upward. This arrangement positively prevents the interleaf SS from slipping downward while the sheet bundle S is conveyed by the conveying section 142.

Figure 29B:
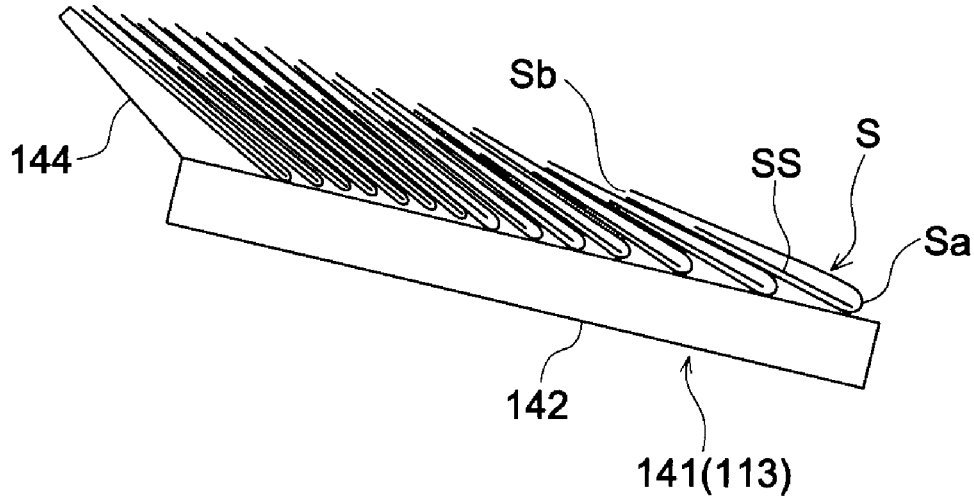

As shown in FIG. 31, the sheet bundle S is center-folded in two, whereby the portion close to the folded portion Sa is swollen. As described above, this sheet bundle S is stacked on the loading section 144 in a standing and leaning position, with the spread portion Sb facing upward. Thus, as shown in FIG. 29*b*, the bulky portion of the sheet bundle S during stacking faces downward. It is intended to prevent the sheet bundle S from being collapsed due to the bulk of the upper portion of the stacked sheet bundle S and to ensure orderly stacking of the sheet bundles.

This arrangement increases the loading amount for the sheet bundles S on the conveying unit 141 at one time, and hence increases the number of the booklets to be bound in one operation.

Figure 30A:
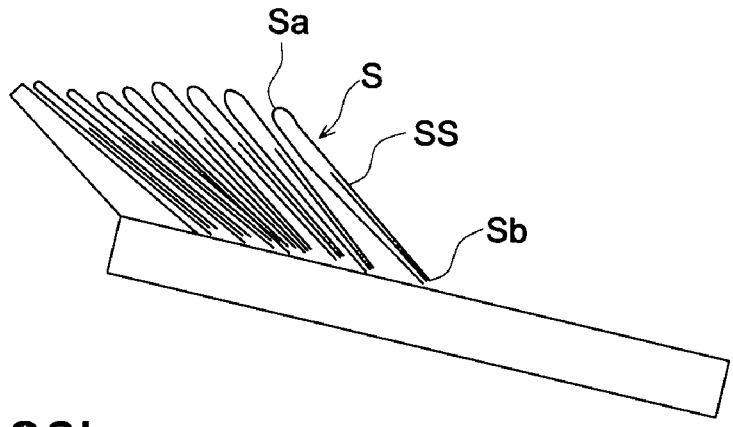
FIGS. 30*a* and 30*b* are perspective diagrams showing the sheet bundles in the process of being stacked and the state of being loaded in a Comparative Example in an embodiment of the present invention.
Figure 30B:
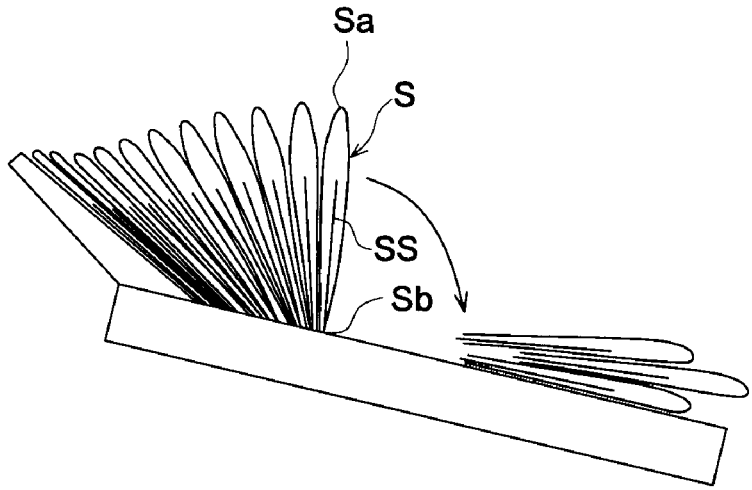

Incidentally, FIGS. 30*a* and 30*b* show comparative examples of the embodiment of the present invention. When the sheet bundle S is conveyed with the folded portion S facing downstream in the direction of conveyance, and the sheet bundle S is placed in a standing and leaning position along the slope of the loading section 14 in the process of stacking as shown in FIG. 30*a*, the interleaf SS inserted in the center-folded sheet with the spread portion Sb faces downward will tend to slip down from the spread portion Sb. Further, when the sheet bundles S are stacked in a standing and leaning position on the loading section 144, the folded portion Sa faces upward. This will cause overlapping of the bulky portions, and will result in an extreme increase of the bulkiness on the upper position, as shown in FIG. 30*b*. Thus, the sheet bundle S will be placed gradually in a further upright position, and will collapse toward the conveying section 142. This will reduce and restrict the loading amount for the sheet bundle S being stacked.

According to the present Example, the sheet bundle collecting unit 113 employs a general-purpose conveying unit 141 including a conveying section 142 equipped with a belt conveyer 143 and a loading section 144 facing obliquely upward and connected to the downstream portion of the conveyance section 142. This allows the existing facilities to be effectively used at a reduced cost.

The reversing section in the sheet ejection mechanism 130 uses a switch-back mechanism 131. This switch-back mechanism 131 receives the sheet bundle S introduced with the folded portion Sa taking the lead, switches the sheet bundle S back, and ejects the sheet bundle S with the spread portion Sb taking the lead, onto the conveying section 142 of the conveying unit 141. This arrangement ensures the sheet bundle S to be reversed and ejected, with the spread portion Sb facing in the direction of sheet ejection.

The sheet bundle S is reversed inside the post-processing apparatus 101. Further, the sheet bundle S is ejected in a leaning position where the spread portion Sb of the sheet bundle S faces downstream in the direction of conveyance. This arrangement prevents the interleaf SS from slipping out of the center-folded sheet of the sheet bundle S in the process of conveyance in a lying condition after the sheet ejection on the aforementioned conveying section 142.

EXAMPLE 6

Figure 25:
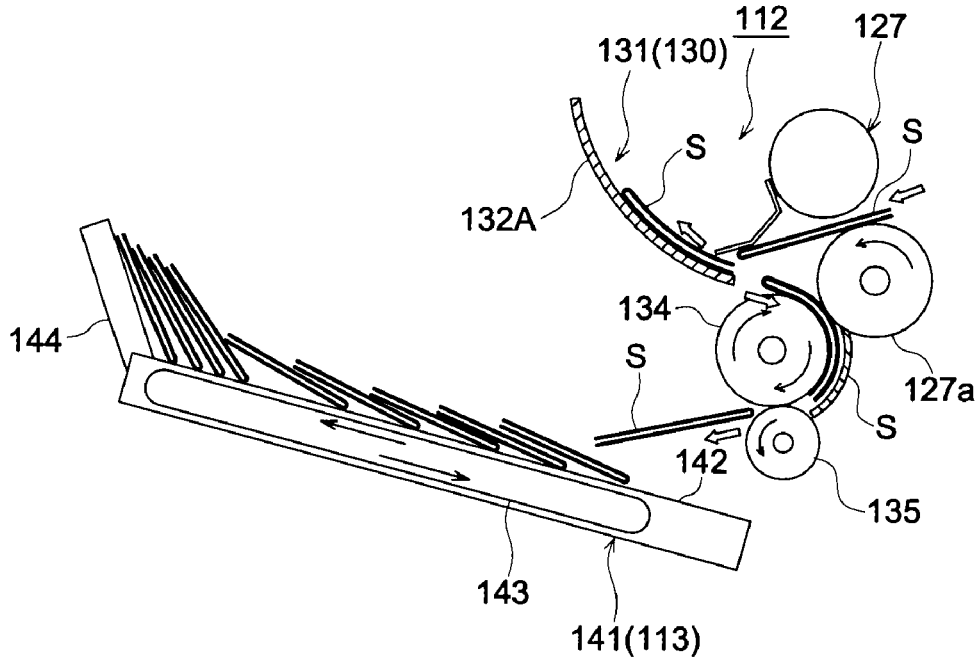
FIG. 25 is a schematic explanatory diagram showing the sixth Example of the sheet ejection unit.

FIG. 25 shows the sixth Example relating to the sheet ejection mechanism 130. In this Example, the aforementioned switch-back mechanism 131 is configured in a simplified form. To put it another way, the reversing tray 132A is formed as a curved tray, which curves obliquely upward. When the sheet bundle S has been fed out onto the curved tray 132A with the folded portion Sa taking the lead, this configuration ensures the sheet bundle S to be switched back along the slope of the curved tray 132A under its own weight.

Thus, the structure of the sixth Example provides the same advantage as that of the aforementioned the fifth Example. Further, this structure simplifies the switch-back mechanism 131 and ensures a substantial cost cutdown.

Figure 26:
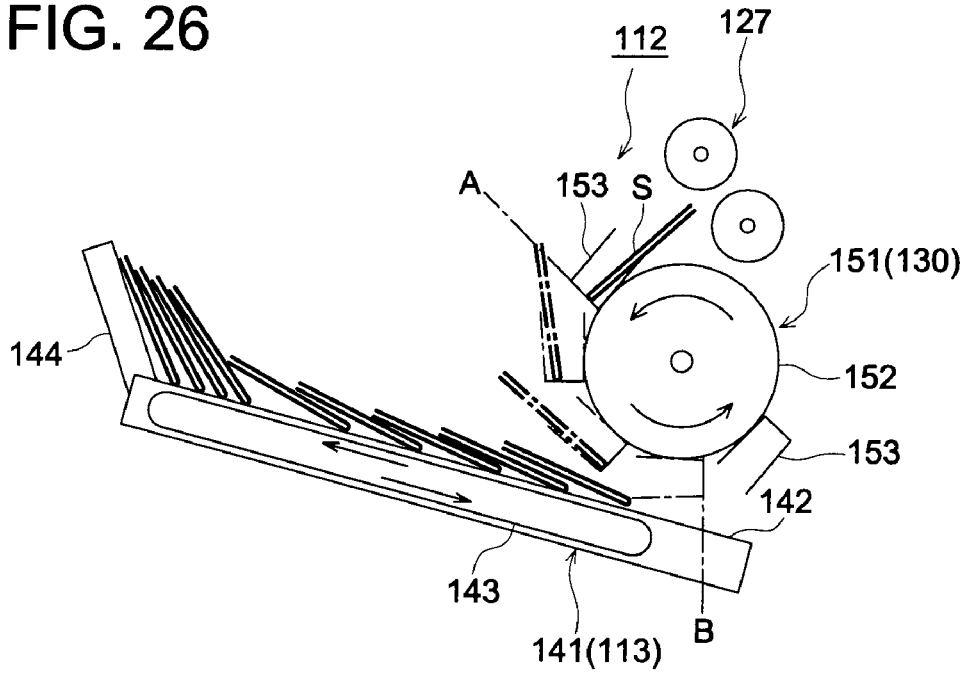
FIG. 26 is a schematic explanatory diagram showing the seventh Example of the sheet ejection unit.

FIG. 26 shows the seventh Example of the sheet ejection mechanism 130. In this Example, as the reversing section of the sheet ejection mechanism 130 a rotary bucket 151 is used, equipped with a rotary member 152 and a pair of buckets 153 provided 180 degrees apart on the peripheral surface of the rotary member 152.

The aforementioned rotary member 152 rotates in the forward direction with respect to the direction in which the sheet bundle S is introduced with the folded portion Sa taking the lead.

In the standby position A on the upper side of the rotary member 152, the bucket 153 acquires the sheet bundle S by capturing the folded portion Sa taking the lead at the time of introduction. When the bucket 153 has been driven and moved to the sheet ejection point B on the lower side of the rotary member 152 from the aforementioned standby position A, the sheet bundles S having been captured are placed in the lying condition where the spread portion Sb is facing downstream in the direction of conveyance under its own weight, and are ejected onto the conveying section 142 of the conveying unit 141.

EXAMPLE 7

Accordingly, in the seventh Example, the same advantages as those of the aforementioned fifth Example can be obtained. Further, the number of required parts is smaller than that in the fifth Example, and cost advantages are provided. In addition, the space of the rotary bucket 151 made up of the rotary member 152 and bucket 153 is reduced, and hence the size of the sheet ejection section 112 is reduced.

EXAMPLE 8

Figure 27:
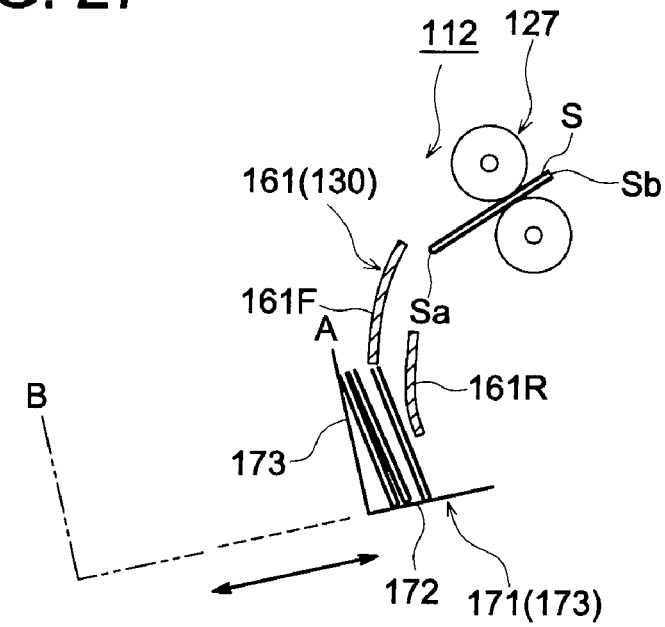
FIG. 27 is a schematic explanatory diagram showing the eighth Example of the sheet ejection unit.

FIG. 27 shows the eighth Example relating to the sheet ejection unit 130. In this Example, the reversing section of the sheet ejection mechanism 130 ensures that the folded portion Sa of the sheet bundle S introduced with the folded portion Sa taking the lead will face down under its own weight, and the sheet bundle S will fall onto the sheet bundle collecting unit 113. Further, the sheet ejection unit 130 is provided with a falling guide member 161 which gives the directivity of falling of the sheet by regulating the orientation of inclination of the sheet bundles S so that the sheet bundles S may be stacked in a leaning position on the sheet bundle collecting unit 113 with the spread portion Sb facing upward after landing.

This falling guide member 161 includes: a curved front guide 161F extending in the vertical direction, with the upper portion of this front guide 161F being set at the position approximately opposed to the nip section of the sheet ejection guide rollers 127; and a curved rear guide 161R arranged at a prescribed space interval with respect to the front guide 161F and extending in the vertical direction, with the upper portion of the rear guide 161R overlapping with the lower portion of the front guide 161F.

The lower end of the front guide 161F is set at such a height that sheet bundles S may be led between these front and rear guides 161F and 161R to be dropped under its own weight, and, when the folded portion Sa of the bottom end has reached the sheet bundle collecting unit 113, the spread portion Sb on the top end can pass through under the lower end of the front guide 161F.

Further, the rear guide 161R is set at such a position that the folded portion Sa of the sheet bundle S slides along the curved surface of the front guide 161F and the sheet bundle S falls down after having been biased to fall over forward. When the sheet bundle S has reached the sheet bundle collecting unit 113, the rear guide 161R slides along the rear surface of the upper side of the sheet bundle S so that backward falling-down can be prevented.

In the present Example, the aforementioned sheet bundle collecting unit 113 is composed of a movable tray 171, which is formed substantially in a form of letter L using a bottom loading surface 172 and a leaning-loading surface 173, and is placed in an inclined position obliquely downward near the sheet ejection section 112, wherein the sheet bundles S ejected by being guided by the falling guide member 161 at the time of falling are sequentially received in a standing and leaning position by the leaning-loading surface 173, and are conveyed in the direction of the inclined position by the movable tray 171.

According to the configuration of the eighth Example, when the sheet bundle S has been led to the falling guide member 161 with the folded portion Sa taking the lead, the folded portion Sa slides along the curved surface of the front guide 161F and the sheet bundle S falls down after having been biased to fall over forward. The folded portion S reaches the bottom loading surface 172 of the movable tray 171. At this moment, the backward falling of the upper portion of the sheet bundle S is prevented by the rear guide 1618, and the sheet bundles S fall into the leaning-loading surface 173 of the movable tray 171 in a half-reversed state, and are stacked in a leaning position onto the leaning-loading surface 173, with the spread portion Sb facing upward.

In the movable tray 171, the position where the aforementioned leaning-loading surface 173 closest to the falling guide member 161 is assumed to be a standby is position A, and the movable tray 171 is moved stepwise toward the sheet bundle take-out position B every time one or plural sheet bundles S have been loaded.

As described above, in the present Example, sheet bundle S led to the sheet ejection section 112 with the folded portion Sa taking the lead is biased to fall over forward by the falling guide member 161, and is guided to fall down in a half-reversed state. When the sheet bundle S has reached the sheet bundle collecting unit 113, the sheet bundle S is stacked on the sheet bundle collecting unit 113 in a standing and leaning position, with the spread portion Sb facing upward. This arrangement ensures that the interleaf SS of the sheet bundle S inserted in the center-folded sheet will not fall down in the process of stacking, and the sheet bundle S will not collapse.

In the present Example, sheet bundle collecting unit 113 is composed of a substantially L-shaped movable tray 171 arranged in an obliquely downward extended form near the sheet ejection section 112. The leaning-loading surface 173 of the movable tray 171 sequentially receives the forward leaning sheet bundles S which is ejected after directivity has been given, as described above. Then the sheet bundle S is stacked in a standing and leaning position. This arrangement ensures the aforementioned interleaf SS will not fall.

Figure 28:
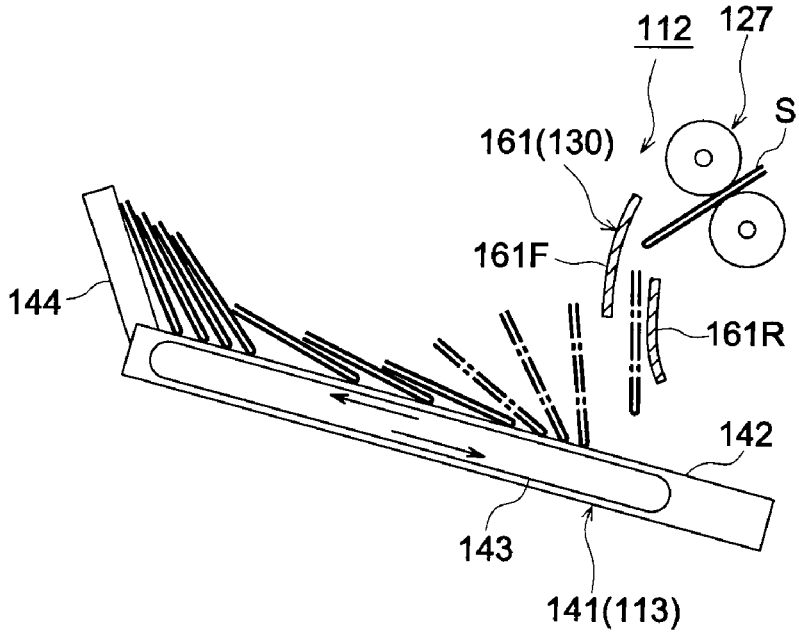
FIG. 28 is a schematic explanatory diagram showing a variation of the eighth Example of FIG. 5.

It goes without saying that, in addition to the aforementioned movable tray 171, the similar conveying unit 141 as those of the aforementioned fifth through the seventh Examples shown in the variations of FIG. 28 can be used as the sheet bundle collecting unit 113.

In this case, with the folded portion Sa taking the lead, the sheet bundle S is biased to fall over forward by the falling guide member 161, and fall down under its own weight. When the sheet bundle S has reached the conveying section 142, the sheet bundle S falls over forward on the conveying section 142 with the spread portion Sb facing downstream in the direction of conveyance and is completely reversed. The sheet bundles S are sequentially loaded in a standing and leaning position on the loading section 144 with the spread portion Sb facing upward.

For the purpose of preventing the interleaf SS from falling, reversing of the sheet bundle S by the falling guide member 161 shown in FIGS. 27 and 28 is preferably performed inside the post-processing apparatus 101. The aforementioned falling guide member 161 can be arranged outside the sheet ejection port (not illustrated) and reversing operation can be performed outside the apparatus.

As described above, adoption of the falling guide member 161 as the sheet ejection unit 130 eliminates the need of using the drive section parts, and hence provides economical advantages.

The post-processing apparatus, control method thereof and image forming system in the Examples of the present invention have been described. It is to be expressly understood, however, that the present invention is not restricted thereto. The present invention can be embodied in a great number of variations, without departing from the scope of the invention claimed. For example, in the description of the aforementioned Examples, when the trailing edge regulating section 43 is moved in response to the sheet size of the insert sheet I, the trailing edge regulating section 43 is moved when the sheet tray 42 is not loaded with any sheet. However, the time of moving the trailing edge regulating section 43 is not restricted thereto. The trailing edge regulating section 43 can be moved at any time before the print sheet P conveyed after the insert sheet I is ejected from the sheet ejection rollers 12.

According to the embodiment in the present invention, when the print sheet is ejected from the sheet ejection section to the sheet tray, the drive section is controlled in response to the size of the insert sheet to ensure that the trailing edge of the print sheet will fall on the surface of the insert sheet loaded as the topmost layer on the sheet tray. This arrangement ensures that the trailing edge of the sheet having fallen from the sheet ejection section to the sheet tray is placed on the surface of the insert sheet loaded on the sheet tray (between the leading edge of the insert sheet and trailing edge regulating section. This minimizes interference between the insert sheet and print sheet, and permits the print sheet and insert sheet having different sizes to be loaded onto the sheet tray, while a paper jam or misalignment is minimized. This arrangement ensures that the print sheet and insert sheet loaded on the sheet tray can be processed, and produces a booklet in the state where an insert sheet is placed between the pages thereof.

Further, according to the embodiment in the present invention, the insert sheet is supplied to the sheet tray along the conveying path. This produces a booklet in the state where an insert sheet is placed therein in a series of booklet producing processes. Further, the execution position of the sheet bundle of center folding or the execution position of center stitching can be shifted as required. This allows a booklet containing an insert sheet to be finished in many variations. This provides a booklet in the state where an insert sheet is placed therein in response to various user requirements.

Further, according to the embodiment in the present invention, the sheet bundle with an interleaf inserted in a free state in the center folded sheet is ejected to the sheet bundle collecting unit by the sheet ejection mechanism in a standing and leaning position, with the spread portion facing upward. This arrangement ensures appropriate loading of the sheet bundle, without the interleaf falling down from the sheet bundle in the sheet bundle stacking process by the sheet bundle collecting unit.

The sheet bundle is loaded onto the sheet bundle collecting unit in a standing and leaning position with the spread portion facing upward. Thus, the bulky portion close to the folded portion is located in the lower portion. This prevents the sheet bundle from collapsing due to the greater bulk on the upper side of the loaded sheet bundle, and ensures orderly loading. This arrangement increases the number of the sheet bundles loaded on the sheet bundle collecting unit in one operation, and hence it increases the number of booklets produced in one operation.

What is claimed is:

1. A post-processing apparatus which produces a booklet by applying a center-folding process or a saddle-stitching process to a sheet, the post-processing apparatus comprising:

a sheet ejection section for ejecting the sheet;

a sheet tray for storing thereon the sheet ejected from the sheet ejection section;

a regulating section for aligning the sheet stored on the sheet tray by coming in contact with an edge of the sheet;

a drive section for moving the regulating section in a direction of sheet ejection or an opposite direction from the direction of sheet ejection;

a control section for moving the regulating section by controlling the drive section such that a third sheet falls onto a sheet surface of a second sheet stored as a top of sheets on the sheet tray when the third sheet is ejected from the sheet ejection section in a situation where the second sheet which has a smaller size than a first sheet in the direction of sheet ejection is stored on the first sheet on the sheet tray; and a processing section for applying the center-folding process or the saddle-stitching process to a bundle of sheets including a plurality of sheets aligned by the regulating section and stored on the sheet tray.

2. The post-processing apparatus of claim 1, further comprising:

a rewinding section for biasing the ejected sheet toward the regulating section by swinging a movable arm every time the sheet is ejected from the sheet ejection section to the sheet tray.

3. The post-processing apparatus of claim 1, wherein the processing section comprises:

a pair of folding rollers; and a folding plate which is arranged to be opposed to the pair of folding rollers with the sheet tray located between the pair of folding rollers and the folding plate and which moves down toward the pair of folding rollers, wherein the processing section applies center folding to the sheet stored on the sheet tray by moving the folding plate down to a center of the first sheet to push the sheet toward the pair of folding rollers.

4. The post-processing apparatus of claim 1, wherein the regulating section comprises a movable section for clamping a trailing edge of the sheet stored on the sheet tray.

5. The post-processing apparatus of claim 1, further comprising:

an introducing section for introducing the second sheet from an image forming apparatus into a body of the post-processing apparatus.

6. The post-processing apparatus of claim 1, further comprising:

a second sheet supply section including a second sheet loading section for loading the second sheet thereon and a sheet feed section for feeding the second sheet having been loaded on the second sheet loading section into a body of the post-processing apparatus.

7. The post-processing apparatus of claim 1, wherein the control section conducts control of the drive section according to a sheet size of the second sheet in a situation where the sheet tray is not loaded with any sheet.

8. The post-processing apparatus of claim 1, wherein the second sheet has a sheet size of half a size of the first sheet or smaller than half a size of the first sheet in the direction of sheet ejection and is an insert sheet which is to be inserted between pages of a booklet.

9. An image forming system comprising:

an image forming apparatus for forming an image on a sheet and for ejecting a first sheet on which an image is formed; and a post-processing apparatus which produces a booklet by applying a center-folding process or a saddle-stitching process to the first sheet ejected from the image forming apparatus, wherein the post-processing apparatus comprises:

a sheet ejection section for ejecting a sheet;

a sheet tray for storing thereon the sheet ejected from the sheet ejection section;

a regulating section for aligning a plurality of sheets stored on the sheet tray by coming in contact with edges of the sheets;

a drive section for moving the regulating section in a direction of sheet ejection or an opposite direction from the direction of sheet ejection;

a control section for moving the regulating section by controlling the drive section such that a third sheet falls onto a sheet surface of a second sheet stored as a top of sheets on the sheet tray when the third sheet is ejected from the sheet ejection section in a situation where the second sheet which has a smaller size than a first sheet in the direction of sheet ejection is stored on the first sheet on the sheet tray; and a processing section for applying the center-folding process or the saddle-stitching process to a bundle of sheets including a plurality of sheets aligned by the regulating section and stored on the sheet tray.

10. The image forming system of claim 9, wherein the image forming apparatus changes a sequence of pages on which images are to be formed for the first sheet such that a page where the second sheet is to be inserted is located on a side of the regulating section, with reference to the first sheet stored on the sheet tray of the post-processing apparatus.

11. The post-processing apparatus of claim 1 further comprising:

a booklet ejection section for ejecting a booklet to which the center-folding process or the saddle-stitching process has been applied by the processing section;

a booklet collecting unit which sequentially receives, near the booklet ejection section, booklets ejected from the booklet ejection section and which collects the booklets to be stacked in a leaning position; and a sheet ejection mechanism arranged in the booklet ejection section for ejecting the booklet in an orientation such that the booklet is ejected to be stacked in the leaning position on the booklet collecting unit with a spread portion facing upward, when a booklet end side folded by the processing section is assumed to be a folded portion, and an opposite side of the folded portion is assumed to be the spread portion.

12. The post-processing apparatus of claim 11, wherein the sheet ejection mechanism comprises a reversing section for reversing the booklet introduced from the processing section and for conveying the booklet with the spread portion taking a lead.

13. The post-processing apparatus of claim 12, wherein the reversing section is included inside a body of the post-processing apparatus.

14. The post-processing apparatus of claim 11,
wherein the booklet collecting unit comprises:
a conveying section which is arranged horizontally or to be inclined such that a downstream side in a conveyance direction is higher that an upstream side and which receives, near the booklet ejection section, the booklet ejected from the sheet ejection mechanism and conveys the booklet in a lying position with the spread portion facing the downstream side in the conveyance direction; and
a loading section provided in an upwardly inclined position, on the downstream side of the conveying section in the conveyance direction, for collecting the booklet in a leaning position.

15. The post-processing apparatus of claim 11,
wherein the booklet collecting unit is a movable tray which is formed substantially in a form of a letter L with a bottom loading surface and a leaning-loading surface and is provided in a downwardly inclined position near the booklet ejection section and further which sequentially receives the booklets ejected from the sheet ejection mechanism in a leaning position on the leaning-loading surface and is fed to travel in an inclination direction of the movable tray.

16. The post-processing apparatus of claim 11,
wherein the sheet ejection mechanism is a switchback mechanism which switches the booklet back to eject the booklet onto the booklet collecting unit with the spread portion taking a lead after receiving the booklet introduced with the folded portion taking a lead.

17. The post-processing apparatus of claim 11,
wherein the sheet ejection mechanism comprises:
a rotary member rotated in a forward direction with respect to an introduction direction of the booklet introduced with the folded portion taking a lead;
a bucket which is provided on a circumferential surface of the rotary member and which acquires the booklet by capturing the folded portion which is taking a lead at time of introduction in a standby position, and
wherein the bucket is constituted of a rotary bucket for ejecting the acquired booklet onto the booklet collecting unit due to own weight of the booklet with the spread portion taking a lead because the bucket is rotated to move from the standby position to an ejection position.

18. The post-processing apparatus of claim 11,
wherein the sheet ejection mechanism ejects the booklet in a lying position.

19. The post-processing apparatus of claim 11,
wherein the sheet ejection mechanism is constituted of a falling guide member which allows the booklet introduced with the folded portion taking a lead to fall with the folded portion facing downward onto the booklet collecting unit due to own weight of the booklet and which gives directivity of falling-over of the booklet by regulating a falling-over direction of the booklet such that, after the booklet reaches the booklet collecting unit, the booklet is collected in a leaning position on the booklet collecting unit with the spread portion facing upward.

20. The post-processing apparatus of claim 11,
wherein the second sheet is an insert sheet which is to be inserted in a free state between pages of the booklet having been subjected to the center-folding process or the saddle-stitching process.

21. The post-processing apparatus of claim 1,
wherein when the booklet is produced by the saddle-stitching process, the processing section applies center stitching and center folding to the bundle of sheets having been loaded on the sheet tray and when the booklet is produced by the center-folding process, the processing section applies center folding to the bundle of sheets having been loaded on the sheet tray, and
wherein the control section calculates a shift amount of an execution position of the center folding or an execution position of the center stitching according to a finishing form of a booklet which includes the second sheet.

22. The post-processing apparatus of claim 21, further comprising:
an acquiring section for acquiring information that the booklet is to be produced by the center-folding process, information on a sheet size of the first sheet and information on a sheet size of the second sheet,
wherein the control section determines, based on a result of acquisition of the acquiring section, whether a center position of the first sheet is to be an execution position of center folding or a position shifted from the center position of the first sheet is to be the execution position of center folding.

23. The post-processing apparatus of claim 22,
wherein the acquiring section further acquires information on a number of total pages of a booklet to be produced, a page where the second sheet is to be inserted and a type of the second sheet and
wherein when the control section has determined to shift the execution position of center folding, the control section calculates the shift amount of the execution position of center folding, based on the sheet size of the first sheet, the sheet size of the second sheet, the number of total pages of a booklet to be produced, the page where the second sheet is to be inserted and the type of the second sheet.

24. The post-processing apparatus of claim 21, further comprising:
an acquiring section for acquiring information that the booklet is to be produced by the saddle-stitching process, information on a sheet size of the first sheet, information on a sheet size of the second sheet and information about whether the second sheet is also to be center-stitched together with the first sheet,
wherein the control section determines, based on a result of acquisition of the acquiring section, whether a center position of the first sheet is to be execution positions of center stitching and center folding or a position shifted from the center position is to be the execution positions of center stitching and center folding.

25. The post-processing apparatus of claim 24,
wherein the acquiring section further acquires information on a type of the second sheet and
wherein when center stitching is not conducted together with the second sheet and the control section has determined to shift the execution positions of center stitching and center folding, the control section calculates a shift amount of the execution positions of center stitching and center folding from a center position of the first sheet based on the sheet size of the first sheet, the sheet size of the second sheet and the type of the second sheet.

26. The post-processing apparatus of claim 24,
wherein the acquiring section further acquires information on a type of the second sheet and an overlap amount which specifies execution positions of center stitching and center folding with reference to a leading edge of the second sheet, and
wherein when center stitching is conducted together with the second sheet and the control section has determined to shift execution positions of center stitching and center folding, the control section calculates a shift amount of execution positions of center stitching and center folding from a center position of the first sheet based on the sheet size of the first sheet, the sheet size of the second sheet, the type of the second sheet and the overlap amount.

27. The post-processing apparatus of claim 21, wherein the control section calculates a shift amount of a position of image forming by an image forming apparatus with reference to the first sheet based on the calculated shift amount.

28. The post-processing apparatus of claim 21, further comprising:

a trimming section for trimming an end of a front edge side of the produced booklet, wherein the control section calculates a shift amount of an execution position of trimming with reference to the booklet based on the calculated shift amount.

29. The image forming system of claim 9, wherein when the booklet is produced by the saddle-stitching process, the processing section applies center stitching and center folding to the bundle of sheets having been loaded on the sheet tray and when the booklet is produced by the center-folding process, the processing section applies center folding to the bundle of sheets having been loaded on the sheet tray, and wherein the control section calculates a shift amount of an execution position of the center folding or an execution position of the center stitching according to a finishing form of a booklet which includes the second sheet.

30. The image forming system of claim 29, wherein the control section calculates a shift amount of a position of image forming by the image forming apparatus with reference to the first sheet based on the calculated shift amount and indicates the shift amount of the position of image forming to the image forming apparatus and wherein the image forming apparatus shifts a position of an image to be formed on the first sheet according to the shift amount of the position of image forming, if the image forming apparatus is indicated the shift amount of the position of image forming from the post-processing apparatus.

31. The image forming system of claim 29, wherein the control section indicates the calculated shift amount to the image forming apparatus and wherein when the shift amount is indicated from the post-processing apparatus, the image forming apparatus calculates a shift amount of a position of image forming with reference to the first sheet and shifts a position of an image to be formed on the first sheet according to the shift amount of the position of image forming.

* * * * *